US005422231A

United States Patent [19]

Nozawa

[11] Patent Number: 5,422,231

[45] Date of Patent: Jun. 6, 1995

[54] PHOTOGRAPHIC PRODUCT

[75] Inventor: Yasushi Nozawa, Kanagawa, Japan

[73] Assignee: Fuji Photo Film Co., Ltd., Japan

[21] Appl. No.: 205,742

[22] Filed: Mar. 4, 1994

[30] Foreign Application Priority Data

Mar. 5, 1993 [JP] Japan ..... 5-069075

[51] Int. Cl.[6] ..... G03C 1/08

[52] U.S. Cl. ..... 430/508; 430/362; 430/496; 430/503; 430/505; 430/506; 430/567

[58] Field of Search ..... 430/508, 505, 503, 506, 430/496, 362, 567; 354/126, 145.11, 149.11

[56] References Cited

U.S. PATENT DOCUMENTS 4,849,325 7/1989 Sasaki et al. ..... 430/505
5,037,728 8/1991 Shiba et al. ..... 430/504
5,057,403 10/1991 Kume et al. ..... 430/496

*Primary Examiner*—Charles L. Bowers, Jr.
*Assistant Examiner*—Geraldine Letscher
*Attorney, Agent, or Firm*—Sughrue, Mion, Zinn, Macpeak & Seas

[57] ABSTRACT

A photographic product having an exposure function is described, which has therein a built-in color photographic material comprising a support having provided thereon at least one red-sensitive emulsion layer, at least one green-sensitive emulsion layer and at least one blue-sensitive emulsion layer and having a specific photographic sensitivity of 640 or more, wherein the built-in color photographic material is characterized by blue, green and red density function curves D (logE) in which in each curve a region defined by a gamma ($<\gamma>=dD/dlogE$) of 0.4 or more is 2.8 or more as logE.

4 Claims, 2 Drawing Sheets

PHOTOGRAPHIC PRODUCT

FIELD OF THE INVENTION

The present invention relates to a photographic material-loaded photographic article with an exposure function (hereinafter referred to as a photographic product having an exposure function) or, that is, a so-called lens-combined film. In particular, it relates to a photographic material-loaded photographic article with an exposure function, which gives satisfactory photographs under various light conditions, for example, for popular indoor photographing and also for cloudy or fine, daytime outdoor photographing.

BACKGROUND OF THE INVENTION

So-called lens-combined films which have heretofore been sold commercially in the market are essentially grouped into two groups; one including those for outdoor photographing in fine or light cloudy weather, and the other including those with a built-in electronic flash for indoor close photographing. Conventional photographic material-loaded photographic articles with an exposure function such as, for example, those described in JP-B-2-32615 (the term "JP-B" as referred to herein means an "examined Japanese patent publication), JP-B-U-3-39784 (the term "JP-B-U" as used herein means an "examined Japanese utility model publication"), Japanese Utility Model Application Nos. 61-75091, 61-75794, 61-136276, 61-246977, 61-246978, etc. and Japanese Utility Model Application Nos. 61-126942 and 61-139993 (corresponding to JP-A-U-64-544 and JP-A-U-63-45552, respectively (the term "JP-A-U" as used herein means an "unexamined published Japanese utility model application")) are such that a photographic material fitted in a cartridge in accordance with the film size is cased in a case equipped with a lens, a shutter, a finder, a flash and other functions and the case is packaged.

Where a lens-combined film for outdoor photographing is used in fine or light cloudy weather, it exhibits a sufficient system sensitivity; but when it is used in the evening or on a rainy day or, even though on a fine day, when it is used in the shade or is directed to an object with a back light thereto, its system sensitivity will be insufficient to cause under-exposure with the result that the finished photographs are unsatisfactory. Thus, conventional lens-combined films for outdoor photographing were often disadvantageous in this respect.

On the other hand, in case of a lens-combined film for indoor photographing, it may exhibit a sufficient system sensitivity when the distance from it to an object is within 3 meters, but its system sensitivity will be insufficient to cause under-exposure in a longer distance with the result that the finished photographs are unsatisfactory. Thus, conventional lens-combined films for indoor photographing were also disadvantageous in this respect.

SUMMARY OF THE INVENTION

Accordingly, one object of the present invention is to provide a color photographic material-loaded photographic article with an exposure function, which gives satisfactory photographs under various light conditions, for example, for popular indoor photographing and also for cloudy or fine, daytime outdoor photographing.

Another object of the present invention is to provide a color photographic material-loaded photographic article an unadjustable exposure function, which gives photographs having a high color saturation with compensating the insufficiency in the system sensitivity even in dark cloudy weather or when using an electronic flash in a distance of 3 meters or more to several meters and which also gives sufficiently satisfactory color photographs even when used on the shore in a bright summer season or used in high mountains.

The above-mentioned objects of the present invention have been attained by a photographic product having an exposure function, which has therein a built-in color photographic material comprising a support having provided thereon at least one red-sensitive emulsion layer, at least one green-sensitive emulsion layer and at least one blue-sensitive emulsion layer and having a specific photographic sensitivity of 640 or more, the color photographic material in the article being characterized in that, in all the blue, green and red density function curves D (logE), the region of the point gamma ($<\gamma>=dD/dlogE$) of being 0.4 or more is in the range of 2.8 or more as logE.

As one preferred embodiment of the present invention, the color photographic material in the product satisfies the following magnitude IE (X/Y) of the interlayer effects:

$0.15<IE\ (R/G)$,
$-0.05<IE\ (R/B)$,
$0.10<IE\ (G/R)$,
$0.15<IE\ (G/B)$,
$0.03<IE\ (B/G)$, and
$0.15<IE\ (B/R)$, wherein IE (X/Y) indicates the magnitude of the interlayer effect from a color-sensitive layer X to a color-sensitive layer Y, and G, B and R indicate a green-sensitive layer, a blue-sensitive layer and a red-sensitive layer, respectively.

As another preferred embodiment of the present invention, the article has a built-in electronic flash, and the lens in the article has a fixed aperture and the shutter in the same has a fixed shutter speed.

As still another preferred embodiment of the present invention, the fixed aperture (F value) of the lens is from 8 to 16, the fixed shutter speed is from 1/50 to 1/200 seconds, and the guide number of the electronic flash is from 7.5 to 15 for a photographic material having an ISO sensitivity of 100.

DETAILED DESCRIPTION OF THE INVENTION

Figure 1:
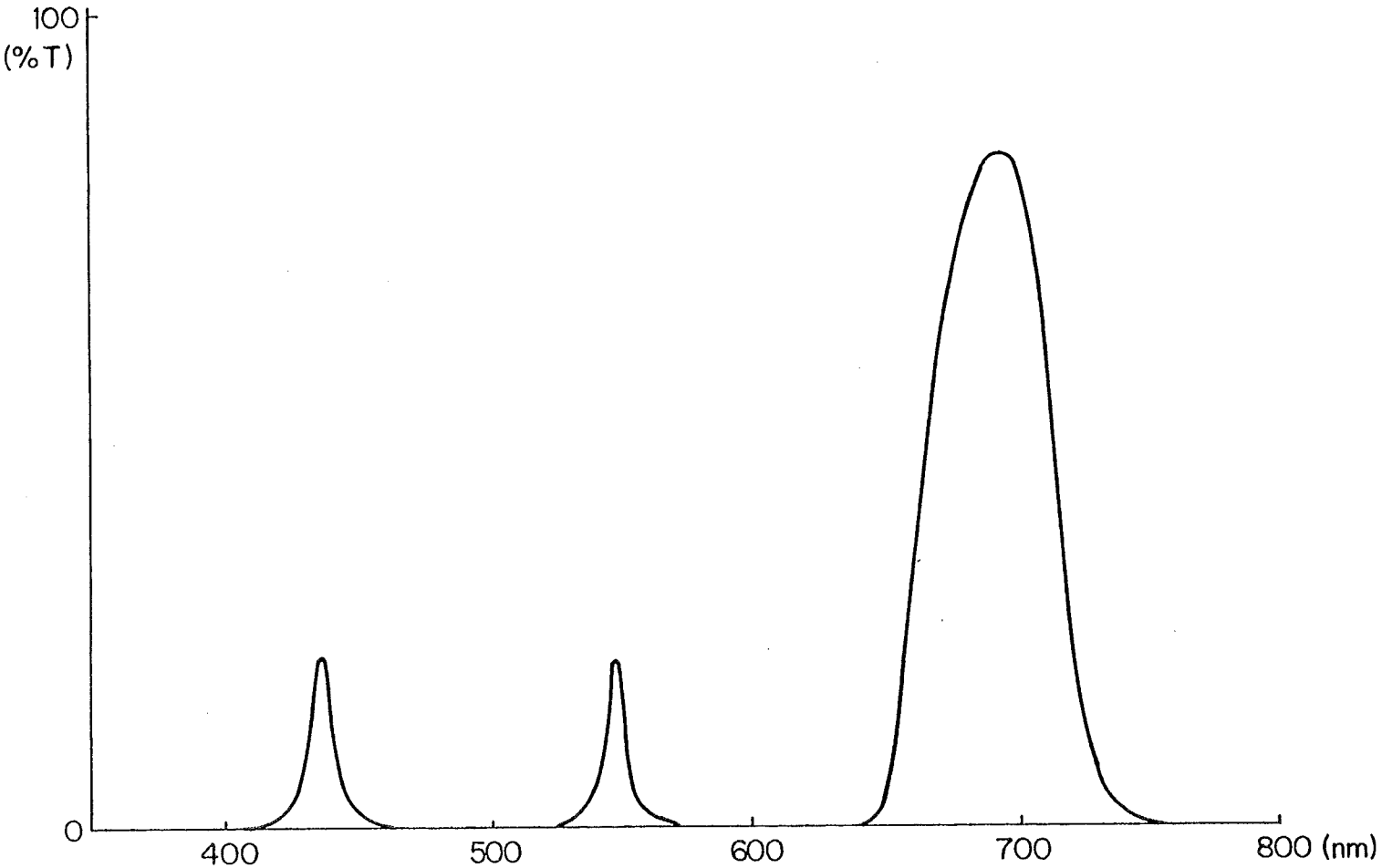
FIG. 1 shows a spectral characteristic of blue, green and red filters to be used for measurement of the density of a photographic material and for determination of the specific photographic sensitivity of the same.

The system sensitivity of a lens-combined film for outdoor photographing is determined, depending upon the F value of the lens, the shutter speed and the sensitivity of the photographic material; while that for indoor photographing depends upon the F value of the lens, the guide number of the electronic flash and the sensitivity of the photographic material.

If the system sensitivity is desired to be elevated by reducing the F value of the lens, the depth of field is reduced so that the focusing range will be narrowed. In order to compensate the disadvantages, for example, it may be considered to impart an auto-focusing mechanism to the system, which, however, will be accompanied by the elevation of the cost and the increase of the weight of the system in view of the current technical level in this field to after all inevitably detract from the low cost and the handiness of lens-combined films, though both being the great advantages of them. As another means, it may also be considered to use a wide angle lens to relatively make the depth of field large, which, however, will naturally lower the picture-taking magnification. Therefore, such a wide angle lens is not preferable except for particular uses.

Therefore, in order to ensure almost satisfactory focal points in the necessary broad range from a short distance of approximately 1 to 2 meters to a distance of 10 meters or more in consideration of most general uses for commemorative pictures or snapshots, the larger the better for the F value. For example, it is desirably 8 or more.

On the other hand, if the system sensitivity is desired to be elevated by making the shutter speed low, troubles of camera shaking or object shaking to cause blurs of pictures will occur naturally. A means of increasing the guide number of the electronic flash for indoor photographing is known, which will also be accompanied by the elevation of the cost and the increase of the weight of the system in view of the current technical level in this field to after all inevitably detract from the low cost and the handiness of lens-combined films, though both being the great advantages of them.

Ultra-high sensitivity color negative films having an ISO sensitivity of 1000, 1600 or 3200 have been sold in the market by various companies. Using such high-sensitivity films, the inventors of the present invention tried to compensate the insufficiency in the system sensitivity in dark cloudy weather or in using an electronic flash in a distance of 3 meters to several meters and obtained relatively satisfactory results, while in outdoor photographing on the shore in a bright summer season or in high mountains, we obtained only flat and unsatisfactory pictures. For the latter, therefore, such high-sensitivity films could not be put to practical use.

As mentioned above, such high-sensitivity films surely exhibited relatively satisfactory results for the purpose of compensating the insufficiency in the system sensitivity in dark cloudy weather or in using an electronic flash in a distance of 3 meters to several meters. However, comparing the pictures obtained with those obtained with an exposure-adjustable ordinary camera loaded with a color negative film having an ISO sensitivity 100 or 400, the former were inferior to the latter with respect to the color saturation.

As a means for improving the color saturation of color photographic light-sensitive materials, it has heretofore been known to utilize an interlayer effect. By way of example of color negative photographic materials, the coloration in the red-sensitive layer by white exposure can be made lower than that by red exposure, by imparting a development-inhibiting effect (that is, an interlayer effect) from the green-sensitive layer to the red-sensitive layer. In a color negative paper system, since the gradation has been so balanced that gray is reproduced on the color print when the paper is exposed with a white light, the above-mentioned interlayer effect gives a cyan color with a higher density on the negative by red exposure than by white exposure with the result that it is possible to reproduce a cyan-lowered red having a higher saturation on the print. Analogously, the interlayer effect from the red-sensitive layer to the green-sensitive layer results in reproduction of green with a higher saturation.

Utilizing the effect, JP-A-1-182847 (the term "JP-A" as used herein means an "unexamined published Japanese patent application") (corresponding to EP 00324471A) has described a color photographic material having high color reproducibility and tone reproducibility, which gives a high-saturation color image. The patent publication refers to in detail a method of imparting the interlayer effect to the photographic material, but it is silent on the sensitivity of the photographic material. Presuming it from the working examples, the photographic material will have an ISO sensitivity of 100 or so.

The present invention will be explained in detail hereunder.

The photographic material-loaded photographic article with an exposure function according to the present invention must have therein a built-in color photographic material having a specific photographic sensitivity of 640 or more. More preferably, it has therein a built-in color photographic material having a specific photographic sensitivity of 800 or more. The upper limit of the specific photographic sensitivity of the photographic material is not specifically defined but is preferably 3200 or less.

The specific photographic sensitivity as referred to herein is a sensitivity that has been obtained in accordance with the definition described in JP-A-63-226650 (corresponding to U.S. Pat. No. 5,091,293). This is a sensitivity similar to the international standard ISO sensitivity, but in order to reduce the indeterminateness as much as possible, it has been obtained by measuring the densities of a photographic material while the period of time from exposure to development of the material has been shortened, the conditions for the development have been defined to constant ones and filters having spectral characteristics close to color sensitivities of various kinds of color papers have been used.

Precisely, the test for obtaining the specific photographic sensitivity in question is carried out in a room having a temperature of 20°±5° C. and a relative humidity of 60±10%, and the photographic material to be tested is allowed to stand under the settled condition for one hour or more before it is tested. The exposure of the material is effected in accordance with a method varying the relative spectral energy and the illuminance, such as that described in JP-A-63-226650. The exposure time in the method is 1/100 second. The process from the exposure to the development is quite the same as that described in JP-A-63-226650.

The measurement of the densities of the photographic material to be tested and the determination of the specific photographic sensitivity of the same are carried out just in the same manner as that described in JP-A-63-226650, except that the densities are measured by the use of blue, green and red filters having the spectral characteristics as shown in FIG. 1, in place of the status M density.

Next, the point gamma ($<\gamma>=dD/dLogE$) in the density function curve D (LogE) as referred to herein will be explained below.

The point gamma $<\gamma>$ as referred to herein is one that has been calculated in accordance with the following equation, using the same blue, green and red density function curves D (LogE) (that is, so-called characteristic curves) as those used for calculating the above-mentioned specific photographic sensitivity.

$$<\gamma>=dD/d\text{Log}E$$

For the meaning of the equation, for example, T. H. James, The Theory of the Photographic Process (4th Ed.), p. 502 (published by MacMillan Publishing Co., Inc., New York, (1977)) is referred to.

The color photographic material according to the present invention must be such that the region of the point gamma $<\gamma>$ in all the blue, green and red density function curves D (logE) of being 0.4 or more is in the range of 2.8 or more as logE. That is, the built-in color photographic material for use in the present invention is characterized by blue, green and red density function curves D (logE) in which in each curve a region defined by a gamma $<\gamma>$ of 0.4 or more is 2.8 or more as logE. Preferably, the region of being 0.4 or more is in the range of 3.0 or more, more preferably, 3.2 or more. The upper limit of the region of the point gamma $<y>$ of being 0.4 or more is determined, depending upon the degree of the depression of the sharpness due to the increase of the thickness of the film to be caused by the increase of the necessary amounts of the couplers and silver to be caused because of the elevation of the limit of the range of the point gamma of being 0.4 or more, and also upon the cost of the photographic material itself. Therefore, the upper limit could not be determined indiscriminately, as depending upon the properties of the couplers and the emulsions constituting the photographic material and also upon the mean point gamma $<\gamma>$ within the defined range, but typically, it is preferably 4.0 or less.

Nevertheless, the point gamma $<\gamma>$ within the defined range must be 0.4 or more, and it is preferably from 0.5 to 1.0, more preferably from 0.6 to 0.9.

The color photographic material according to the present invention must be such that the region of the point gamma $<\gamma>$ in all the blue, green and red density function curves D (logE) of being 0.4 or more is in the range of 2.8 or more as logE, as mentioned above. Even if the region of the point gamma $<\gamma>$ of being 0.4 or more in one or two layers of the photographic material is broad, the photographic article of present invention may exhibit the effect in its own way. However, in consideration of the reproducibility of the white background area in the pictures to be taken in bright fine weather, the point gamma $<\gamma>$ in all the constitutive layers must be 0.4 or more in the defined broad range.

The photographic material-loaded photographic article with an exposure function according to the present invention is in the form of a packaged unit, and it has an exposure function composed of a picture-taking lens, such as a single lens or a non-spherical lens, and a shutter mechanism, along with a housing room (or a roll film-focusing room) having a color photographic film roll directly therein or as cased in a case. Preferably, the photographic material is directly housed in the housing room. If desired, the photographic material may be cased in a patrone or a cartridge.

The picture-taking lens to be in the photographic article of the present invention may have either a variable aperture stop or a fixed aperture stop. In order to make the photographic material-loaded photographic article simple and handy, the lens is desired to have a fixed aperture stop. The lens stop (F value) is preferably from 8 to 16, more preferably from 9 to 14.

The shutter speed may be either variable or fixed, but it is preferably fixed like the aperture stop. Preferably, it is from 1/50 to 1/200 second, more preferably from 1/80 to 1/160 second.

In order to favorably attain the object of the present invention or to obtain a photographic material-loaded photographic article with an exposure function, which gives satisfactory photographs under various light conditions, for example, for popular indoor photographing and also for cloudy or fine, daytime outdoor photographing, it is desired that the article has therein a built-in electronic flash. If it is desired to take pictures of even remote objects in a room or in the nighttime, it is naturally preferred that the article has therein a built-in electronic flash having a large guide number. However, in view of the object of the present invention providing a lightweight and handy photographic article, it is preferred that the guide number of the built-in electronic flash to be therein is within the range of from 7.5 to 15, more preferably from 8 to 13, for photographic materials having an ISO sensitivity of 100. The guide number of an electronic flash is a terminology which is well known in this technical field, and it is explained in detail, for example, in Encyclopaedia for Photography (published by Kohdan-sha Publishing Co.). By the combination of the photographic material according to the present invention having a specific photographic sensitivity of 640 or more and a relatively small-sized electronic flash, a lightweight and handy photographic article with an exposure function and with a built-in photographic material may be obtained, which gives satisfactory photographs under various light conditions, for example, for popular indoor or nighttime photographing in a distance of up to several meters.

Next, the magnitude IE (X/Y) of the interlayer effect of the present invention will be explained below.

Figure 2:
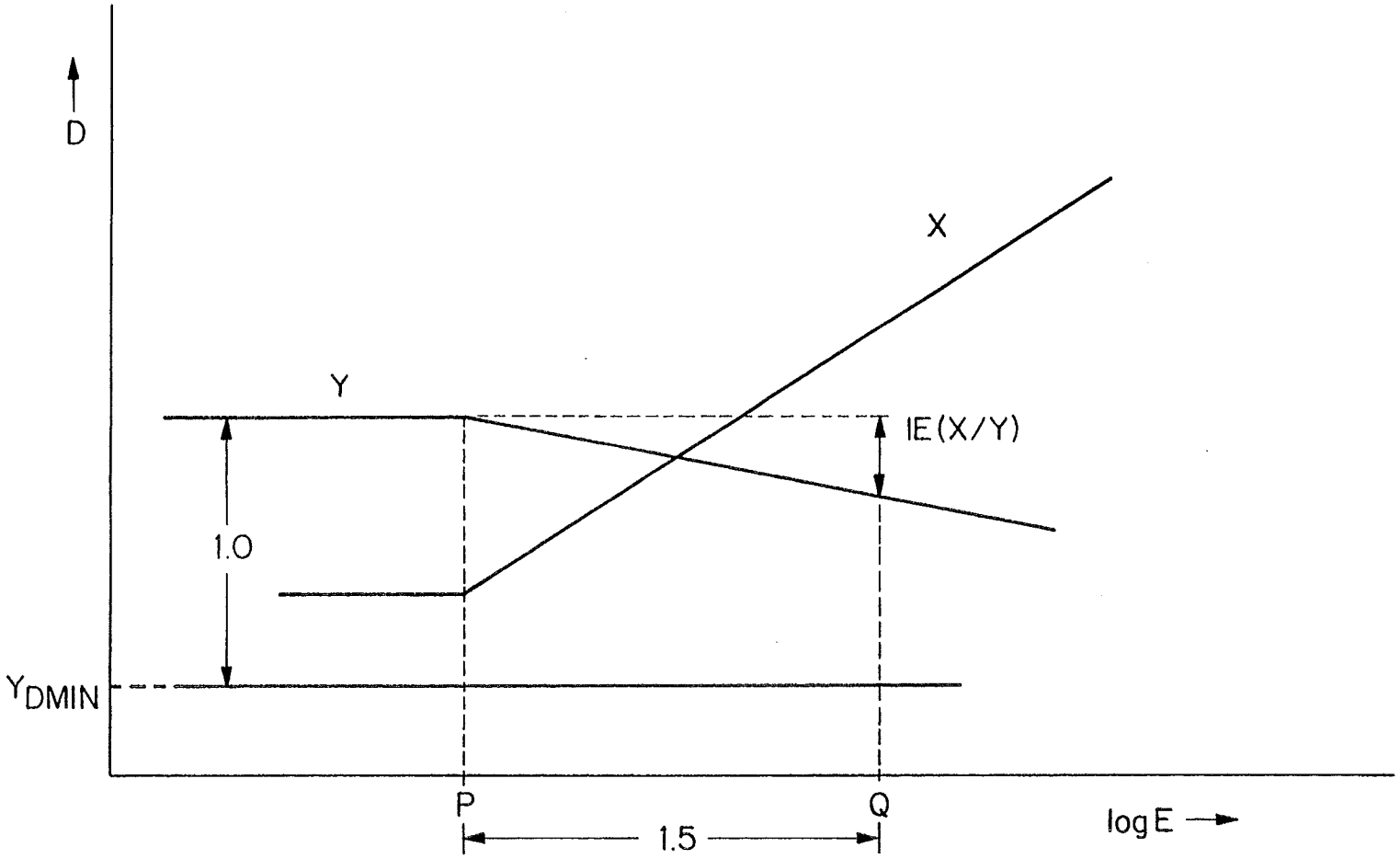
FIG. 2 shows characteristic curves for obtaining the magnitude IE (X/Y) of the interlayer effect of a photographic material.

IE (X/Y) indicates the magnitude of the interlayer effect from X to Y, which is obtained by the method shown in FIG. 2. In FIG. 2, $Y_{DMIN}$ indicates the minimum density of a color-sensitive layer Y to be obtained by stepwise exposure to a color-sensitive layer X.

For instance, the magnitude IE (G/R) of the interlayer effect from a green-sensitive layer to a red-sensitive layer may be obtained in the manner mentioned below.

First, a photographic material sample is stepwise exposed to a green light (using a filter of BPN-55, produced by Fuji Photo Film Co., Ltd.) and then uniformly exposed to a red light (using a filter of SC-60, produced by Fuji Photo Film Co., Ltd.) to have a density of $R_{DMIN}+1.0$ to obtain the characteristic curve of FIG. 2. In the characteristic curve, the depression of the density of the red-sensitive layer during the period while the fog density in the green-sensitive layer moves to the higher exposure side from the exposure amount P, which gives the fog density, by 1.5 logE is obtained, and this is referred to as IE (G/R).

The interlayer effect from the blue-sensitive layer to the red-sensitive layer is obtained in the same manner, using a blue light (through a filter of BPN-45, produced by Fuji Photo Film Co., Ltd.).

IE (X/Y) may be a positive value or a negative value. This is because of the color turbidity due to the side absorptions of the color couplers in a photographic material. A negative value of IE (X/Y) do not mean the ineffectiveness in the interlayer effect.

It is preferred that the interlayer effects are present in the built-in color photographic material for use in the present invention in the following magnitude IE (X/Y):

$0.15 < IS\ (R/G)$,
$-0.05 < IE\ (R/B)$,
$0.10 < IE\ (G/R)$,
$0.15 < IE\ (G/B)$,
$0.03 < IE\ (B/G)$, and
$0.15 < IE\ (B/R)$, wherein IE (X/Y) indicates the magnitude of the interlayer effect from a color-sensitive layer X to a color-sensitive layer Y, and G, B and R indicate a green-sensitive layer, a blue-sensitive layer and a red-sensitive layer, respectively.

Where the saturation is desired to be elevated by utilizing the interlayer effect in general, the relation between the sensitivity and the color saturation is such that the former trades off for the latter and vice versa. In order to satisfy both the desired magnitude of the interlayer effect and the high sensitivity in the present invention, not only the ideal ratio of sensitivity/graininess in the silver halide emulsions, which is the eternal theme for those skilled in the art including the inventors of the present invention, is utilized but also the interlayer effect-yielding techniques which will be mentioned below may be utilized.

First, the mean AgI content in the silver halide emulsions in all the red-sensitive layers and all the green-sensitive layers is defined to be from 2 to 5 mol %. The increase in the AgI content in the emulsion yields the interlayer effect due to the iodide ions but, on the other hand, the emulsion itself is hardly affected by the interlayer effect. The inventors of the present invention have found, as a result of our studies, that the defined range of the AgI content gives a further larger interlayer effect with still maintaining the high sensitivity.

Secondly, DIR compounds of formula (1) or (2) which will be mentioned below are used. By employment of these compounds, it has become possible to increase the interlayer effect from a color-sensitive layer which is nearer to the support to a color-sensitive layer which is remoter from the support (in general, from a red-sensitive layer to a green-sensitive layer, or from a red-sensitive layer to a blue-sensitive layer), though the generation of the interlayer effect between them has heretofore been very difficult.

Thirdly, yellow-colored cyan couplers which will be mentioned below are utilized, by which the masking of a blue-sensitive layer from a red-sensitive layer has become enhanced.

By the use of these DIR compounds of formula (1) or (2) and the yellow-colored cyan couplers, it has become possible to increase the interlayer effect from a red-sensitive layer to a green-sensitive layer or to a blue-sensitive layer in well balanced proportions.

The silver halide grains to be employed in the present invention are grains of silver bromide, silver chloride, silver iodide, silver chlorobromide, silver chloroiodide, silver iodobromide and/or silver chloroiodobromide. They may contain, if desired, other grains of silver salts, such as silver rhodanide, silver sulfide, silver selenide, silver carbonate, silver phosphate and silver salts of organic acids, as separate grains or as parts of them. In order to suitably inhibit the development of silver halide emulsions, the emulsions preferably contain silver iodide. The silver halide emulsions for use in the present invention comprise silver halide grains having a silver iodide content of from 1 to 30 mol %, preferably from 1.5 to 15 mol %, especially preferably from 2 to 10 mol %.

In the photographic material according to the present invention, the mean AgI content of the silver halide grains in all the red-sensitive layers and/or all the green-sensitive layers is preferably from 2 to 5 mol %, more preferably from 3 to 4 mol %. The mean AgI content of the silver halide grains in all the red-sensitive layers means a value to be obtained by dividing the molar amount of all the silver iodide grains (AgI) in all the red-sensitive emulsion layers by the molar amount of all the silver halide grains (AgX) in the same followed by multiplying the resulting quotient by 100.

In the photographic material according to the present invention, it is desired that at least one emulsion layer of all the constitutive red-sensitive layers and green-sensitive layers has a mean AgI content of 6 mol % or less.

DIR compounds which are employed in the present invention are preferably those of the following formula (1) or (2):

$$(1)\ A-(L_1)_j-(L_2)_m-[(L_3)_n\text{-}PUG]_s$$

wherein A represents a coupler residue or a redox group;

$L_1$ and $L_3$ each represents a divalent timing group;

$L_2$ represents a trivalent or higher polyvalent timing group;

PUG represents a photographically useful group;

j and n are independently 0, 1 or 2;

m is 1 or 2;

s is an integer obtained by subtracting 1 (one) from the valence of $L_2$ and is 2 or more; and when the molecule has plural $L_1$'s, $L_2$'s and/or $L_3$'s, they may be the same or different, and when the molecule has plural PUG's, they may be the same or different.

$$(2)\ A-L_4-L_5\text{-}PUG$$

wherein A and PUG have the same meanings as those in formula (1);

$L_4$ represents —OCO—, —OSO—, —$OSO_2$—, —OCS—, —SCO—, —SCS— or —$WCR_{11}R_{12}$—, in which W represents an oxygen atom, a sulfur atom or a tertiary amino group (—$NR_{13}$—), $R_{11}$ and $R_{12}$ independently represent a hydrogen atom or a substituent, $R_{13}$ represents a substituent, and any two of $R_{11}$, $R_{12}$ and $R_{13}$ may be divalent groups and bonded to form a cyclic structure; and $L_5$ represents a group which releases PUG by electron transfer along the conjugated system, or it has the same meaning as $L_4$.

The DIR compounds of formulae (1) and (2) will be explained in detail hereunder.

In formula (1), A represents a coupler residue or a redox group.

The coupler residue of A includes, for example, yellow coupler residues (e.g., open-chain ketomethylene-type coupler residues from, for example, acylacetanilides or malondianilides), magenta coupler residues (e.g., 5-pyrazolone-type, pyrazolotriazole-type or imidazopyrazole-type coupler residues), cyan coupler residues (e.g., phenol-type or naphthol-type coupler residues, imidazole-type coupler residues such as those described in European Patent 249,453, or pyrazolopyrimidine-type coupler residues such as those described in European Patent 304,001) and colorless dye-forming coupler residues (e.g., indanone-type or acetophenone-type coupler residues). In addition, it further includes heterocyclic coupler residues such as those described in U.S. Pat. Nos. 4,315,070, 4,183,752, 4,174,969, 3,961,959, 5,171,223, and JP-A-52-82423.

The redox group of A is a group which may be cross-oxidized by the oxidation product of a developing agent, and it includes residues of hydroquinones, catechols, pyrogallols, 1,4-naphthohydroquinones, 1,2-naphthohydroquinones, sulfonamidophenols, hydrazides and sulfonamidonaphthols. These residues are concretely described in, for example, JP-A-61-230135, JP-A-62-251746, JP-A-61-278852, U.S. Pat. Nos. 3,364,022, 3,379,529, 3,639,417 and 4,684,604, and *J. Org. Chem.*, 29, 588, (1964).

In formula (1), $L_1$ preferably includes the following groups.

(1) Groups utilizing cleavage of hemiacetals.

These are described in, for example, U.S. Pat. No. 4,146,396, JP-A-60-249148 and JP-A-60-249149 and are represented by the following formula (T-1) where * indicates the position at which the group is bonded to A or $L_1$ in formula (1), and ** indicates the position at which it is bonded to $L_1$ or $L_2$ in the same.

$$*\text{—}(W\text{—}CR_{11}(R_{12}))_t\text{—}** \qquad \text{(T-1)}$$

wherein W represents an oxygen atom, a sulfur atom or —$NR_{13}$—;

$R_{11}$ and $R_{12}$ each represents a hydrogen atom or a substituent;

$R_{13}$ represents a substituent; and t is 1 or 2.

When t is 2, two (—W—$CR_{11}(R_{12})$—)'s may be the same or different. Typical examples of the substituents of $R_{11}$, $R_{12}$ and $R_{13}$ are $R_{15}$—, $R_{15}CO$—, $R_{15}SO_2$—, $R_{15}(R_{16})NCO$— and $R_{15}(R_{16})NSO_2$—, where $R_{15}$ represents an aliphatic group, an aromatic group or a heterocyclic group, and $R_{16}$ represents a hydrogen atom, an aliphatic group, an aromatic group or a heterocyclic group. Any two of $R_{11}$, $R_{12}$ and $R_{13}$ may be divalent groups and bonded to form a cyclic structure.

Specific examples of the groups of formula (T-1) are as follows:

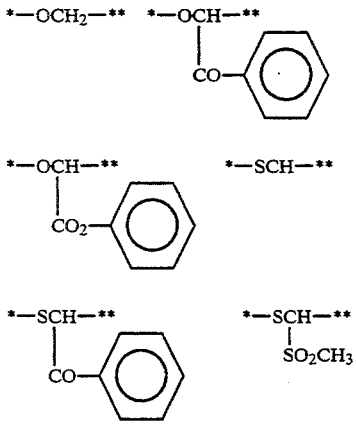

-continued

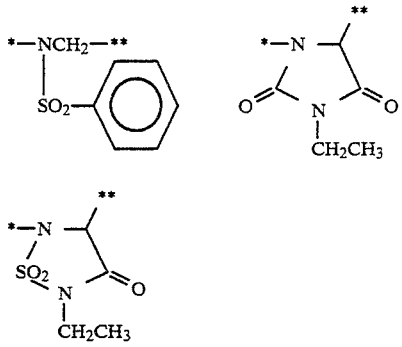

(2) Groups utilizing intramolecular nucleophilic substitution to cause their cleavage.

As examples, mentioned are timing groups described in U.S. Pat. No. 4,248,292 and represented by the following formula (T-2).

$$*\text{—Nu—Link—E—}** \qquad \text{(T-2)}$$

wherein Nu represents an nucleophilic group, for example, having an oxygen atom or a sulfur atom as the nucleophilic seed;

E represents an electrophilic group, which is nucleophilically attacked by Nu to cleave the bond to **; and Link represents a linking group which maintains the steric configuration of Nu and E for the intramolecular nucleophilic substitution between them.

Specific examples of the groups of formula (T-2) are as follows:

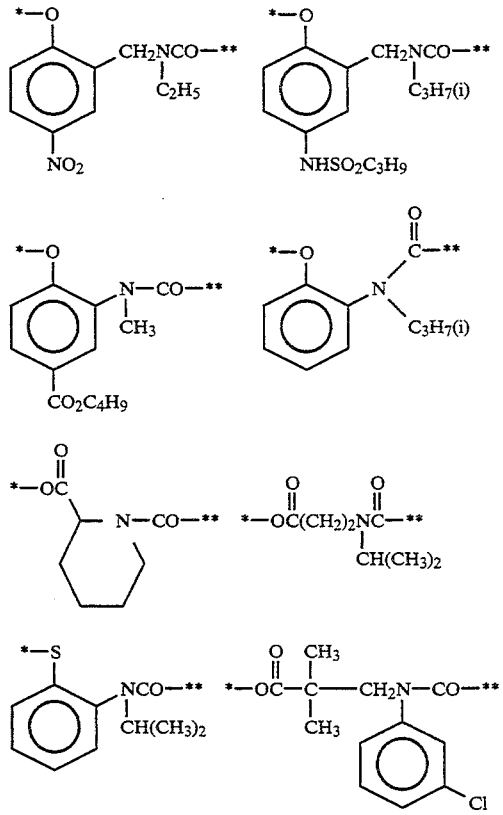

-continued (3) Groups utilizing electron transfer along the conjugated system to cause cleavage.

As examples, mentioned are groups of the following formula (T-3) such as those described in U.S. Pat. Nos. 4,409,323 and 4,421,845, JP-A-57-188035, JP-A-58-98728, JP-A-58-209736, JP-A-58-209737 and JP-A-58-209738.

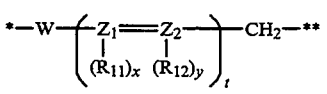

(T-3)

wherein *, **, W, $R_{11}$, $R_{12}$ and t have the same meanings as those in formula (T-1), provided that $R_{11}$ and $R_{12}$ may bonded to each other to be constitutive members for forming a benzene ring or a hetero ring and that $R_{11}$ and W or $R_{12}$ and W may be bonded to each other to form a benzene ring or a hetero ring;

$Z_1$ and $Z_2$ independently represent a carbon atom or a nitrogen atom;

x and y each is 0 or 1;

when $Z_1$ is a carbon atom, then x is 1, and when $Z_1$ is a nitrogen atom, then x is 0; and the same applies to $Z_2$ and y;

t is 1 or 2;

when t is 2, then two (—[$Z_1(R_{11})_x$=$Z_2(R_{12})_y$]—)'s may be the same or different; and —$CH_2$— adjacent to ** may optionally be substituted by an alkyl group having from 1 to 6 carbon atoms or by a phenyl group.

Specific examples of the groups of formula (T-3) are as follows:

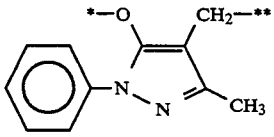

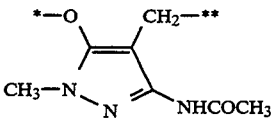

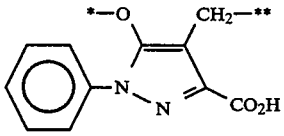

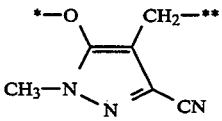

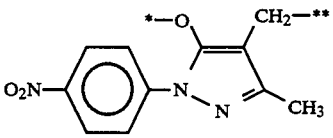

-continued

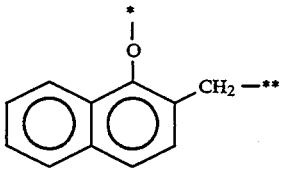

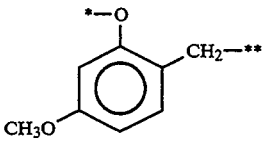

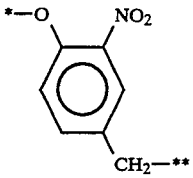

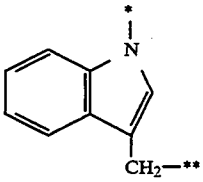

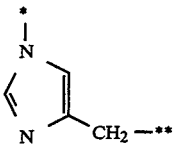

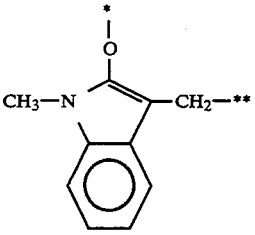

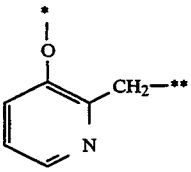

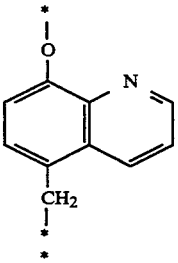

-continued

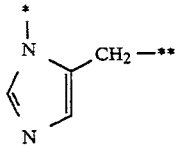

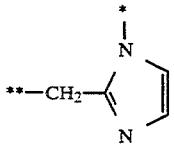

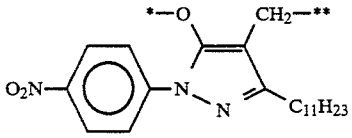

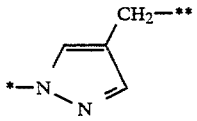

(4) Groups utilizing cleavage by hydrolysis of esters.

As examples, mentioned are linking groups described in West German Patent Publication (OLS) No. 2,626,315, such as those represented by the following formulae (T-3) and (T-4).

*—OCO—** (T-4)

*—SCS—** (T-5)

where * and ** have the same meanings as those in formula (T-1).

(5) Groups utilizing cleavage of iminoketals.

As examples, mentioned are linking groups described in U.S. Pat. No. 4,546,073, such as those represented by the following formula (T-6),

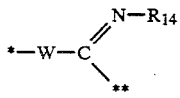

(T-6)

where *, ** and W have the same meanings as those in formula (T-1); and $R_{14}$ has the same meaning as $R_{13}$.

Specific examples of the groups of formula (T-6) are as follows:

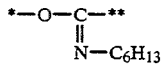

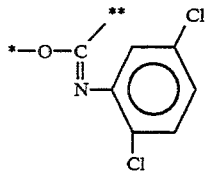

-continued

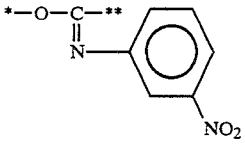

In formula (1), $L_1$ is preferably the group of anyone of formulae (T-1) to (T-5), especially preferably the group of anyone of (T-1), (T-3) and (T-4).

In formula (1), j is preferably 0 or 1.

In formula (1), $L_2$ is a trivalent or higher polyvalent timing group and is preferably represented by the following formula (T-$L_1$) or (T-$L_2$).

$$*—W—[Z_1(R_{11})_x=Z_2(R_{12})_y]_t—CH_2—** \quad (T\text{-}L_1)$$

wherein W, $Z_1$, $Z_2$, $R_{11}$, $R_{12}$, x, y and t have the same meanings as those in formula (T-3);

* indicates the position at which the group is bonded to $A—(L_1)_j—$ in formula (1);

** indicates the position at which the group is bonded to $—(L_3)_n$-PUG in the same;

provided that at least one of plural ($R_{11}$)'s and ($R_{12}$)'s is a group which is bonded to $—(L_3)_n$-PUG via a substituted or unsubstituted methylene group.

In formula (T-$L_1$), W is preferably a nitrogen atom and, more preferably, W is bonded to $Z_2$ to form a 5-membered ring, especially preferably, to form an imidazole or pyrazole ring.

$$*—N—(Z_3—**)_2 \quad (T\text{-}L_2)$$

where * and ** have the same meanings as those in formula (T-$L_1$);

$Z_3$ represents a substituted or unsubstituted methylene group, two ($Z_3$)'s may be the same or different, and two ($Z_3$)'s may be bonded to each other to form a ring.

Specific examples of the groups of formulae (T-$L_1$) and (T-$L_2$) are mentioned below, which, however, are not limitative.

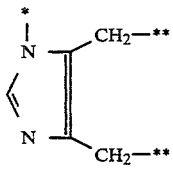

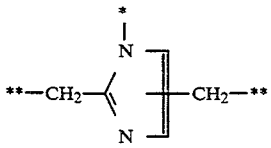

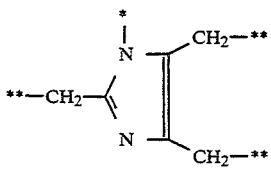

-continued
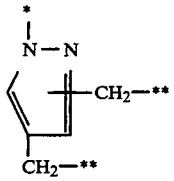
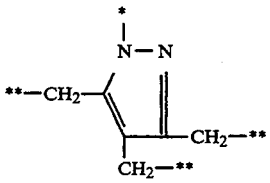
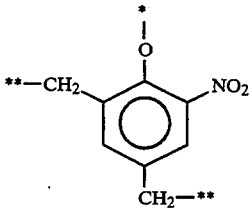
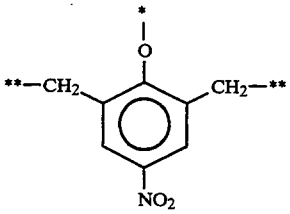
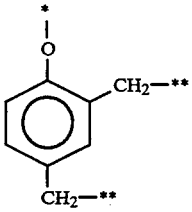
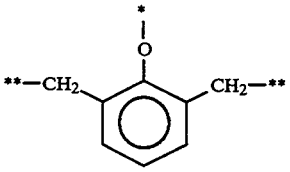
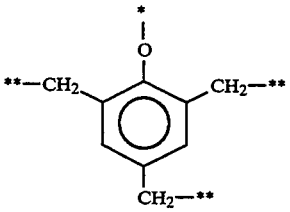
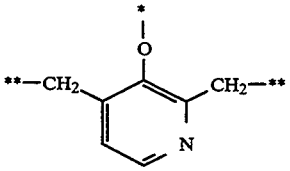
-continued
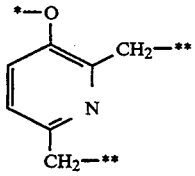
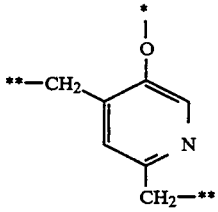
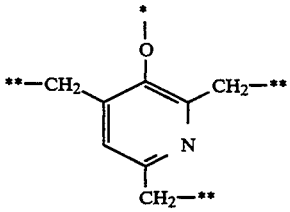
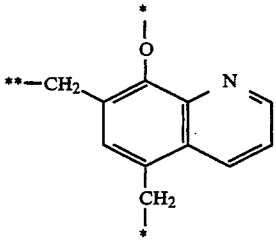
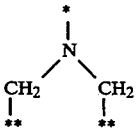
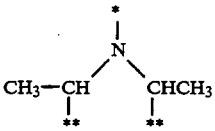
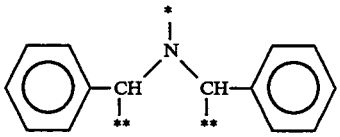
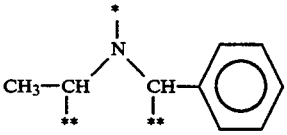
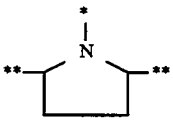

-continued

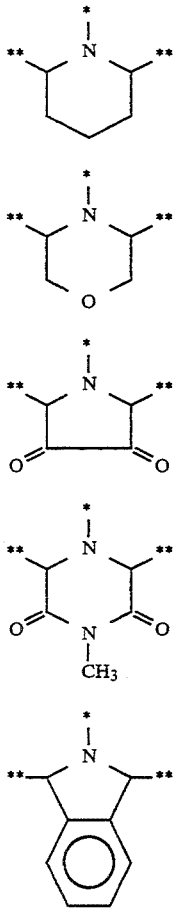

These groups as illustrated above may optionally have substituents. As examples of the substituents, mentioned are an alkyl group (e.g., methyl, ethyl, isopropyl, t-butyl, hexyl, methoxymethyl, methoxyethyl, chloroethyl, cyanoethyl, nitroethyl, hydroxypropyl, carboxyethyl, dimethylaminoethyl, benzyl, phenethyl), an aryl group (e.g., phenyl, naphthyl, 4-hydroxyphenyl, 4-cyanophenyl, 4-nitrophenyl, 2-methoxyphenyl, 2,6-dimethylphenyl, 4-carboxyphenyl, 4-sulfophenyl), a heterocyclic group (e.g., 2-pyridyl, 4-pyridyl, 2-furyl, 2-thienyl, 2-pyrrolyl), a halogen atom (e.g., chlorine, bromine), a nitro group, an alkoxy group (e.g., methoxy, ethoxy, isopropoxy), an aryl group (e.g., phenoxy), an alkylthio group (e.g., methylthio, isopropylthio, t-butylthio), an arylthio group (e.g., phenylthio), an amino group (e.g., amino, dimethylamino, diisopropylamino), an acylamino group (e.g., acetylamino, benzoylamino), a sulfonamido group (e.g., methanesulfonamido, benzenesulfonamido), a cyano group, a carboxyl group, an alkoxycarbonyl group (e.g., methoxycarbonyl, ethoxycarbonyl), an aryloxycarbonyl group (e.g., phenoxycarbonyl), and a carbamoyl group (e.g., N-ethylcarbamoyl, N-phenylcarbamoyl).

Of them, preferred are an alkyl group, a nitro group, an alkoxy group, an alkylthio group, an amino group, an acylamino group, a sulfonamido group, an alkoxycarbonyl group, and a carbamoyl group.

The group —$CH_2$— adjacent to the position ** of formula (T-$L_1$) may optionally be substituted by an alkyl group having from 1 to 6 carbon atoms or by a phenyl group.

In formula (1), m is preferably 1.

In formula (1), the group of $L_3$ has the same meaning as that of $L_1$.

In formula (1), n is preferably 0 or 1, especially preferably 0.

The photographically useful group PUG in formula (1) is precisely selected from the group consisting of residues of development inhibitors, dyes, foggants, developing agents, couplers, bleaching accelerators and fixation accelerators. As preferred examples of the photographically useful group PUG, mentioned are photographically useful groups described in U.S. Pat. No. 4,248,962 (these are represented by PUG therein); residues of dyes described in JP-A-62-49353 (releasing groups to be released from couplers described therein), residues of development inhibitors described in U.S. Pat. No. 4,477,563; and residues of bleaching accelerators described in JP-A-61-201247 and JP-A-2-55 (releasing groups to be released from couplers described therein). Residues of development inhibitors are especially useful as the photographically useful groups in the present invention.

As development inhibitors for PUG in the present invention, those of the following formulae (INH-1) to (INH-13) are preferred.

(INH-1)

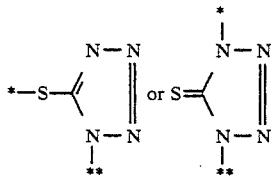

(INH-2)

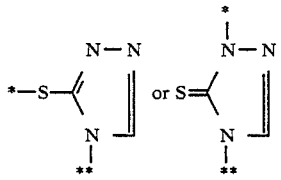

(INH-3)

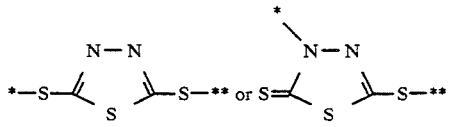

(INH-4)

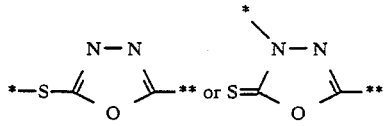

(INH-5)

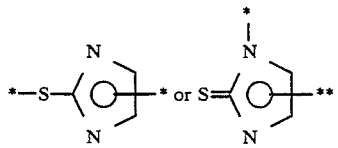

(INH-6)

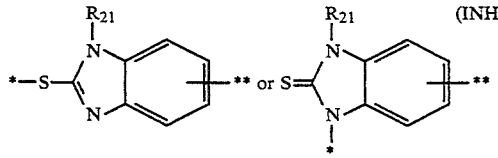

In formula (INH-6), $R_{21}$ represents a hydrogen atom, or a substituted or unsubstituted hydrocarbon residue (e.g., methyl, ethyl, propyl, phenyl).

(INH-7)

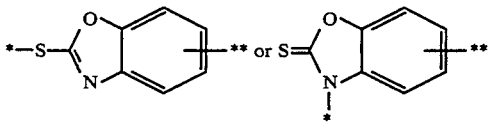

(INH-8)

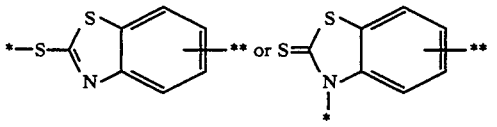

(INH-9)

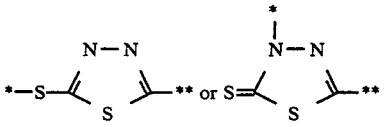

(INH-10)

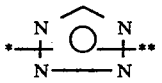

(INH-11)

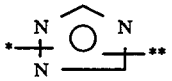

(INH-12)

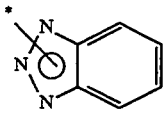

(INH-13)

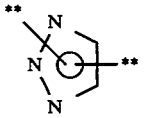

In these formulae, * indicates the position at which the group is bonded to $L_2$ or $L_3$ in formula (1).

** indicates the position at which the group is bonded to a substituent. As examples of the substituent, mentioned are substituted or unsubstituted alkyl, aryl, heterocyclic, alkylthio, and alkyl- or aryl-oxycarbonyl groups. Preferably, these substituents contain therein group(s) which may be decomposed in processing solutions during photographic processing.

As specific examples of the substituted or unsubstituted alkyl group, mentioned are methyl, ethyl, propyl, butyl, hexyl, decyl, isobutyl, t-butyl, 2-ethylhexyl, 2-methylthioethyl, benzyl, 4-methoxybenzyl, phenethyl, 1-methoxycarbonylethyl, propyloxycarbonylmethyl, 2-(propyloxycarbonyl)ethyl, butyloxycarbonylmethyl, pentyloxycarbonylmethyl, 2-cyanoethyloxycarbonylmethyl, 2,2-dichloroethyloxycarbonylmehtyl, 3-nitropropyloxycarbonylmethyl, 4-nitrobenzyloxycarbonylmethyl, and 2,5-dioxo-3,6-dioxadecyl groups.

As specific examples of the substituted or unsubstituted aryl group, mentioned are phenyl, naphthyl, 4-methoxycarbonylphenyl, 4-ethoxycarbonylphenyl, 2-methylthiophenyl, 3-methoxycarbonylphenyl, and 4-(2-cyanoethyloxycarbonyl)phenyl groups.

As specific examples of the substituted or unsubstituted heterocyclic group, mentioned are 4-pyridyl, 3-pyridyl, 2-pyridyl, 2-furyl, and 2-tetrahydropyranyl groups.

As specific examples of the substituted or unsubstituted alkylthio group, mentioned are methylthio, t-butylthio, and 1-methoxycarbonylethylthio groups.

As specific examples of the substituted or unsubstituted alkyl- or aryl-oxycarbonyl group, mentioned are methoxycarbonyl, butoxycarbonylmethoxycarbonyl, isopentyloxycarbonylmethoxycarbonyl, N-hexylcarbamoylmethoxycarbonyl, and phenoxycarbonyl groups.

Of the above-mentioned INH's (development inhibitors ), preferred are development inhibitors of formulae (INH-1), (INH-2), (INH-3), (INH-4), (INH-9) and (INH-12). Of them, especially preferred are those of formulae (INH-1), (INH-2) and (INH-3).

As the substituent which bonds to INH, preferred are an alkyl group, a substituted or unsubstituted, phenyl group and a substituted or unsubstituted alkyl- or aryloxycarbonyl groups.

As the compounds of formula (1), especially preferred are those of the following formulae (1a) and (1b).

$$A—(L_1)_j—W—[Z_1(R_{11})_x=Z_2(R_{12})_y]_t—CH_2\text{-}PUG \quad (1a)$$

$$A—L_1—N—(Z_3\text{-}PUG)_2 \quad (1b)$$

wherein all the symbols have the same meanings as those in formulae (1), (T-$L_1$) and (T-$L_2$).

In formula (1a), j is preferably 0 or 1. In formulae (1a) and (1b), $L_1$ is preferably —OC(=O)—, and PUG is preferably a residue of a development inhibitor.

If, however, the plural photographically useful groups, if any, have different functions in these formulae, the timing group therein is not that utilizing intramolecular nucleophilic substitution.

The functions of photographically useful groups as referred to herein mean the functions to be exhibited by development inhibitors, dyes, foggants, developing agents, couplers, bleaching accelerators and fixing agents.

It is especially preferred that two or more PUG to be released from one compound are the same development inhibitor.

Next, the compounds of formula (2) will be explained below.

In formula (2), A and PUG have the same meanings as those in formula (1).

$L_4$ represents —OCO—, —OSO—, —$OSO_2$—, —OCS—, —SCO—, —SCS— or —$WCR_{11}R_{12}$, where W, $R_{11}$ and $R_{12}$ have the same meanings as those in formula (T-1) which has been used hereinabove for explanation of $L_1$ in formula (1).

Where $L_4$ is —$WCR_{11}R_{12}$—, W is preferably an oxygen atom or a tertiary amino group. More preferably, $L_4$ is —$OCH_2$—, or W and $R_{11}$ or $R_{12}$ form a ring.

Where $L_4$ represents a group except —$WCR_{11}R_{12}$—, it is preferably —OCO—, —OSO— or —$OSO_2$—, especially preferably —OCO—.

$L_5$ represents a group which releases PUG from the molecule by electron transfer along the conjugated system, or it has the same meaning as $L_4$. The group which releases PUG from the molecule by electron transfer along the conjugated system, for $L_5$, is the same as the group of formula (T-3) that has been referred to hereinabove for explanation of $L_1$ in formula (1). $L_5$ is preferably a group which releases PUG from the molecule by electron transfer along the conjugated system, and it is more preferably a group which is bonded to $L_4$ via a nitrogen atom.

Of the compounds of formula (2), preferred are those of the following formulae (3) and (4).

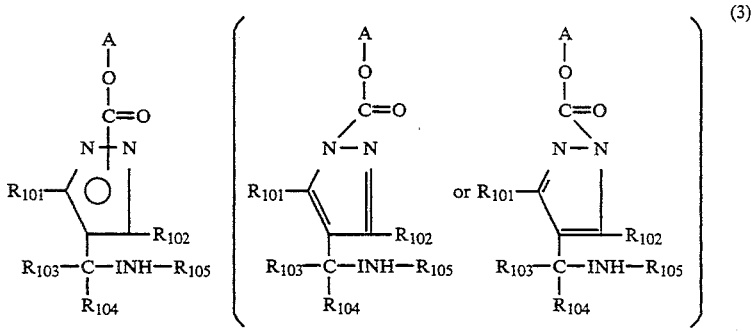

(3)

The same applies hereunder.

In formula (3), A has the same meaning as that in formula (1). $R_{101}$ and $R_{102}$ independently represent a hydrogen atom or a substituent. $R_{103}$ and $R_{104}$ independently represent a hydrogen atom or a substituent. INH represents a group having a development-inhibiting ability. $R_{105}$ represents an unsubstituted phenyl group, a primary alkyl group, an alkylthio group, a primary alkyl group substituted by substituent(s) except aryl groups, or a group of $—CO_2C(R_{107})(R_{108})CO_2R_{106}$. $R_{106}$ represents an unsubstituted alkyl group, and $R_{107}$ and $R_{108}$ independently represent a hydrogen atom or an unsubstituted alkyl group. At least one of $R_{101}$ to $R_{104}$ is a substituent except hydrogen atom.

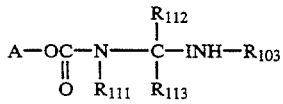

(4)

In formula (4), A, INH and $R_{105}$ have the same meanings as those in formula (3). $R_{111}$, $R_{112}$ and $R_{113}$ each represents a hydrogen atom or an organic group, and any two of $R_{111}$, $R_{112}$ and $R_{113}$ may be divalent groups and bonded to form a ring.

The compounds of formula (3) will be explained in more detail hereunder.

In formula (3), A has the same meaning as that in formula (1).

$R_{101}$ and $R_{102}$ independently represent a hydrogen atom or a substituent. Examples of the substituent are an aryl group (e.g., phenyl, naphthyl, p-methoxyphenyl, p-hydroxyphenyl, p-nitrophenyl, o-chlorophenyl), an alkyl group (e.g., methyl, ethyl, isopropyl, propyl, tert-butyl, tert-amyl, isobutyl, sec-butyl, octyl, methoxymethyl, 1-methoxyethyl, 2-chloroethyl, nitromethyl, 2-cyanoethyl, 2-carbamoylethyl, 2-dimethylcarbamoylethyl), a halogen atom (e.g., fluorine, chlorine, bromine, iodine), an alkoxy group (e.g., methoxy, ethoxy, isopropyloxy, propyloxy, tert-butyloxy, isobutyloxy, butyloxy, octyloxy, 2 -methoxyethoxy, 2-chloroethoxy), an aryloxy group (e.g., phenoxy, naphthoxy, p-methoxyphenoxy), an alkylthio group (e.g., methylthio, ethylthio, isopropylthio, propylthio, tert-butylthio, isobutylthio, sec-butylthio, octylthio, 2-methoxyethylthio), an arylthio group (e.g., phenylthio, naphthylthio, p-methoxyphenylthio), an amino group (e.g., amino, methylamino, phenylamino, dimethylamino, diethylamino, diisopropylamino, phenylmethylamino), a carbamoyl group (e.g., carbamoyl, methylcarbamoyl, dimethylcarbamoyl, diethylcarbamoyl, diisopropylcarbamoyl, ethylcarbamoyl, isopropylcarbamoyl, tert-butylcarbamoyl, phenylcarbamoyl, phenylmethylcarbamoyl), a sulfamoyl group (e.g., sulfamoyl, methylsulfamoyl, ethylsulfamoyl, isopropylsulfamoyl, phenylsulfamoyl, octylsulfamoyl, dimethylsulfamoyl, diethylsulfamoyl, diisopropylsulfamoyl, dihexylsulfamoyl, phenylmethylsulfamoyl), an alkoxycarbonyl group (e.g., methoxycarbonyl, propyloxycarbonyl, isopropyloxycarbonyl, tert-butyloxycarbonyl, tert-amyloxycarbonyl, octyloxycarbonyl), an aryloxycarbonyl group (e.g., phenoxycarbonyl, p-methoxyphenoxycarbonyl), an acylamino group (e.g., acetylamino, propanoylamino, pentanoylamino, N-methylacetylamino, benzoylamino), a sulfonamido group (e.g., methanesulfonamido, ethanesulfonamido, pentanesulfonamido, benzenesulfonamido, p-toluenesulfonamido), an alkoxycarbonylamino group (e.g., methoxycarbonylamino, isopropyloxycarbonylamino, tert-butoxycarbonylamino, hexyloxycarbonylamino), an aryloxycarbonylamino group (e.g., phenoxycarbonylamino), an ureido group (e.g., 3-methylureido, 3-phenylureido), a cyano group and a nitro group.

$R_{101}$ and $R_{102}$ may be the same or different, but the sum of the formula weights of them is desired to be less than 120. Preferred substituents for them are an alkyl group, a halogen atom and an alkoxy group. Of them, most preferred is an alkyl group.

In formula (3), $R_{103}$ and $R_{104}$ independently represent a hydrogen atom or an alkyl group. The alkyl group includes, for example, methyl, ethyl, isopropyl, tert-butyl, isobutyl, hexyl and 2-methoxyethyl groups. Preferably, $R_{103}$ and $R_{104}$ each represents a hydrogen atom, a methyl group or an ethyl group. Especially preferably, they are hydrogen atoms.

In formula (3), $R_{105}$ represents an unsubstituted phenyl group, a primary alkyl group, an alkylthio group, a primary alkyl group substituted by substituent(s) except aryl groups, or $—CO_2C(R_{107})(R_{108})CO_2R_{106}$.

The alkyl group includes, for example, ethyl, propyl, butyl, isobutyl, pentyl, isopentyl, 2-methylbutyl, hexyl, 2-methylpentyl, 3-methylpentyl, 4-methylpentyl, 2-ethylbutyl, heptyl and octyl groups. As the substituents, mentioned are a halogen atom, an alkoxy group, an alkylthio group, an amino group, a carbamoyl group, a sulfamoyl group, an alkoxycarbonyl group, an acylamino group, a sulfonamido group, an alkoxycarbonylamino group, an ureido group, a cyano group and a nitro group. As specific examples of the groups, those that have been mentioned hereinabove for $R_{101}$ and $R_{102}$ are referred to, except for the groups containing aryl group(s).

$R_{106}$ represents an unsubstituted alkyl group having from 3 to 6 carbon atoms (e.g., propyl, butyl, isobutyl, pentyl, isopentyl, hexyl). $R_{107}$ and $R_{108}$ each represents a hydrogen atom, or an unsubstituted alkyl group having from 1 to 8 carbon atoms (e.g., methyl, ethyl, propyl, isopropyl, butyl, pentyl, hexyl, octyl); and $R_{107}$ and $R_{108}$ may be the same or different.

$R_{105}$ may be substituted by two or more different substituents. As substituents for $R_{105}$, preferred are a fluorine atom, a chlorine atom, an alkoxy group, a carbamoyl group, an alkoxycarbonyl group, a cyano group and a nitro group. Of them, especially preferred is an alkoxycarbonyl group.

$R_{105}$ is preferably a phenyl group, an unsubstituted primary alkyl group having from 2 to 6 carbon atoms, $—CO_2C(R_{107})(R_{108})CO_2R_{106}$ where $R_{106}$ is an unsubstituted alkyl group having from 3 to 6 carbon atoms and $R_{107}$ and $R_{108}$ are both hydrogen atoms, or a primary alkyl group substituted by substituent(s) selected from those that have been hereinabove mentioned as the preferred substituents for $R_{105}$. Especially preferably, $R_{105}$ is an unsubstituted primary alkyl group having from 3 to 5 carbon atoms, or a primary alkyl group substituted by an alkoxycarbonyl group.

In formula (3), INH represents a residue of a development inhibitor. As specific examples of the residue, those of formulae (INH-1) to (INH-13) that have been hereinabove mentioned for PUG in formula (1) are referred to. Regarding the preferred examples of the residue of INH in formula (3), those mentioned for PUG in formula (1) are also referred to.

Next, the compounds of formula (4) will be explained in detail hereunder.

In formula (4), $R_{111}$, $R_{112}$ and $R_{113}$ each may be a hydrogen atom or a monovalent organic group.

Where $R_{112}$ and $R_{113}$ each are a monovalent organic group, the organic group is preferably an alkyl group (e.g., methyl, ethyl) or an aryl group (e.g., phenyl).

Preferably, at least one of $R_{112}$ and $R_{113}$ is a hydrogen atom; and especially preferably, both $R_{112}$ and $R_{113}$ are hydrogen atoms.

$R_{111}$ may be an organic group. Preferably, it may ben an alkyl group (e.g., methyl, isopropyl, butyl, isobutyl, tert-butyl, sec-butyl, neopentyl, hexyl), an aryl group (e.g., phenyl), an acyl group (e.g., acetyl, benzoyl), a sulfonyl group (e.g., methanesulfonyl, benzenesulfonyl), a carbamoyl group (e.g., ethylcarbamoyl phenylcarbamoyl), a sulfamoyl group (e.g., ethylsulfamoyl phenylsulfamoyl), an alkoxycarbonyl group (e.g., ethoxycarbonyl, butoxycarbonyl), an aryloxycarbonyl group (e.g., phenoxycarbonyl, 4-methylphenoxycarbonyl), an alkoxysulfonyl group (e.g., butoxysulfonyl, ethoxysulfonyl), an aryloxysulfonyl group (e.g., phenoxysulfonyl, 4-methoxyphenoxysulfonyl), a cyano group, a nitro group, a nitroso group, a thioacyl group (e.g., thioacetyl, thiobenzoyl), a thiocarbamoyl group (e.g., ethylthiocarbamoyl), an imidoyl group (e.g., N-ethylthiocarbamoyl), an amino group (e.g., amino, dimethylamino, methylamino), an acylamino group (e.g., formylamino, acetylamino, N-methylacetylamino), an alkoxy group (e.g., methoxy, isopropyloxy), or an aryloxy group (e.g., phenoxy).

The organic groups may optionally have one or more substituents. As examples of the substituents, mentioned are a halogen atom (e.g., fluorine, chlorine, bromine), a carboxyl group and a sulfo group, and also those that have been hereinabove mentioned for $R_{111}$.

Preferably, the number of the atoms, except hydrogen, that constitute the group $R_{111}$ is 15 or less.

More preferably, $R_{111}$ is a substituted or unsubstituted alkyl or aryl group; and especially preferably, it is an unsubstituted or substituted alkyl group.

Any two of $R_{111}$, $R_{112}$ and $R_{113}$ in formula (4) may be divalent groups and bonded to form a ring.

The ring to be formed by them is preferably a 4-membered to 8-membered one, more preferably a 4-membered to 6-membered one.

As preferred examples of the divalent group, mentioned are $—C(=O)—N(R_{114})—$, $—SO_2—N(R_{114})—$, $—(CH_2)_3—$, $—(CH_2)_4—$, $—(CH_2)_5—$, $—C(=O)—(CH_2)_2—$, $—C(=O)—N(R_{114})—C(=O)—$, $—SO_2—N(R_{114})—C(=O)—$, $—C(=O)—C(R_{114})(R_{115})—$ and $—(CH_2)_2—O—CH_2—$.

In these groups, $R_{114}$ and $R_{115}$ each represents a hydrogen atom or a monovalent organic group that has been hereinabove mentioned for $R_{111}$. $R_{114}$ and $R_{115}$ may be the same or different.

The remaining one of $R_{111}$, $R_{112}$ and $R_{113}$, that does not participate in the divalent groups, represents a hydrogen atom or a monovalent organic group. As specific examples of the organic group in the case, those that have been hereinabove mentioned for $R_{111}$, $R_{112}$ and $R_{113}$ not forming a ring are referred to.

Where any two of $R_{111}$, $R_{112}$ and $R_{113}$ are bonded to form a ring, it is preferred that one of $R_{112}$ and $R_{113}$ is a hydrogen atom while the remaining $R_{112}$ or $R_{113}$ is bonded to $R_{111}$ to form a ring. More preferably, the left end of the above-mentioned divalent group is bonded to the nitrogen atom in formula (4) and the right end of the same to the carbon atom therein.

It is also preferred that $R_{111}$, $R_{112}$ and $R_{113}$ do not form a ring but each represents a hydrogen atom or a monovalent organic group.

In formulae (1) and (2), it is preferred that the formula weight of the residues, except for A and PUG, is from 64 to 240, more preferably from 70 to 200, especially preferably from 90 to 180.

Specific examples of the compounds of formulae (1) to (4), which are used in the present invention, are mentioned below. However, these are not limitative.

In the following exemplification, CA-headed numbers indicate examples of formula (1) where A is a coupler residue; CB-headed numbers indicate examples of formulae (2) to (4) where A is a coupler residue; and SA-headed numbers indicate examples of formulae (1) to (4) where A is a redox group.

(CA-1)
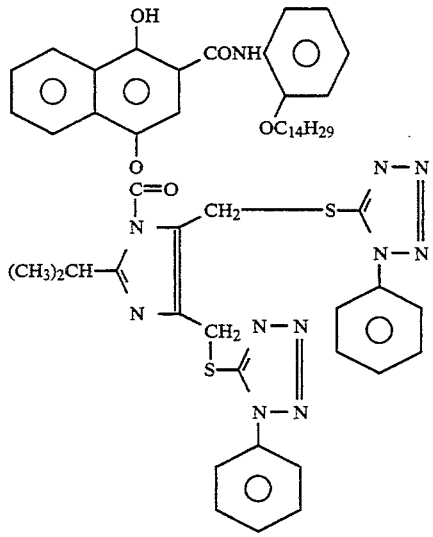
(CA-2)
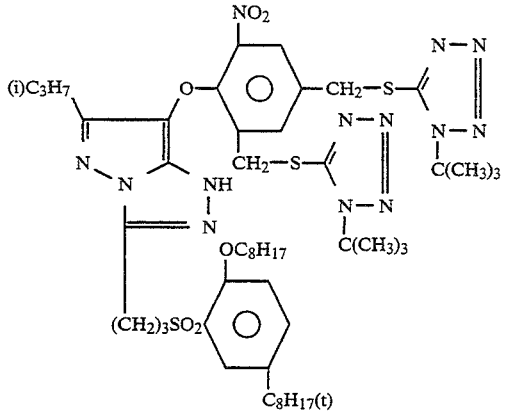
(CA-3)
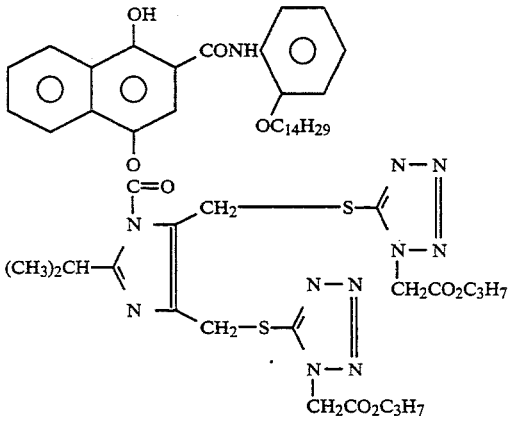
(CA-4)
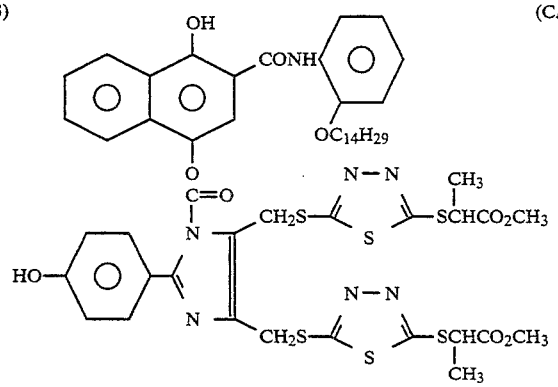
(CA-5)
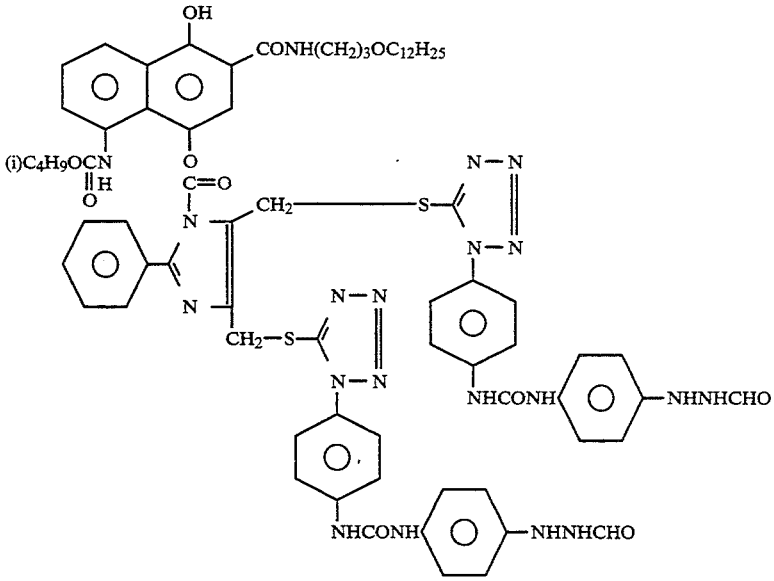

-continued
(CA-6)
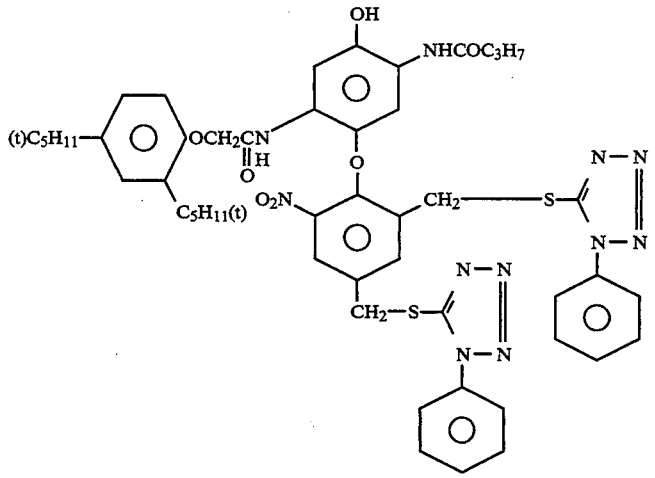
(CA-7)
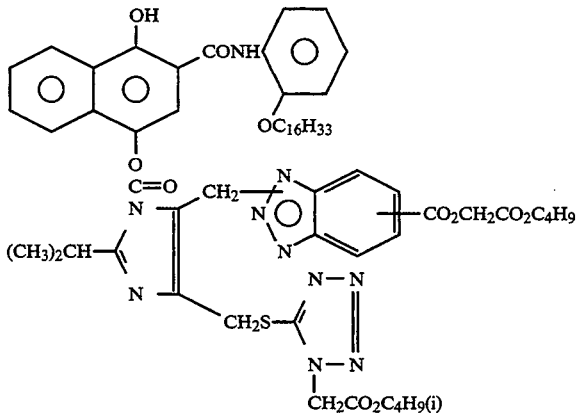
(CA-8)
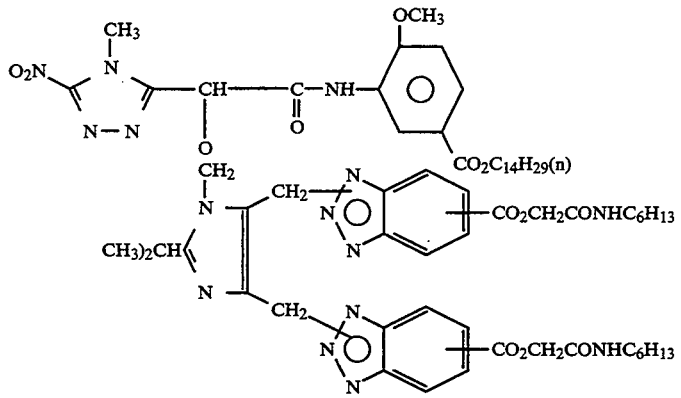
(CA-9)
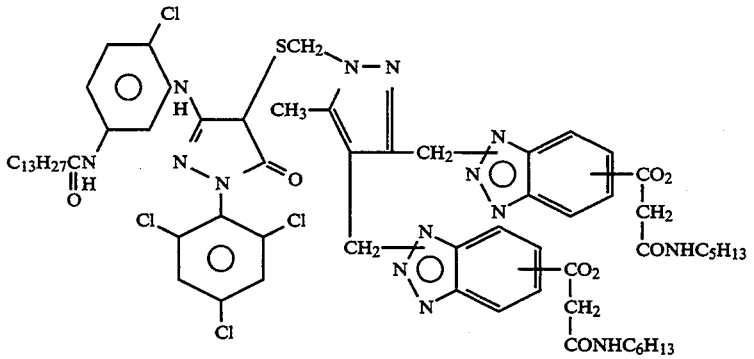

-continued
(CA-10)
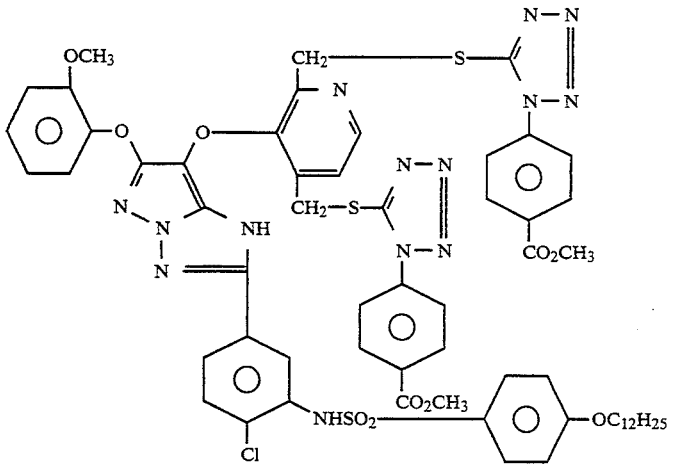
(CA-11)
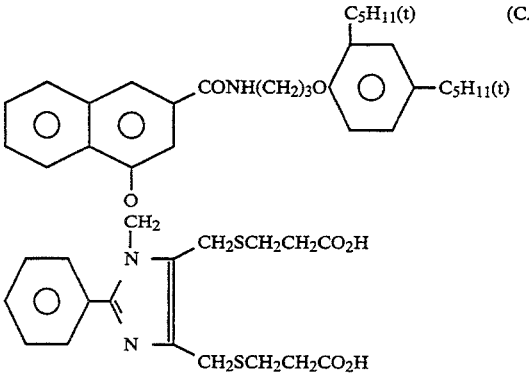
(CA-12)
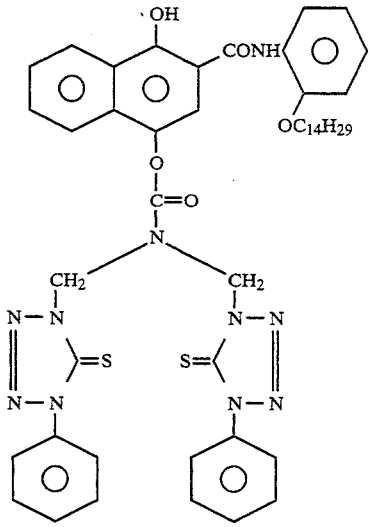
(CA-13)
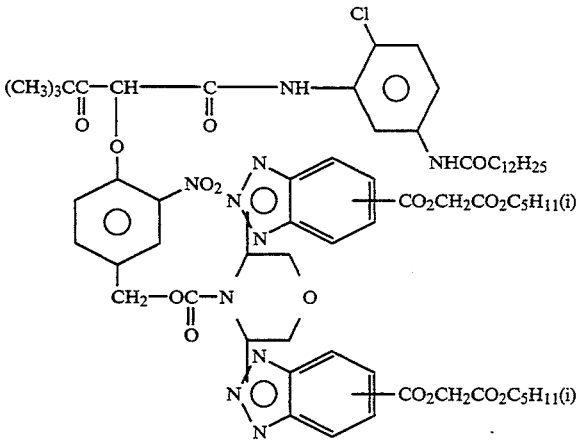

-continued
(CA-14)
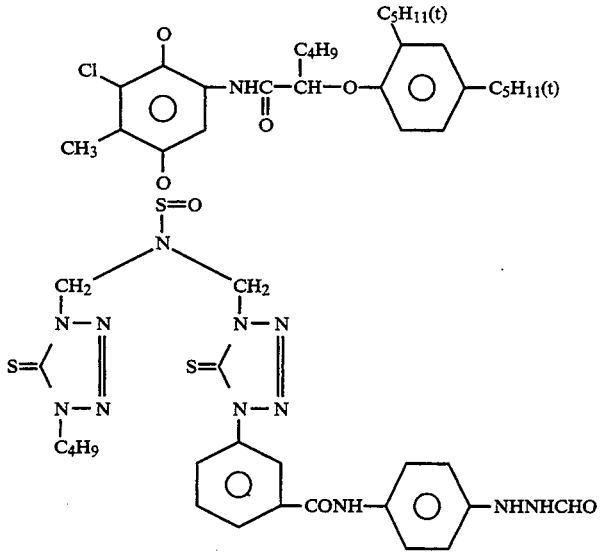
(CB-1)
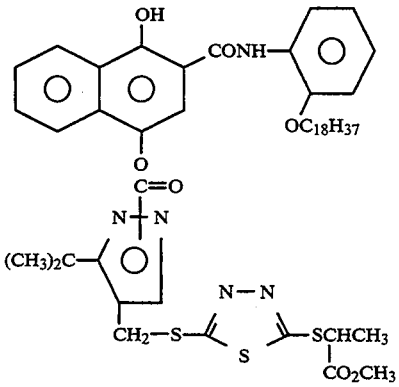
(CB-2)
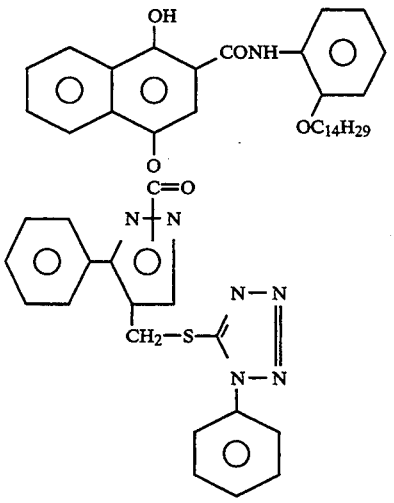
(CB-3)
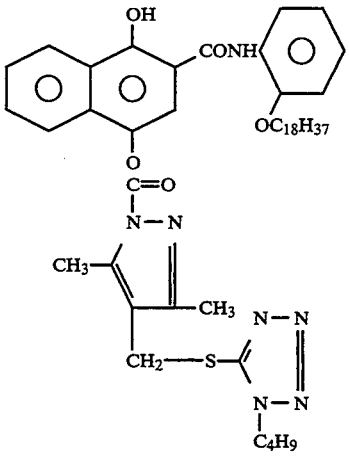
(CB-4)
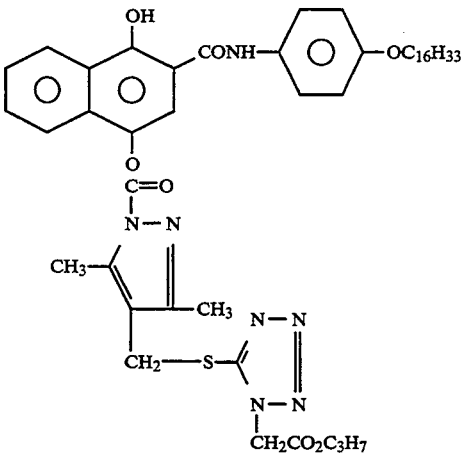

-continued
(CB-5)
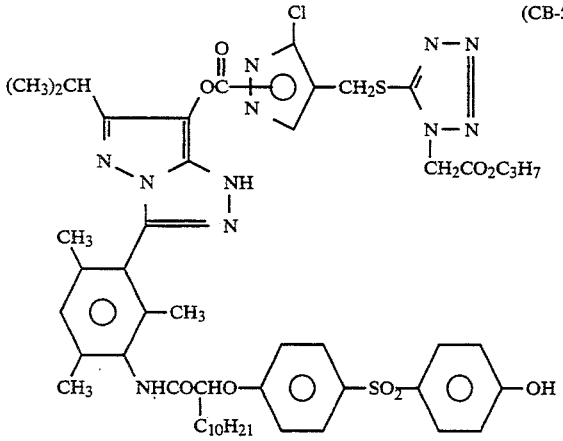
(CB-6)
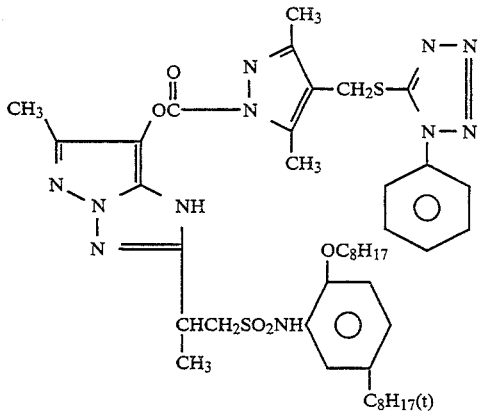
(CB-7)
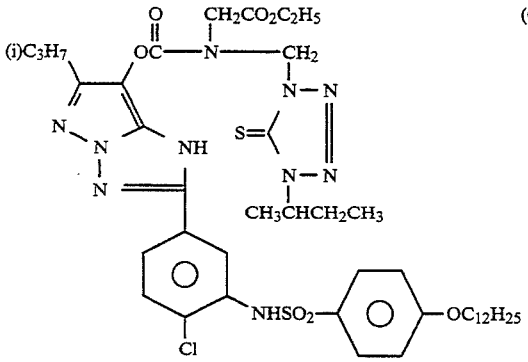
(CB-8)
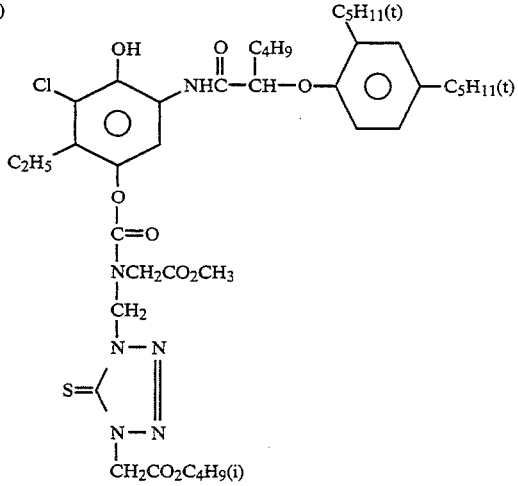
(CB-9)
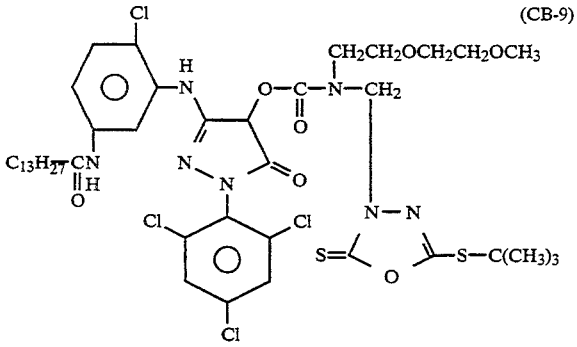
(CB-10)
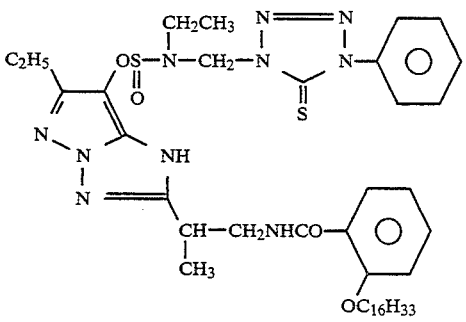

-continued
(CB-11)
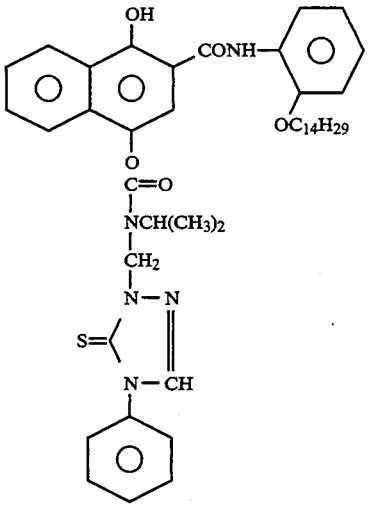
(CB-12)
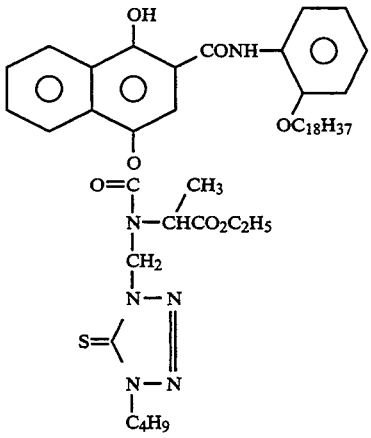
(CB-13)
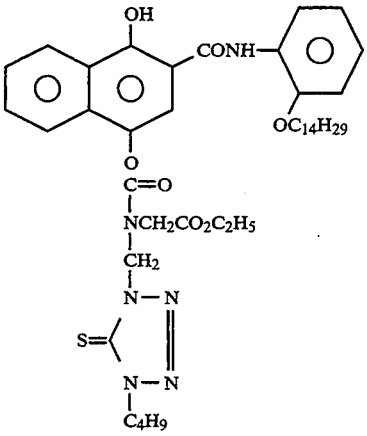
(CB-14)
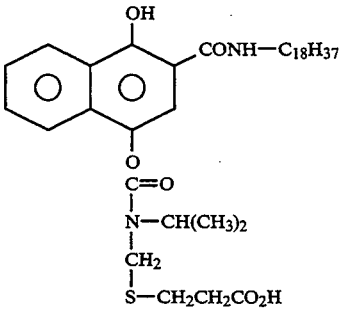
(CB-15)
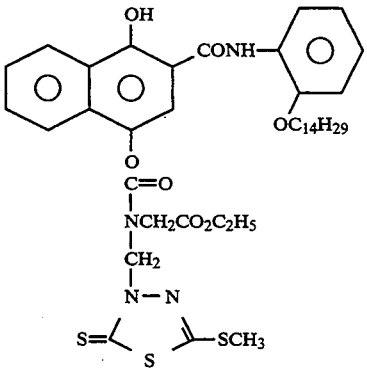
(CB-16)
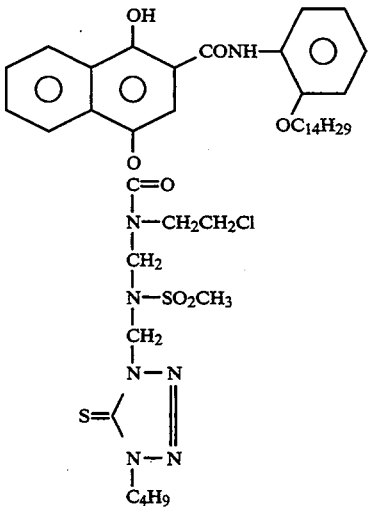

-continued
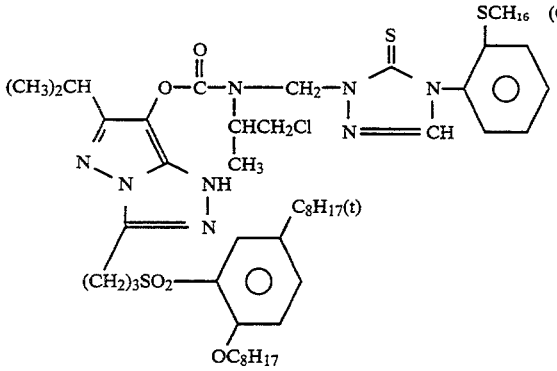
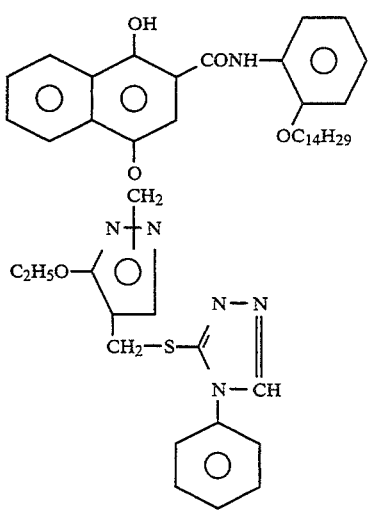
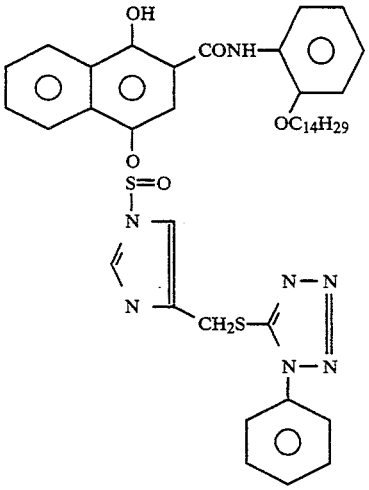
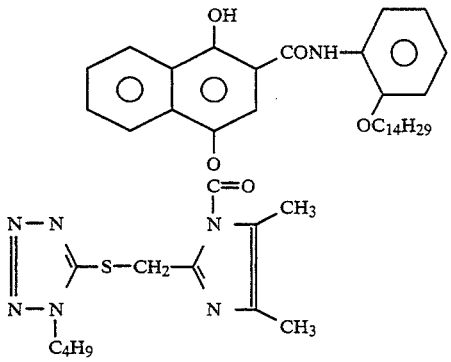
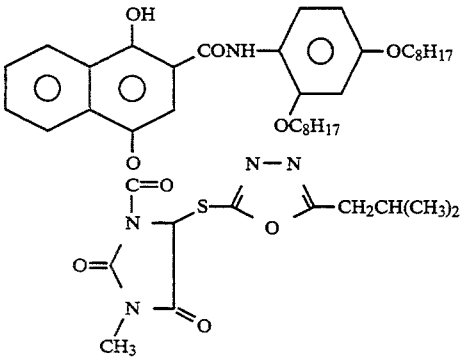
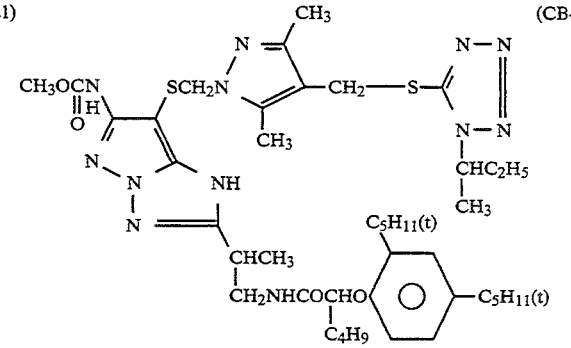

-continued
(CB-23)
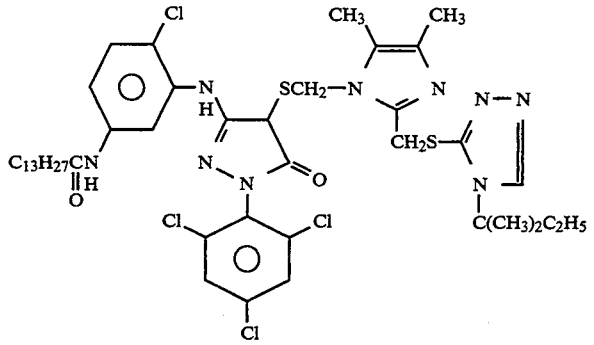
(CB-24)
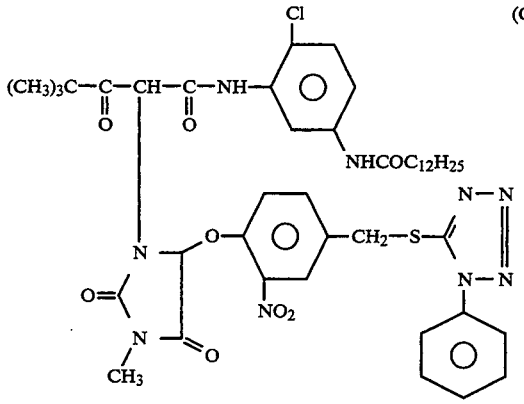
(CB-25)
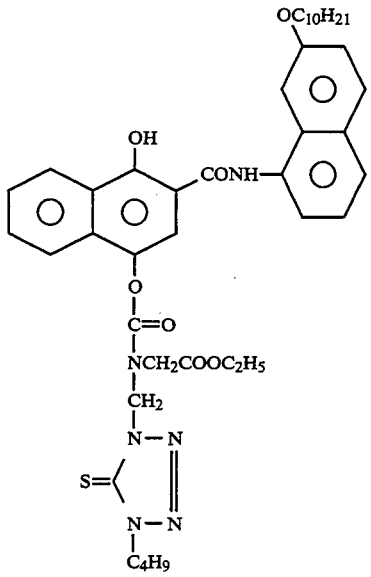
(CB-26)
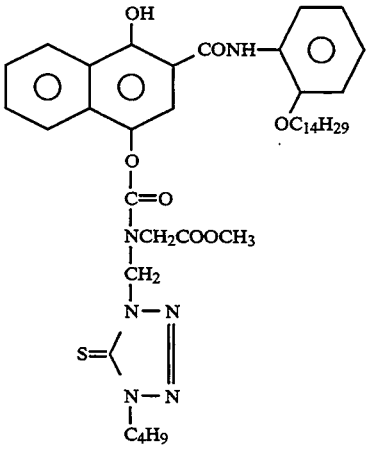
(SA-1)
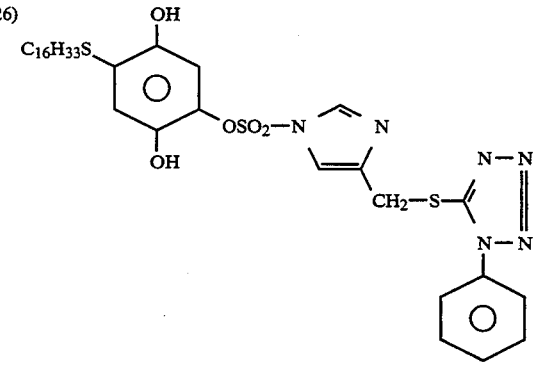

-continued (SA-2)

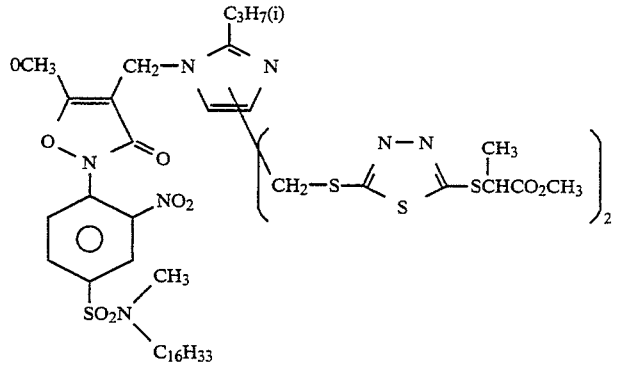

(SA-3)

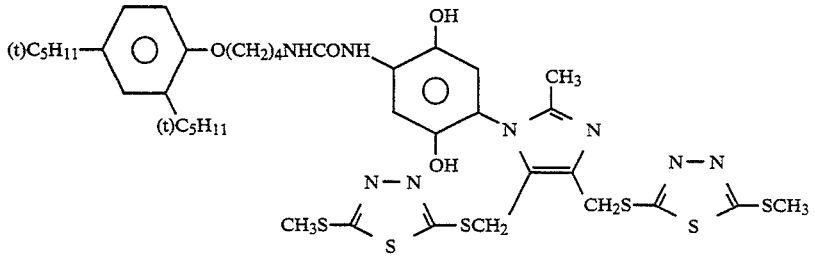

(SA-4)

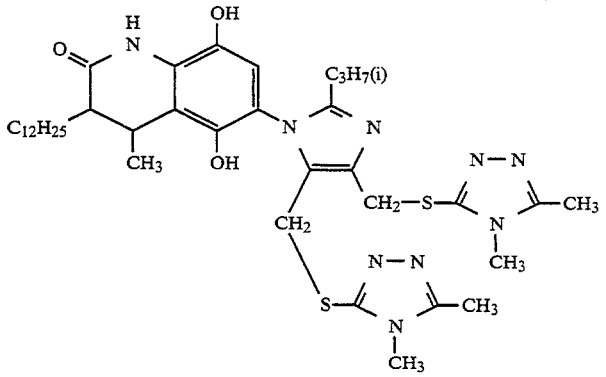

(SA-5)

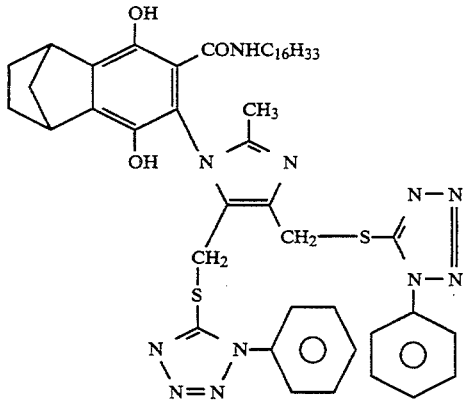

(SA-6)

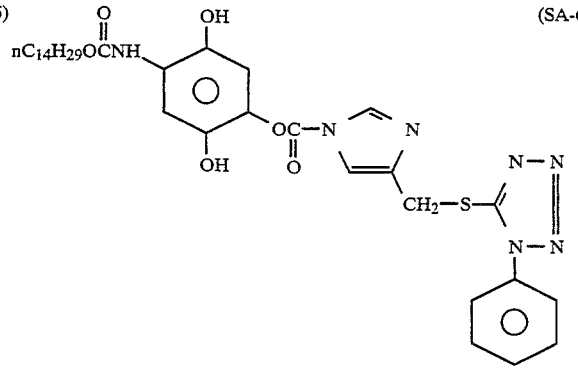

To synthesize the compounds which are used in the present invention, for example, the methods described in U.S. Pat. Nos. 4,847,383, 4,770,900, 4,684,604, 4,886,736, JP-A-60-218645, JP-A-61-230135, and Japanese patent application Nos. 2-37070 and 2-170832 (corresponding to JP-A-4-211246 and EP 00464612A, respectively) and Japanese patent application No. 2-251192 and methods similar to them may be utilized.

Examples for synthesizing them are mentioned below.

Synthesis Example 1:

Synthesis of Compound (CA-1):

Compound (CA-1) was synthesized in accordance with the process mentioned below.

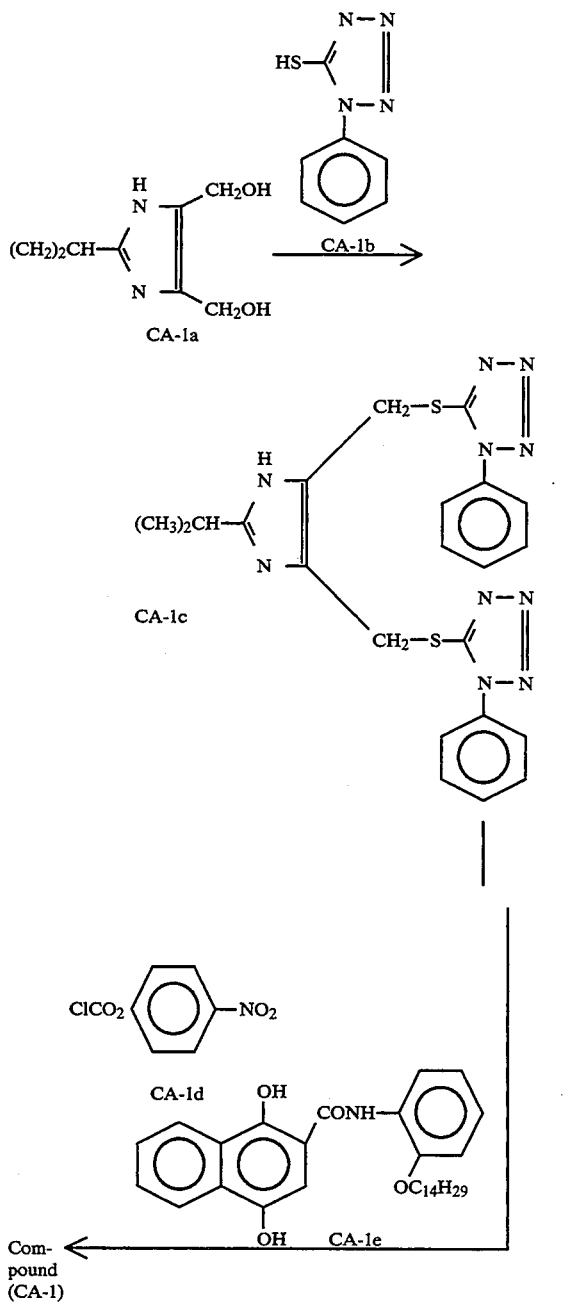

Precisely, 3.40 g of (CA-1a) was reacted with 30 ml of thionyl chloride at 60° C. for one hour, and the excess thionyl chloride was removed by distillation under reduced pressure. The residue was added to a dimethylformamide solution containing 7.48 g of (CA-1b) and 10.5 ml of diisopropylethylamine at 0° C. and stirred for one hour. The resulting solution was poured into 500 ml of water, and the crystals thus formed were taken out by filtration to obtain 9.8 g of (CA-1c) as crude crystals. The structure of the product was identified by NMR.

3.20 g of (CA-1c) and 1.38 g of (CA-1d) were reacted in 30 ml of 1,2-dichloroethane for one hour, and a solution of 3.20 g of (CA-1e) in 20 ml of ethyl acetate was added thereto with cooling with water. Subsequently, 4.5 ml of diisopropylethylamine was added thereto and stirred for one hour.

The reaction was stopped by adding 1-N hydrochloric acid to the reaction system, and 30 ml of chloroform was added to the reaction solution to dilute it. Then, the reaction solution was washed three times each with water, and the organic layer was dried on sodium sulfate. The organic solvent was removed by distillation to obtain an oily product, which was purified by silica gel column chromatography (using ethyl acetate/hexane=1/5) to obtain 1.20 g of Compound (CA-1). The structure of the product was identified by NMR. The product had a melting point of 133.0° to 134.0° C.

Synthesis Example 2:

Synthesis of Compound (CA-12):

Compound (CA-12) was synthesized in accordance with the process mentioned below.

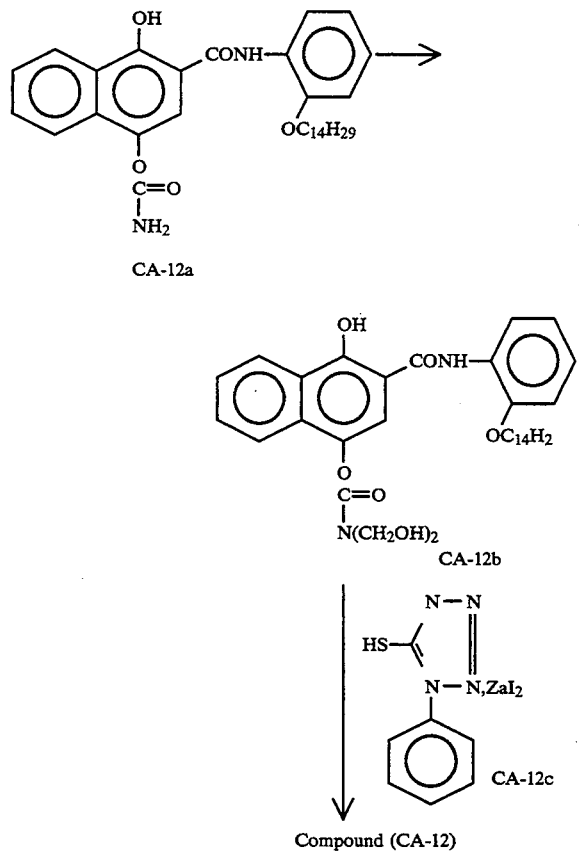

Precisely, 10.7 g of (CA-12a) and 30 ml of aqueous 37% formalin solution reacted in 100 ml of acetic acid at 70° C. for 5 hours, and then the solvent was removed by distillation under reduced pressure. The residue was purified by silica gel column chromatography (using ethyl acetate/hexane=2/1) to obtain 6.4 g of (CA-12b). The yield was 53%.

Next, 3.2 g of (CA-12b) and 2.1 g of (CA-12c) were suspended in 40 ml of chloroform, and 5.7 g of zinc iodide was added thereto and reacted at room temperature for 2 hours. The reaction was stopped, using 1-N hydrochloric acid. The reaction solution was diluted with 40 ml of chloroform and thereafter washed two times each with water. The organic layer was dried with sodium sulfate and concentrated, and the resulting residue was purified by silica gel column chromatography (using ethyl acetate/hexane=1/4) to obtain 4.1 g of Compound (CA-12). The yield was 25%. The structure of the product was identified by NMR, mass spectrography and elementary analysis.

Synthesis Example 3:

Synthesis of Compound (CB-2):

Compound (CB-2) was synthesized in accordance with the process mentioned below.

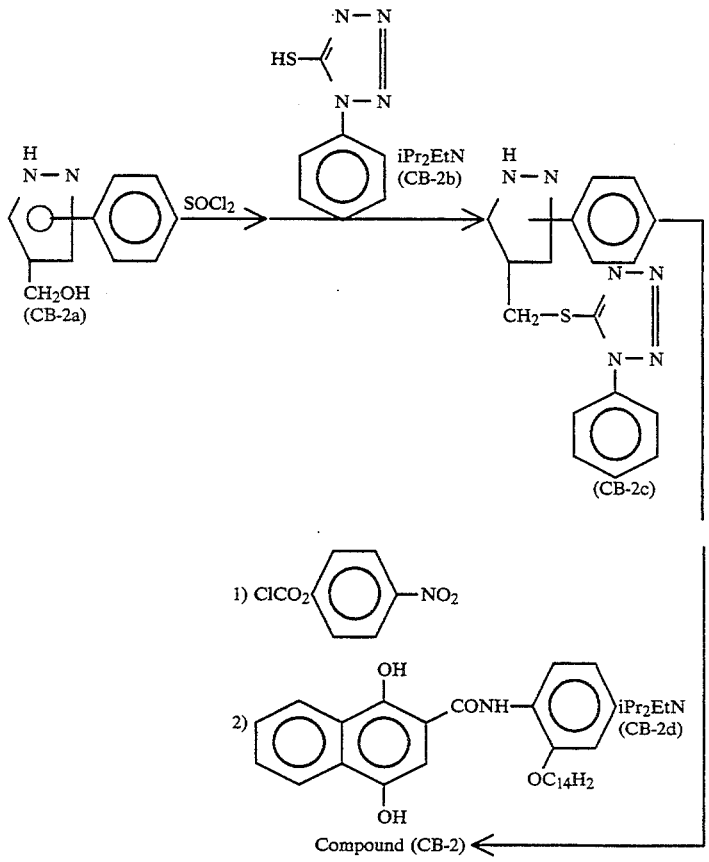

Precisely, 10 mmol of (CB-2a) was suspended in 30 ml of chloroform, 20 mmol of thionyl chloride was added thereto and reacted at 50° C. for one hour, and then the solvent was removed by distillation. The residue thus obtained was added to a solution of 10 mmol of (CB-2b) and 20 mmol of diisopropylethylamine in 30 ml of dimethylformamide and reacted for one hour, and then the reaction mixture was poured in 200 ml of ice-water. 50 ml of chloroform was added thereto and stirred, and the aqueous phase was separated. The organic layer was washed two times each with 100 ml of water, and then dried with sodium sulfate and concentrated to obtain (CB-2c).

The thus obtained (CB-2c) was dissolved in 30 ml of chloroform, and 10 mmol of nitrophenyl chlorocarbonate was added thereto and reacted for one hour. Then, a solution of 10 mmol of (CB-2b) in 50 ml of ethyl acetate was added thereto, and 50 mmol of diisopropylethylamine was added thereto and reacted for one hour. The reaction was stopped by adding 10 ml of 1-N hydrochloric acid to the reaction system. This was then diluted with 10 ml of ethyl acetate. The organic layer was washed with water and then dried with sodium sulfate and concentrated. The resulting residue was purified by silica gel column chromatography (using an eluent of ethyl acetate/hexane= 1/3) to obtain 1.94 g of Compound (CB-2). The yield was 23%. The product had a melting point of 101.5° to 102.5° C.

Synthesis Example 4:

Synthesis of Compound (CB-3):

Compound (CB-3) was synthesized in accordance with the process mentioned below.

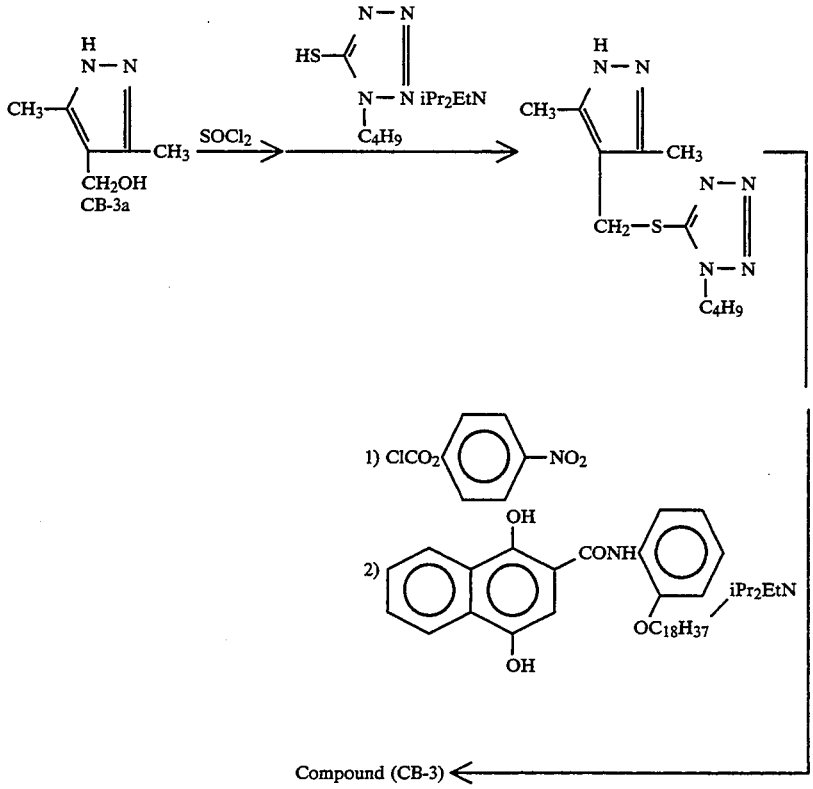

Using (CB-3a) as the starting compound, Compound (CB-3) was produced in the same manner as in the synthesis of Compound (CB-2) mentioned above. The yield of the product was 31%. The product had a melting point of 68.0° to 69.0° C.

Synthesis Example 5:

Synthesis of Compound (CB-11):

Compound (CB-11) was synthesized in accordance with the process mentioned below.

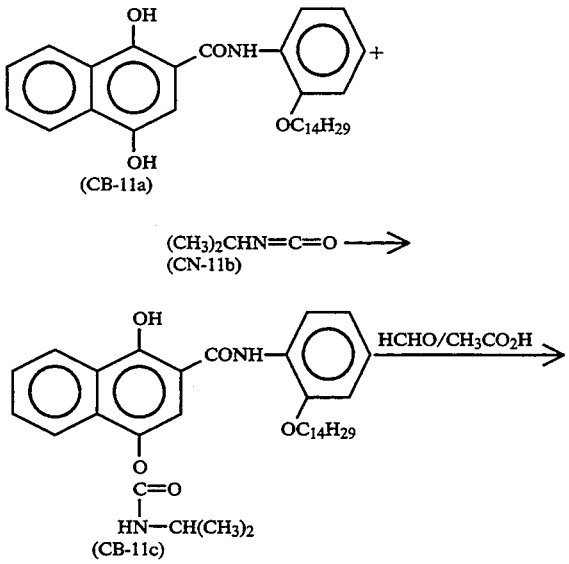

-continued

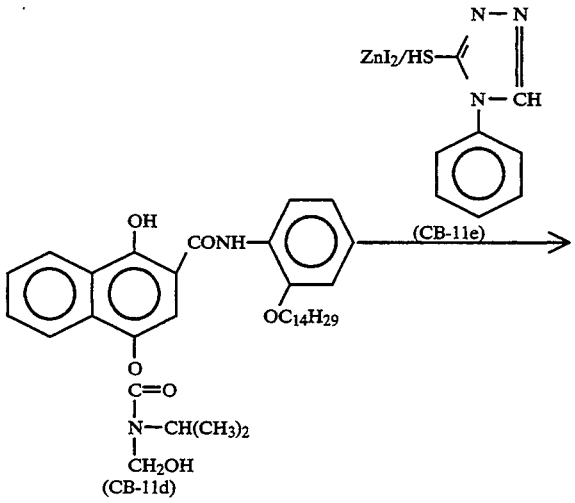

Compound (CB-11)

Precisely, 200 g of (CB-11a) and 34.7 g of (CB-11b) were dissolved in 500 ml of ethyl acetate, and 142 ml of diisopropylethylamine was added thereto and stirred for 4 hours. The crystals thus precipitated were taken out by filtration and washed with ethyl acetate to obtain 176 g (75%) of (CS-11c).

53.6 g of (CB-11c) and 27.9 g of paraformaldehyde reacted in a mixture consisting of 500 ml of 1,2-dichloroethane and 54 ml of acetic acid under reflux for 4 hours. After cooled to room temperature, the reaction solution was washed with water, and then dried with anhydrous sodium sulfate and concentrated. The resulting residue was purified by silica gel column chromatography, using chloroform as an eluent, to obtain 23.2 g (41.2%) of (CB-11d).

23.2 g of (CB-11d) and 6.78 g of (CB-11c) were dissolved in 250 ml of chloroform, and 26.88 g of zinc iodide was added thereto and stirred for 3 hours. After 1-N hydrochloric acid was added, the reaction solution was washed with water. The organic layer was dried with anhydrous sodium sulfate and concentrated, and the resulting residue was purified by silica gel column chromatography (using ethyl acetate/hexane=1/4) to obtain 7.0 g of Compound (CB-11). The yield was 23.9%. The product had a melting point of 117.0° to 118.5° C.

Synthesis Example 6:

Synthesis of Compound (CB-13):

Compound (CB-13) was synthesized in the same manner as in Synthesis Example 5. The product had a melting point of 61.5° to 63.0° C.

Synthesis Example 7:

Synthesis of Compound (CB-19):

Compound (CB-19) was synthesized in the same manner as in Synthesis Example 2 of JP-A-60-218645. The yield was 7%. The product had a melting point of 115° C.

Synthesis Example 8:

Synthesis of Compound (SA-5):

Compound (SA-5) was synthesized in accordance with the process mentioned below.

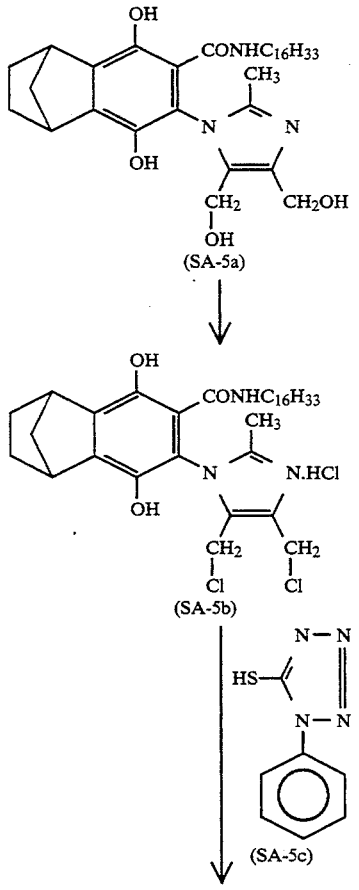

Precisely, 11.6 g of (SA-5a) (this was produced by the same method as that described in JP-A-61-230135 (corresponding to U.S. Pat. Nos. 4,740,453 and 5,142,029)) was added to 30 ml of thionyl chloride with cooling with water, and reacted for one hour at 50° C. The excess thionyl chloride was removed by distillation under reduced pressure, and the crystals precipitated were washed with a small amount of ice-cooled chloroform to obtain (SA-5b) as crude crystals. Next, 13.1 g of (SA-5b) were added to a solution of 7.2 g of (SA-5c) and 12.1 g of triethylamine in 100 ml of N,N-dimethylformamide at 0° C. and then reacted for one hour at room temperature.

The reaction mixture was poured into an aqueous solution consisting of 60 ml of 2-N hydrochloric acid and 300 ml of ice-water, and 300 ml of ethyl acetate was added thereto and stirred. The resulting liquid was transferred into a separatory funnel, and the oily layer was separated and washed several times each with water. The organic layer was dried with anhydrous sodium sulfate and concentrated, and the residue was purified by silica gel column chromatography (using ethyl acetate/hexane=1/4 to 1/1, v/v, as an eluent) to obtain 3.7 g of Compound (SA-5) as an amorphous product.

The compounds of formulae (1) and (2) for use in the present invention may be added to any layer or layers constituting the photographic material according to the present invention. Preferably, they are added to the light-sensitive emulsion layer(s) and/or the adjacent layer(s). More preferably, they are added to the red-sensitive emulsion layer(s) and/or the green-sensitive emulsion layer(s). Where one color-sensitive layer is composed of two or more layers having different sensitivities, the compounds may be added to any one or more of the highest sensitivity layer, the lowest sensitivity layer and the middle sensitivity layer.

The total amount of the compounds to be added to the photographic material is from 0.001 to 1.0 g/m$^2$, preferably from 0.010 to 0.5 g/m$^2$, more preferably from 0.020 to 0.40 g/m$^2$, most preferably from 0.030 to 0.30 g/m$^2$.

Where the compound(s) of formula (1) and the compound(s) of formula (2) are used together, the blending proportions are not specifically defined but may be selected freely. If desired, other development inhibitor-releasing compounds than the compounds of formulae (1) and (2) may be used together with the compounds of formulae (1) and (2).

The photographic material according to the present invention may contain yellow-colored cyan couplers.

Yellow-colored cyan couplers which may be in the photographic material according to the present invention are cyan couplers that have, by themselves, an absorption peak between 400 nm and 500 nm in the visible absorption range and that are coupled with an oxidation product of an aromatic primary amine developing agent to form cyan dyes having an absorption peak between 630 nm and 750 nm in the visible absorption range.

Of such yellow-colored cyan couplers, preferred are those that can release a compound residue containing a water-soluble 6-hydroxy-2-pyridon-5-ylazo group, a water-soluble pyrazolon-4-ylazo group, a water-soluble 2-acylaminophenylazo group or a water-soluble 2-sulfonamidophenylazo group, by coupling reaction with an oxidation product of an aromatic primary amine developing agent.

Colored cyan couplers of the following formulae (CI) to (CIV) are preferably used in the present invention.

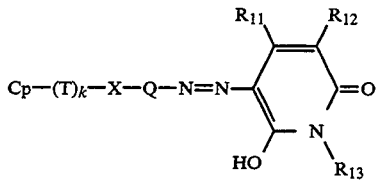
(CI)

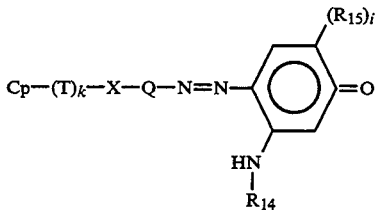
(CII)

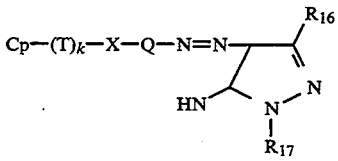
(CIII)

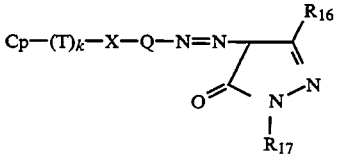
(CIV)

In formulae (CI) to (CIV), Cp represents a cyan coupler residue (to which T is bonded at the coupling position); T represents a timing group; k represents an integer of 0 or 1; X represents a divalent linking group which contains N, O or S and which is bonded to $(T)_k$ or Cp via the atom to thereby link $(T)_k$ or Cp and Q; and Q represents an arylene group or a divalent heterocyclic group.

In formula (CI), $R_{11}$ and $R_{12}$ independently represent a hydrogen atom, a carboxyl group, a sulfo group, a cyano group, an alkyl group, a cycloalkyl group, an aryl group, a heterocyclic group, a carbamoyl group, a sulfamoyl group, a carbonamido group, a sulfonamido group, or a sulfonyl group; and $R_{13}$ represents a hydrogen atom, an alkyl group, a cycloalkyl group, an aryl group or a heterocyclic group; provided that at least one of T, X, Q, $R_{11}$, $R_{12}$ and $R_{13}$ contains a water-soluble group (e.g., hydroxyl, carboxyl, sulfo, amino, ammoniumyl, phosphono, phosphino, hydroxysulfonyloxy).

It is generally known that, in formula (CI), the following moiety:

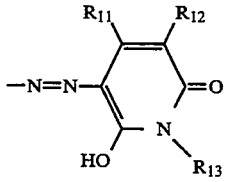

includes the following tautomeric structures:

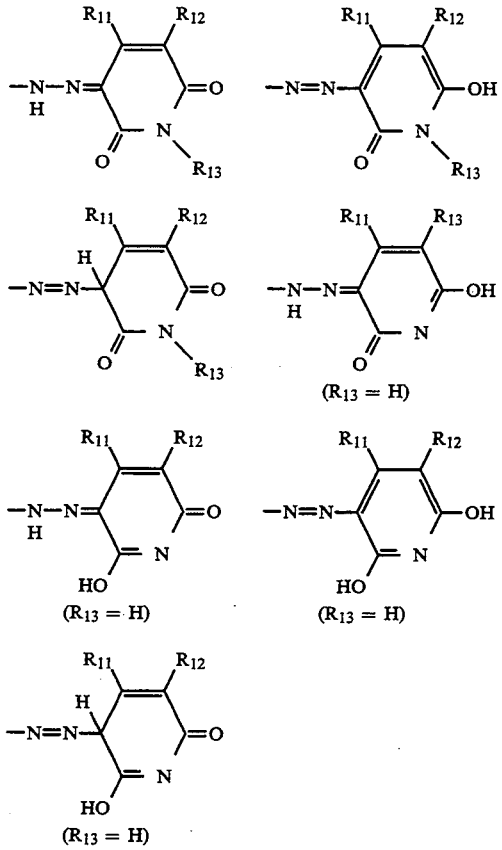

Needless-to-say, these tautomeric structures are within the scope of formula (CI).

In formula (CII), $R_{14}$ represents an acyl group or a sulfonyl group; $R_{15}$ represents a substitutable group; and j represents an integer of from 0 to 3. When j is an integer of 2 or more, plural $(R_{15})$'s may be the same or different. At least one of T, X, Q, $R_{14}$ and $R_{15}$ contains a water-soluble group (e.g., hydroxyl, carboxyl, sulfo, phosphono, phosphino, hydroxysulfonyloxy, amino, ammoniumyl).

In formulae (CIII) and (CIV), $R_{16}$ represents a hydrogen atom, a carboxyl group, a sulfo group, a cyano group, an alkyl group, a cycloalkyl group, an aryl group, an alkoxy group, a cycloalkyloxy group, an aryloxy group, a heterocyclic group, a carbamoyl group, an alkoxycarbonyl group, an aryloxycarbonyl group, a sulfamoyl group, a carbonamido group, a sulfonamido group or a sulfonyl group; and $R_{17}$ represents a hydrogen atom, an alkyl group, a cycloalkyl group, an aryl group or a heterocyclic group; provided that at least one of T, X, Q, $R_{16}$ and $R_{17}$ contains a water-soluble group (e.g., hydroxyl, carboxyl, sulfo, phosphono, phosphino, hydroxysulfonyloxy, amino, ammoniumyl).

The following groups are tautomers and indicate the same compound.

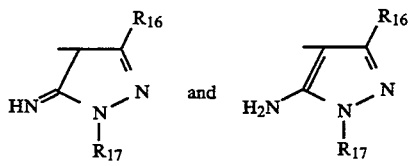

-continued

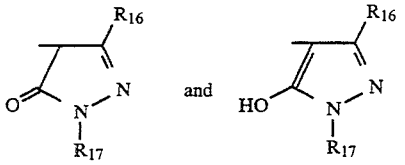

The compounds of formulae (CI) to (CIV) will be explained in more detail hereunder.

The coupler residue of Cp may be a residue of a known cyan coupler (e.g., phenol-type or naphthol-type cyan coupler).

The timing group of T is a group which cleaves its bond to X after cleavage of its bond to Cp by coupling reaction of the coupler of formulae (CI) to (CIV) and an oxidation product of an aromatic primary amine developing agent, and this is used for various purposes of adjustment of the coupling reactivity of the coupler, stabilization of the coupler and adjustment of the timing for releasing the moiety bonded to the coupler via X. As examples of the timing group of the kind, mentioned are known linking groups of the following formulae (T-1) to (T-7) where * indicates the position at which the timing group is bonded to Cp and ** indicates the position at which it is bonded to X.

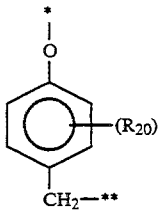

(T-1)

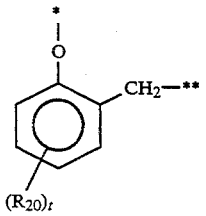

(T-2)

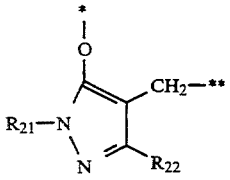

(T-3)

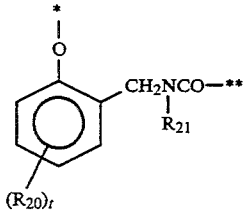

(T-4)

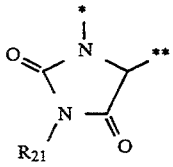

(T-5)

-continued

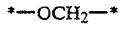

(T-6)

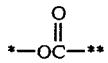

(T-7)

In these formulae, $R_{20}$ represents a group substitutable on the benzene ring; $R_{21}$ has the same meaning as $R_{41}$ which will be mentioned below; $R_{22}$ represents a hydrogen atom or a substituent; and t represents an integer of from 0 to 4. As examples of the substituents of $R_{20}$ and $R_{22}$, mentioned are $R_{41}$, a halogen atom, $R_{43}O$—, $R_{43}S$—, $R_{43}(R_{44})NCO$—, $R_{43}OOC$—, $R_{43}SO_2$—, $R_{43}(R_{44})NSO_2$—, $R_{43}CON(R_{43})$—, $R_{41}SO_2N(R_{43})$—, $R_{43}CO$—, $R_{41}COO$—, $R_{41}SO$—, a nitro group, $R_{43}(R_{44})NCON(R_{45})$—, a cyano group, $R_{41}OCON(R_{43})$—, $R_{43}OSO_2$—, $R_{43}(R_{44})N$—, $R_{43}(R_{44})NSO_2N(R_{45})$— and

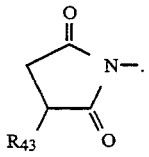

In the above-mentioned groups, $R_{41}$ represents an aliphatic group, an aromatic group or a heterocyclic group; and $R_{43}$, $R_{44}$ and $R_{45}$ each represents a hydrogen atom, an aliphatic group, an aromatic group or a heterocyclic group.

The aliphatic group as referred to herein means a saturated or unsaturated, acyclic or cyclic, linear or branched, substituted or unsubstituted aliphatic hydrocarbon residue having from 1 to 32, preferably from 1 to 22, carbon atoms. Specific examples of the group include methyl, ethyl, propyl, isopropyl, butyl, t-butyl, i-butyl, t-amyl, hexyl, cyclohexyl, 2-ethylhexyl, octyl, 1,1,3,3-tetramethylbutyl, decyl, dodecyl, hexadecyl and octadecyl groups.

The aromatic group as referred to herein is an aromatic group having from 6 to 20 carbon atoms, preferably a substituted or unsubstituted phenyl or naphthyl group.

The heterocyclic group as referred to herein is preferably a 3-membered to 8-membered substituted or unsubstituted heterocyclic group having from 1 to 20, preferably from 1 to 7, carbon atoms and having one or more hetero atoms selected from nitrogen atom, oxygen atom and sulfur atom. Specific examples of the group include 2-pyridyl, 2-thienyl, 2-furyl, 1,3,4-thiadiazol-2-yl, 2,4-dioxo-1,3-imidazolidin-5-yl, 1,2,4-triazol-2-yl and 1-pyrazolyl groups.

The aliphatic hydrocarbon group, aromatic group and heterocyclic group may optionally have substituent(s). Specific examples of the substituents include a halogen atom, $R_{47}O$—, $R_{46}S$—, $R_{47}CON(R_{48})$—, $(R_{47})(R_{48})NCO$—, $R_{46}OCON(R_{47})$—, $R_{46}SO_2N(R_{47})$—, $(R_{47})(R_{48})NSO_2$—, $R_{46}SO_2$—, $R_{47}OCO$—, $(R_{47})(R_{48})NCON(R_{49})$—, $R_{46}$—,

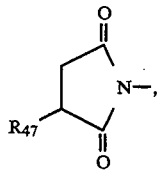

$R_{46}COO$—, $R_{47}OSO_2$—, a cyano group and a nitro group. In these groups, $R_{46}$ represents an aliphatic group, an aromatic group or a heterocyclic group; and $R_{47}$, $R_{48}$ and $R_{49}$ each represents an aliphatic group, an aromatic group, a heterocyclic group or a hydrogen atom. The aliphatic group, aromatic group and heterocyclic groups have the same definitions as mentioned hereinabove.

k is an integer of 0 or 1, but in general, k is preferably 0. That is to say, it is preferred that Cp is directly bonded to X.

X is a divalent linking group which is bonded to Cp—$(T)_k$— via N, O or S. Preferably, X is —O—, —S—, —OCO—, —OCO(O)—, —OCO(S)—, —OCONH—, —$SO_2$—, —$OSO_2NH$—, or a heterocyclic group that is bonded to Cp—$(T)_k$— via N (for example, a group derived from pyrrolidine, piperidine, morpholine, piperazine, pyrrole, pyrazole, imidazole, 1,2,4-triazole, benzotriazole, succinimide, phthalimide, oxazolidine-2,4-dione, imidazolidine-2,4-dione or 1,2,4-triazolidine-3,5-dione), or is a linking group composed of these groups and an alkylene group (e.g., methylene, ethylene, propylene), a cycloalkylene group (e.g., 1,4-cyclohexylene), an arylene group (e.g., o-phenylene, p-phenylene), a divalent heterocyclic group (e.g., a group derived from pyridine or thiophene), —CO—, —$SO_2$—, —COO—, —CONH—, —$SO_2NH$—, —$SO_2O$—, —NHCO—, —$NHSO_2$—, —NHCONH—, —$NHSO_2NH$— and/or —NHCOO—.

More preferably, X is a group of formula (I):

$$*-X_1-(L-X_2)_m-** \quad (I)$$

wherein * indicates the position at which the group is bonded to Cp—$(T)_k$—; ** indicates the position at which the group is bonded to Q; x1 represents —O— or —S—; L represents an alkylene group; $X_2$ represents —O—, —S—, —CO—, —$SO_2$—, —OCO—, —COO—, —NHCO—, —CONH—, —$SO_2NH$—, —$NHSO_2$—, —$SO_2O$—, —$OSO_2$—, —OCO(O)—, —OCONH—, —NHCOO—, —NHCONH—, —$NHSO_2NH$—, —OCO(S)—, —SCO(O)—, —$OSO_2NH$— or —$NHSO_2O$—; and m represents an integer of from 0 to 3.

The total number of carbon atoms (hereinafter referred to as "the total carbon number") in X is preferably from 0 to 12, more preferably from 0 to 8. X is most preferably —$OCH_2CH_2O$—.

Q represents an arylene group or a divalent heterocyclic group.

The arylene group of Q may be of a condensed ring or may have substituent(s) (for example, selected from a halogen atom, a hydroxyl group, a carboxyl group, a sulfo group, a nitro group, a cyano group, an amino group, an ammonium group, a phosphono group, a phosphino group, an alkyl group, a cycloalkyl group, an aryl group, a carbonamido group, a sulfonamido group, an alkoxy group, an aryloxy group, an acyl group, a sulfonyl group, a carboxyl group, a carbamoyl group and a sulfamoyl group). The total carbon number in the arylene group is preferably from 6 to 15, more preferably from 6 to 10.

The heterocyclic group of Q is a 3-membered to 8-membered, preferably 5-membered to 7-membered, mono-cyclic or condensed heterocyclic group having at least one hetero atom selected from N, O, S, P, Se and Te, in the group, for example, a residue derived from pyridines, thiophenes, furans, pyrroles, pyrazoles, imidazoles, thiazoles, oxazoles, benzothiazoles, benzoxazoles, benzofurans, benzothiophenes, 1,3,4-thiadiazoles, indoles and quinolines. The group may optionally have substituent(s) selected from those mentioned hereinabove for the arylene group of Q. The total carbon number in the heterocyclic group is preferably from 2 to 15, more preferably from 2 to 10.

Most preferably, Q is a group of:

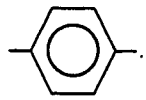

Therefore, the moiety —$(T)_k$—X—Q— is most preferably a group of:

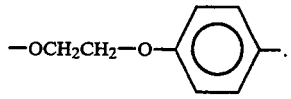

When $R_{11}$, $R_{12}$ or $R_{13}$ is an alkyl group, the alkyl group may be either linear or branched and may contain unsaturated bond(s). It may have substituent(s) (for example, selected from a halogen atom, a hydroxyl group, a carboxyl group, a sulfo group, a phosphono group, a phosphino group, a cyano group, an alkoxy group, an aryl group, an alkoxycarbonyl group, an amino group, an ammoniumyl group, an acyl group, a carbonamido group, a sulfonamido group, a carbamoyl group, a sulfamoyl group and a sulfonyl group).

When $R_{11}$, $R_{12}$ or $R_{13}$ is a cycloalkyl group, the cycloalkyl group is of a 3-membered to 8-membered ring and may contain a crosslinked moiety/moieties. It may also contain unsaturated bond(s) and may have substituent(s) (for example, selected from those mentioned hereinabove for the alkyl group of $R_{11}$, $R_{12}$ or $R_{13}$).

When $R_{11}$, $R_{12}$ or $R_{13}$ is an aryl group, the aryl group may be of a condensed ring or may have substituent(s) (for example, selected from an alkyl group, a cycloalkyl group and also those mentioned hereinabove for the alkyl group of $R_{11}$, $R_{12}$ or $R_{13}$).

When $R_{11}$, $R_{12}$ or $R_{13}$ is a heterocyclic group, the heterocyclic group is a 3-membered to 8-membered, preferably 5-membered to 7-membered, mono-cyclic or condensed heterocyclic group having at least one hetero atom selected from N, S, O, P, Se and Te, in the group (e.g., imidazolyl, thienyl, pyrazolyl, thiazolyl, pyridyl, quinolinyl). The group may optionally have substituent(s) (for example, selected from those mentioned hereinabove for the aryl group of $R_{11}$, $R_{12}$ or $R_{13}$).

The carboxyl group as referred to herein may contain a carboxylato group; the sulfo group a sulfonato group; the phosphino group a phosphinato group; and the phosphono group a phosphonato group. In these cases, the pair ion is, for example, $Li^+$, $Na^+$, $K^+$ or ammonium ion.

$R_{11}$ is preferably a hydrogen atom, a carboxyl group, an alkyl group having a total carbon number of from 1 to 10 (e.g., methyl, t-butyl, sulfomethyl, 2-sulfoethyl, carboxymethyl, 2-carboxyethyl, 2-hydroxyethyl, benzyl, ethyl, isopropyl), or an aryl group having a total carbon number of from 6 to 12 (e.g., phenyl, 4-methoxyphenyl, 4-sulfophenyl); and it is especially preferably a hydrogen atom, a methyl group or a carboxyl group.

$R_{12}$ is preferably a cyano group, a carboxyl group, a carbamoyl group having a total carbon number of from 1 to 10, a sulfamoyl group having a total carbon number of from 0 to 10, a sulfo group, an alkyl group having a total carbon number of from 1 to 10 (e.g., methyl, sulfomethyl), a sulfonyl group having a total carbon number of from 1 to 10 (e.g., methylsulfonyl, phenylsulfonyl), a carbonamido group having a total carbon number of from 1 to 10 (e.g., acetamido, benzamido), or a sulfonamido group having a total carbon number of from 1 to 10 (e.g., methanesulfonamido, toluenesulfonamido); and it is especially preferably a cyano group, a carbamoyl group or a carboxyl group.

$R_{13}$ is preferably a hydrogen atom, an alkyl group having a total carbon number of from 1 to 12 (e.g., methyl, sulfomethyl, carboxymethyl, 2-sulfoethyl, 2-carboxyethyl, ethyl, n-butyl, benzyl, 4-sulfobenzyl), or an aryl group having a total carbon number of from 6 to 15 (e.g., phenyl, 4-carboxyphenyl, 3-carboxyphenyl, 4-methoxyphenyl, 2,4-dicarboxyphenyl, 2-sulfophenyl, 3-sulfophenyl, 4-sulfophenyl, 2,4-disulfophenyl, 2,5-disulfophenyl); and it is more preferably an alkyl group having a total carbon number of from 1 to 7, or an aryl group having a total carbon number of from 6 to 10.

$R_{14}$ is concretely an acyl group of the following formula (II), or a sulfonyl group of the following formula (III).

$$R_{31}CO— \quad (II)$$

$$R_{31}SO_2— \quad (III)$$

wherein $R_{31}$ represents an alkyl group, a cycloalkyl group, an aryl group or a heterocyclic group.

The alkyl group of $R_{31}$ may be either linear or branched and may contain unsaturated bond(s). It may have substituent(s) (for example, selected from a halogen atom, a hydroxyl group, a carboxyl group, a sulfo group, a phosphono group, a phosphino group, a cyano group, an alkoxy group, an aryl group, an alkoxycarbonyl group, an amino group, an ammoniumyl group, an acyl group, a carbonamido group, a sulfonamido group, a carbamoyl group, a sulfamoyl group and a sulfonyl group).

The cycloalkyl group of $R_{31}$ is of a 3-membered to 8-membered ring, and it may have crosslinked moiety/moieties and may contain unsaturated bond(s). It may also have substituent(s) (for example, selected from those mentioned hereinabove for the alkyl group of $R_{31}$).

The aryl group of $R_{31}$ may be of a condensed ring and may have substituent(s) (for example, selected from an alkyl group, a cycloalkyl group and those mentioned hereinabove for the alkyl group of $R_{31}$).

The heterocyclic group of $R_{31}$ is of a 3-membered to 8-membered, preferably 5-membered to 7-membered, monocyclic or condensed heterocyclic ring having at least one hetero ring selected from N, S, O, P, Se and Te in the ring (e.g., imidazolyl, thienyl, pyrazolyl, thiazolyl, pyridyl, quinolinyl), and it may have substituent(s) (for example, selected from those mentioned hereinabove for the aryl group of $R_{31}$).

The carboxyl group as referred to herein may contain a carboxylato group; the sulfo group a sulfonato group; the phosphino group a phosphinato group; and the phosphono group a phosphonato group. In these cases, the pair ion is, for example, $Li^+$, $Na^+$, $K^+$ or ammonium ion.

$R_{31}$ is preferably an alkyl group having a total carbon number of from 1 to 10 (e.g., methyl, carboxymethyl, sulfoethyl, cyanoethyl), a cycloalkyl group having a total carbon number of from 5 to 8 (e.g., cyclohexyl, 2-carboxycyclohexyl), or an aryl group having a total carbon number of from 6 to 10 (e.g., phenyl, 1-naphthyl, 4-sulfophenyl); and it is especially preferably an alkyl group having a total carbon number of from 1 to 3, or an aryl group having a total carbon number of 6.

$R_{15}$ is a substitutable group, preferably an electron-donating group, especially preferably $—NR_{32}R_{33}$ or $—OR_{34}$. The position of $R_{15}$ is preferably the 4-position of the benzene ring. $R_{32}$, $R_{33}$ and $R_{34}$ each is a hydrogen atom, an alkyl group, a cycloalkyl group, an aryl group or a heterocyclic group, having the same definition as $R_{31}$. $R_{32}$ and $R_{33}$ may form a ring, and the nitrogen-containing hetero ring to be formed by them is preferably alicyclic.

j represents an integer of from 0 to 3, preferably 1 or 2, especially preferably 1.

When $R_{16}$ or $R_{17}$ is an alkyl group, the alkyl group may be either linear or branched and may contain unsaturated bond(s). It may have substituent(s) (for example, selected from a halogen atom, a hydroxyl group, a carboxyl group, a sulfo group, a phosphono group, a phosphino group, a cyano group, an alkoxy group, an aryl group, an alkoxycarbonyl group, an amino group, an ammoniumyl group, an acyl group, a carbonamido group, a sulfonamido group, a carbamoyl group, a sulfamoyl group and a sulfonyl group).

When $R_{16}$ or $R_{17}$ is a cycloalkyl group, the cycloalkyl group is of a 3-membered to 8-membered ring and may contain a crosslinked moiety/moieties. It may also contain unsaturated bond(s) and may have substituent(s) (for example, selected from those mentioned hereinabove for the alkyl group of $R_{16}$ or $R_{17}$).

When $R_{16}$ or $R_{17}$ is an aryl group, the aryl group may be of a condensed ring or may have substituent(s) (for example, selected from an alkyl group, a cycloalkyl group and also those mentioned hereinabove for the alkyl group of $R_{16}$ or $R_{17}$).

When $R_{16}$ or $R_{17}$ is a heterocyclic group, the heterocyclic group is a 3-membered to 8-membered, preferably 5-membered to 7-membered, mono-cyclic or condensed heterocyclic group having at least one hetero atom selected from N, S, O, P, Se and Te, in the group (e.g., imidazolyl, thienyl, pyrazolyl, thiazolyl, pyridyl, quinolinyl). The group may optionally have substituent(s) (for example, selected from those mentioned hereinabove for the aryl group of $R_{16}$ or $R_{17}$).

The carboxyl group as referred to herein may contain a carboxylato group; the sulfo group a sulfonato group; the phosphino group a phosphinato group; and the phosphono group a phosphonato group. In these cases, the pair ion is, for example, $Li^+$, $Na^+$, $K^+$ or ammonium ion.

$R_{16}$ is preferably a cyano group, a carboxyl group, a carbamoyl group having a total carbon number of from 1 to 10, an alkoxycarbonyl group having a total carbon number of from 2 to 10, an aryloxycarbonyl group having a total carbon number of from 7 to 11, a sulfamoyl group having a total carbon number of from 0 to 10, an alkyl group having a total carbon number of from 1 to 10 (e.g., methyl, carboxymethyl, sulfomethyl), a sulfonyl group having a total carbon number of from 1 to 10 (e.g., methylsulfonyl, phenylsulfonyl), a carbonamido group having a total carbon number of from 1 to 10 (e.g., acetamido, benzamido), a sulfonamido group having a total carbon number of from 1 to 10 (e.g., methanesulfonamido, toluenesulfonamido), an alkyloxy group (e.g., methoxy, ethoxy), or an aryloxy group (e.g., phenoxy); and it is especially preferably a cyano group, a carbamoyl group, an alkoxycarbonyl group or a carboxyl group.

$R_{17}$ is preferably a hydrogen atom, an alkyl group having a total carbon number of from 1 to 12 (e.g., methyl, sulfomethyl, carboxymethyl, ethyl, 2-sulfoethyl, 2-carboxyethyl, 3-sulfopropyl, 3-carboxypropyl, 5-sulfopentyl, 5-carboxypentyl, 4-sulfobenzyl), or an aryl group having a total carbon number of from 6 to 15 (e.g., phenyl, 4-carboxyphenyl, 3-carboxyphenyl, 2,4-dicarboxyphenyl, 4-sulfophenyl, 3-sulfophenyl, 2,5-disulfophenyl, 2,4-disulfophenyl); and it is especially preferably an alkyl group having a total carbon number of from 1 to 7, or an aryl group having a total carbon number of from 6 to 10.

Specific examples of yellow-colored cyan couplers which are preferably used in the present invention are mentioned below, but these are not limitative.

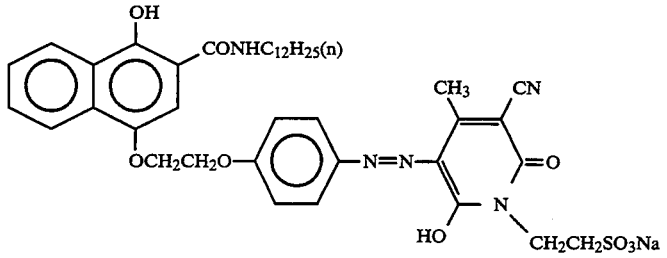

(YC-1)

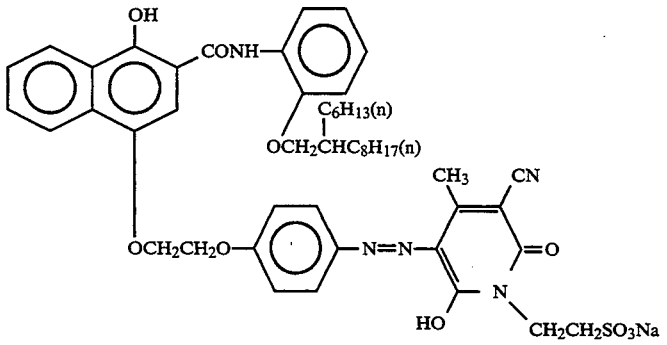

(YC-2)

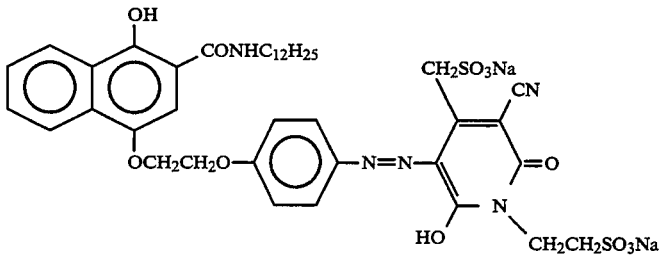

(YC-3)

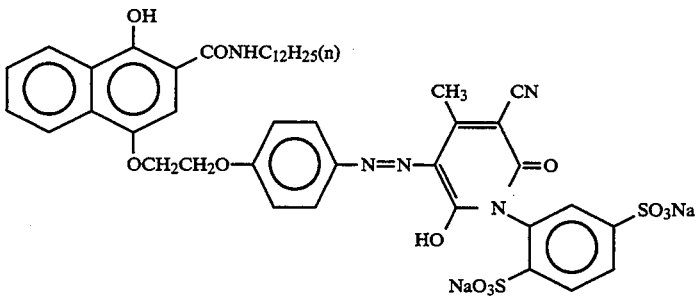

(YC-4)

-continued
(YC-5)
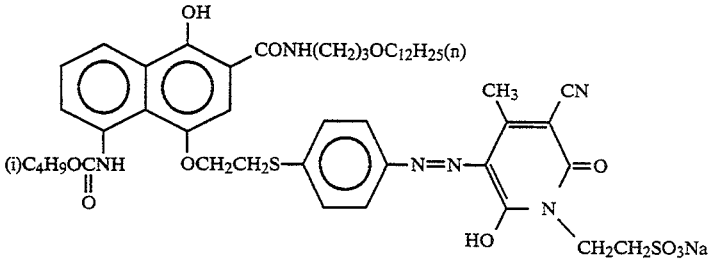
(YC-6)
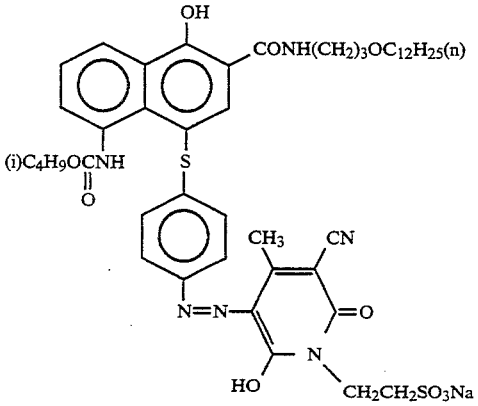
(YC-7)
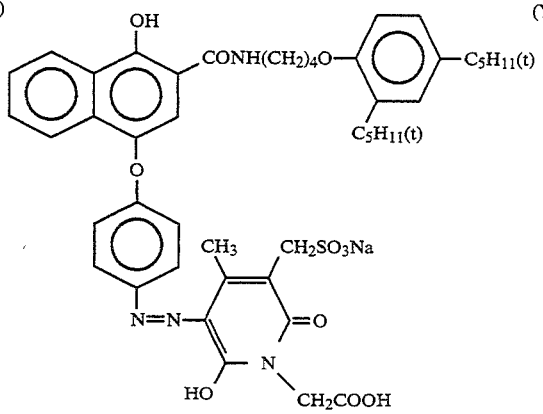
(YC-8)
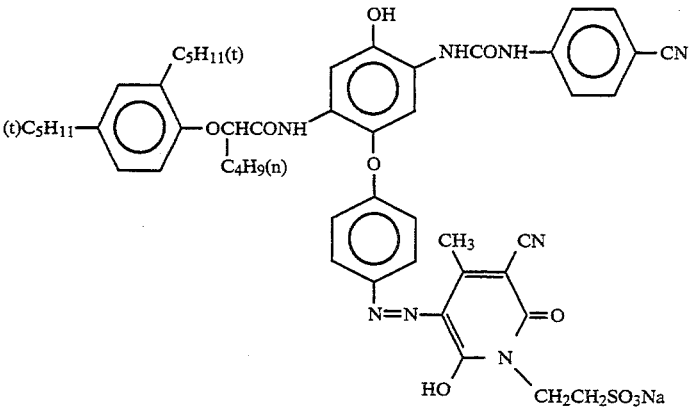
(YC-9)
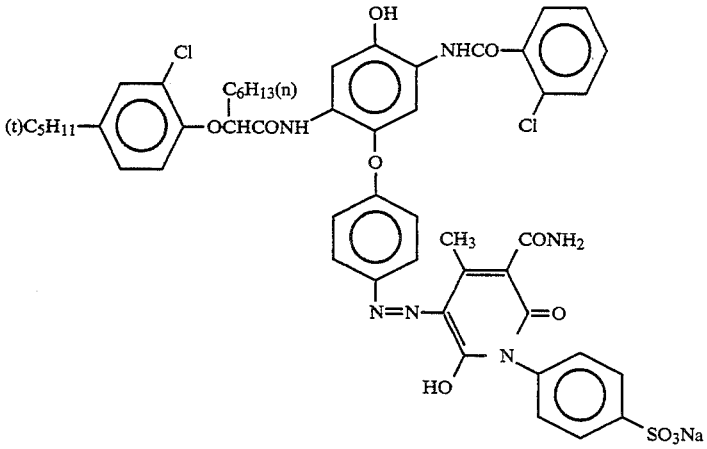

-continued
(YC-10)
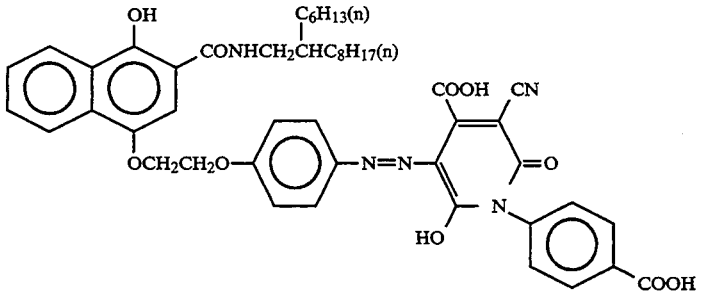
(YC-11)
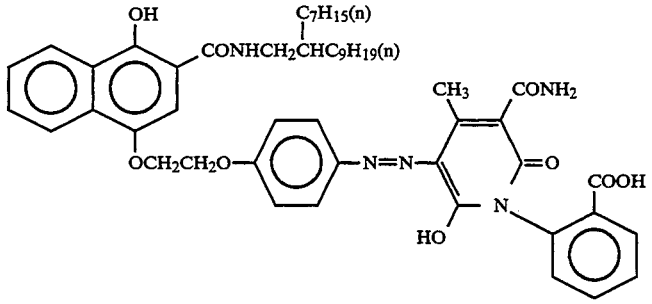
(YC-12)
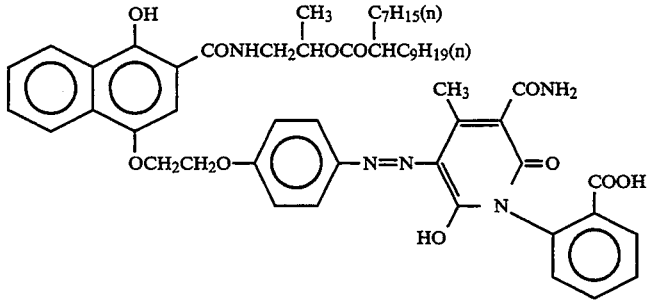
(YC-13)
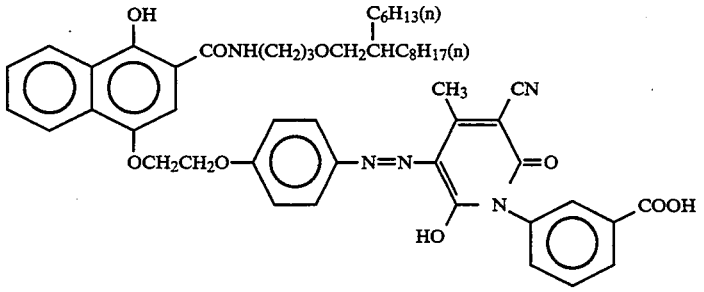
(YC-14)
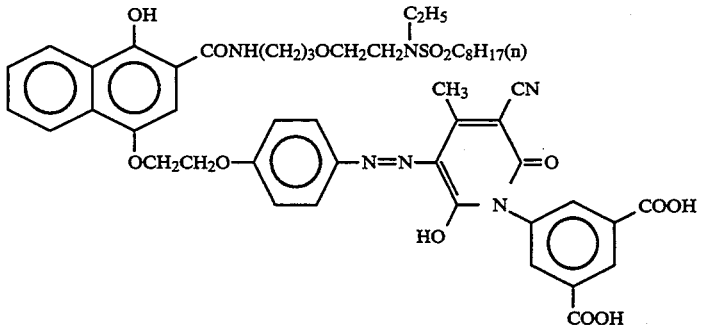

-continued
(YC-15)
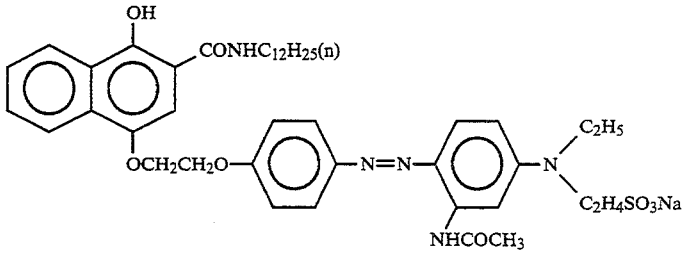
(YC-16)
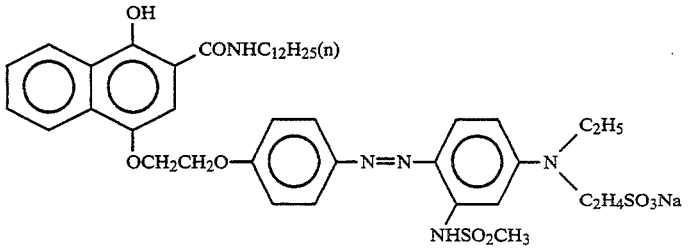
(YC-17)
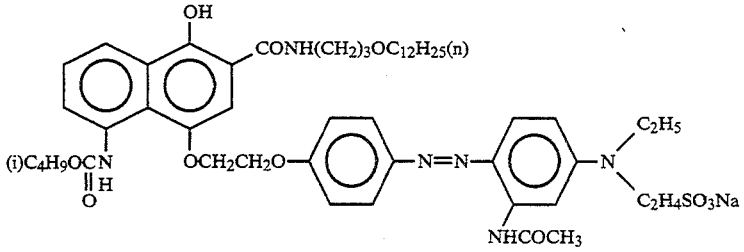
(YC-18)
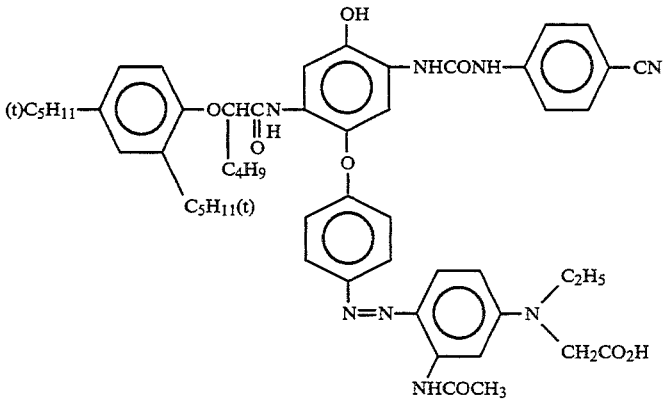
(YC-19)
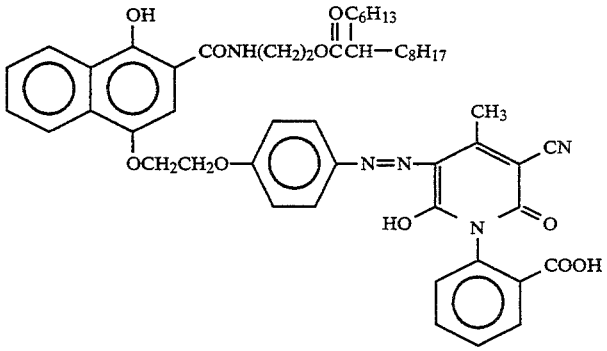

-continued
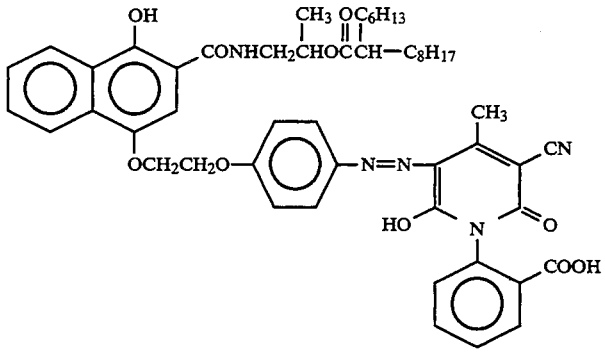
(YC-20)
(YC-21)
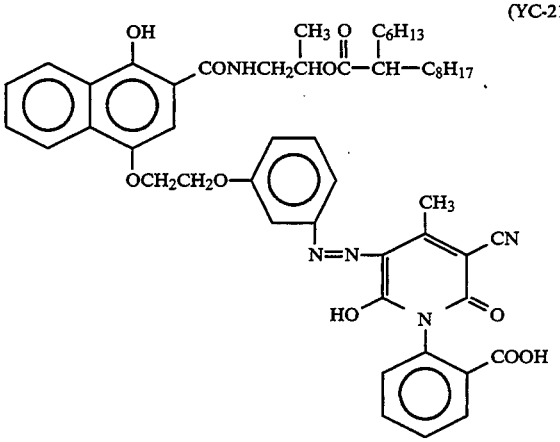
(YC-22)
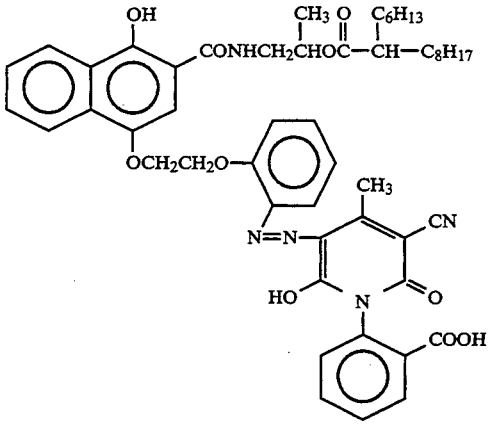
(YC-23)
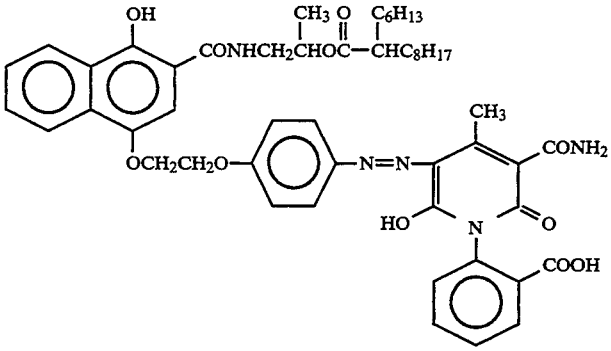
(YC-24)
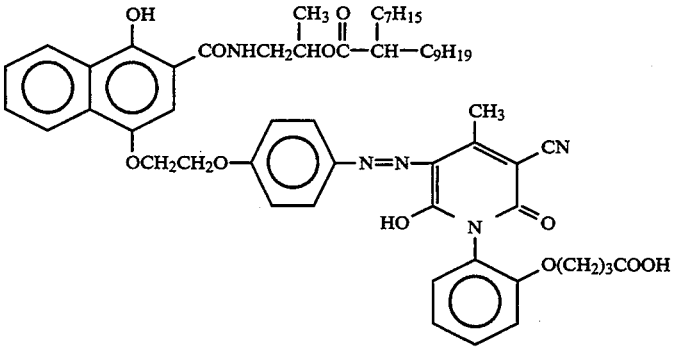

-continued
(YC-25)
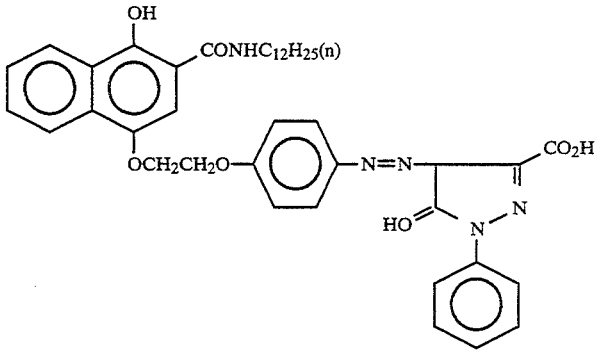
(YC-26)
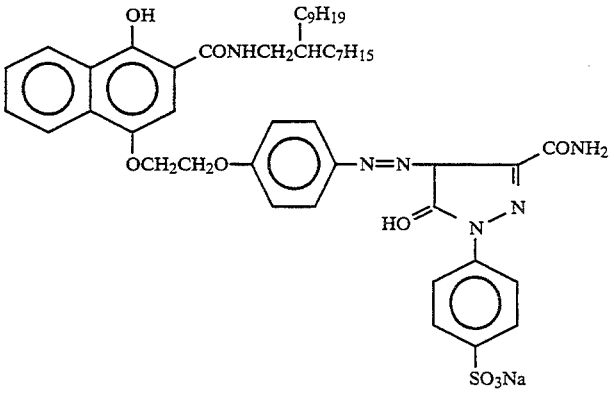
(YC-27)
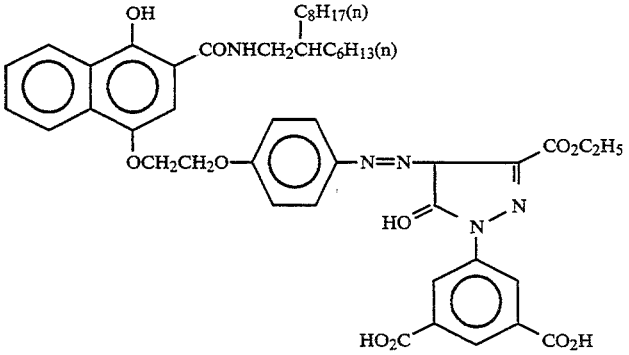
(YC-28)
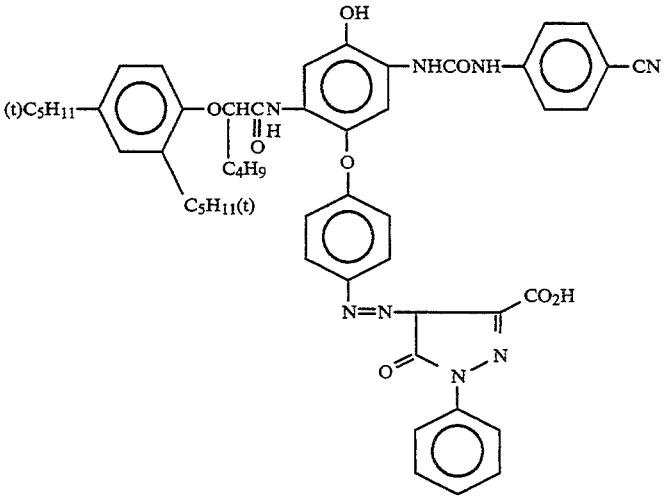

-continued (YC-29)

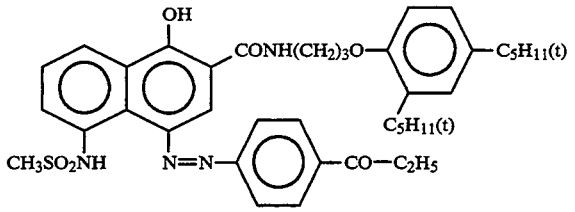

Yellow-colored couplers of formula (CI) which are usable in the present invention may be synthesized generally by diazo-coupling reaction of 6-hydroxy-2-pyridones and aromatic diazonium salts or heterocyclic diazonium salts having a coupler structure.

The former 6-hydroxy-2-pyridones may be synthesized by the methods described in E. Klingsberg, *Heterocyclic Compounds—Pyridine and Its Derivatives*, Part 3 (published by Interscience, (1962)); *J. Am. Chem. Soc.*, (1943), Vol 65, p. 449; *J. Chem. Tech. Biotechnol.*, (1986), Vol. 36, p. 410; *Tetrahedron*, (1966), Vol. 22, p. 445; JP-B-61-52827; West German Patents 2,162,612, 2,349,709 and 2,902,486; and U.S. Pat. No. 3,763,170.

The latter diazonium salts may be synthesized by the methods described in U.S. Pat. Nos. 4,004,929 and 4,138,258, JP-A-61-72244 and JP-A-61-273543.

The diazo-coupling reaction of 6-hydroxy-2-pyridones and diazonium salts may be carried out in a solvent such as, for example, methanol, ethanol, methyl cellosolve, acetic acid, N,N-dimethylformamide, N,N-dimethylacetamide, tetrahydrofuran, dioxane or water, or in a mixed solvent thereof. The reaction may use a base such as, for example, sodium acetate, potassium acetate, sodium carbonate, potassium carbonate, sodium hydrogencarbonate, sodium hydroxide, potassium hydroxide, pyridine, triethylamine, tetramethylurea or tetramethylguanidine. The reaction temperature may be generally from −78° C. to 60° C., preferably from −20° C. to 30° C.

Examples of synthesizing typical yellow-colored cyan couplers for use in the present invention are mentioned below.

Synthesis Example 1:
Synthesis of Coupler (YC-1):

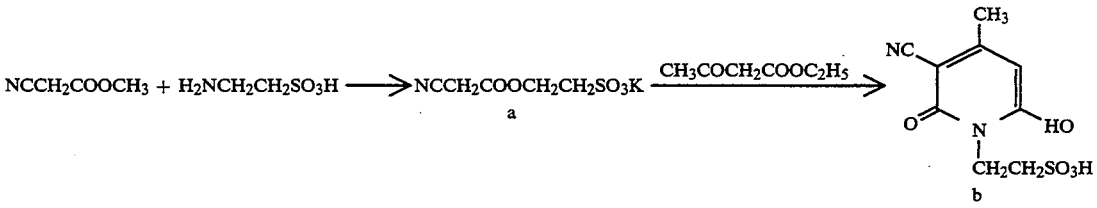

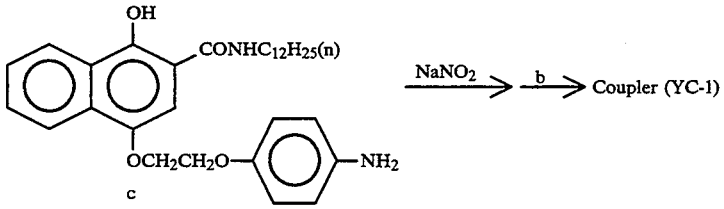

Synthesis Example 2:
Synthesis of Coupler (YC-2):

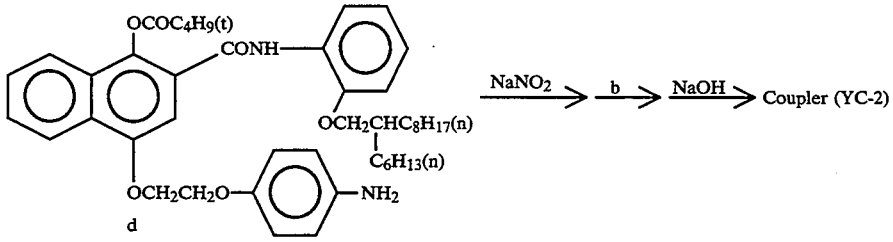

Synthesis Example 3:
Synthesis of Coupler (YC-13):

-continued
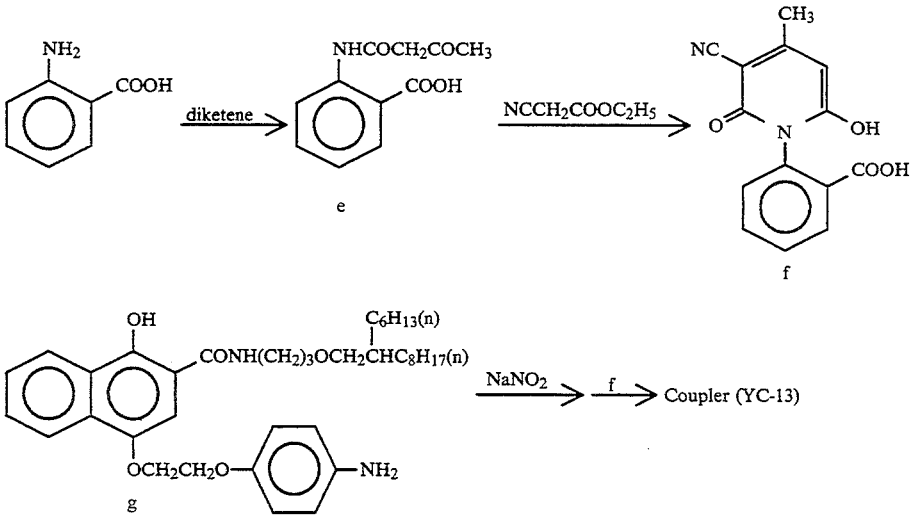
Synthesis Example 4:
Synthesis of Coupler (YC-20):
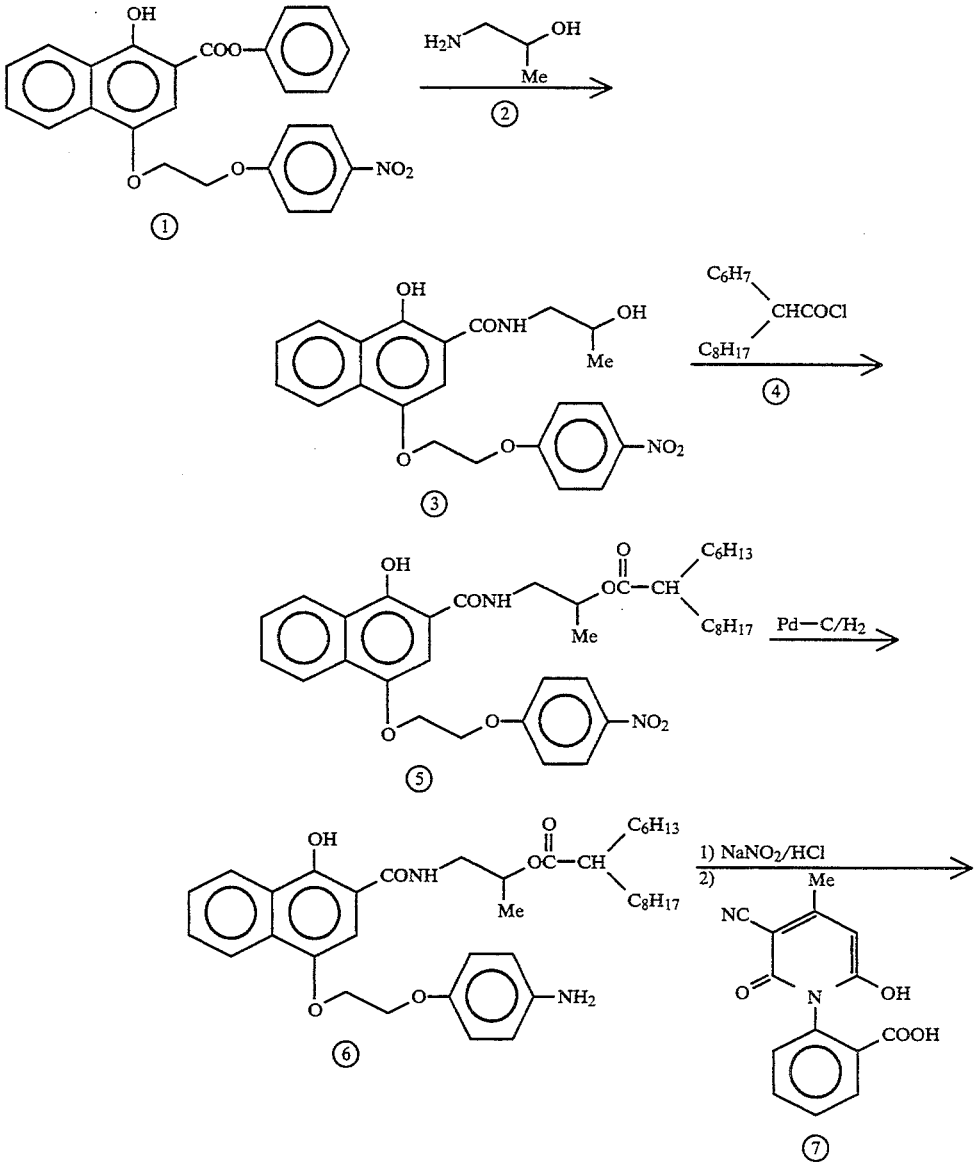

-continued

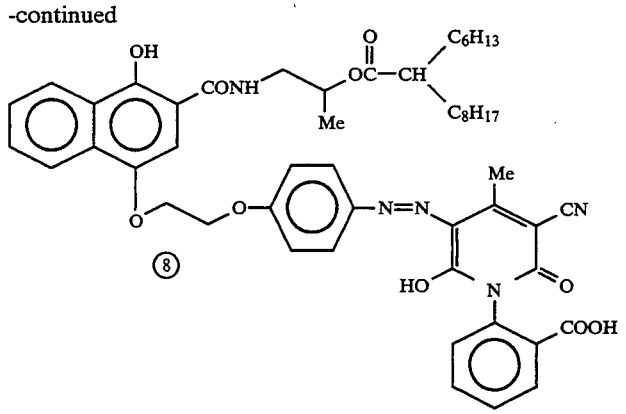

Coupler (YC-20)

Yellow-colored cyan couplers of formulae (CII) to (CIV) which are also usable in the present invention may be synthesized by the methods described in JP-B-58-6939 and JP-A-1-197563 and also by the methods described in the literatures and patent publications that have been hereinabove referred to for the synthesis of couplers of formula (CI).

Yellow-colored cyan couplers of formulae (CI) and (CII) are preferably used in the present invention. Of them, those of formula (CI) are especially preferably used.

The above-mentioned yellow-colored cyan couplers are preferably added to the light-sensitive silver halide emulsion layers or their adjacent layers in the photographic material according to the present invention. Especially preferably, they are added to the red-sensitive emulsion layers. The total amount of the couplers to be added to the photographic material is from 0.005 to 0.30 g/m$^2$, preferably from 0.02 to 0.20 g/m$^2$, more preferably from 0.03 to 0.15 g/m$^2$.

The addition of the yellow-colored cyan couplers may be conducted by ordinary methods, like the addition of ordinary couplers, as will be mentioned hereunder.

The support to be used in the present invention is a polyethylene-aromatic dicarboxylate type polyester support, having a glass transition point of from 50° C. to 200° C. It is preferably heat-treated at a temperature falling within the range of from 40° C. to its glass transition point, before or after having been coated with subbing layer(s) but before being coated with emulsion layers.

The support for use in the present invention will be explained in detail hereunder.

A 36-exposures film which is to be loaded in a photographic material-loaded photographic article with an exposure function (hereinafter referred to as a film-integrated camera) is about 60% longer than a 24-exposures film to be loaded in the same. Therefore, when a raw 36-exposures film as drawn out of a patrone is rolled and loaded in the supply room of a camera, the number of the coils of the rolled film is large due to the prolonged length of the film so that the film is rolled densely in the room (or that is, the rolled film is hardly unrolled therein). In addition, in the case, since the diameter to be formed by the rolled innermost layer of the film in the supply room is naturally smaller than that of a 24-exposures film, the starting tip of the rolled film (or the tongue of the rolled film) is strongly curled. Therefore, after photographic exposure of the film of the whole length, the strongly-curled tongue of the film as cased in the patrone is to closely adhere to the inner wall of the patrone so that the operation of drawing the tongue of the exposed film from the patrone with a tool prior to the development of the film is extremely difficult.

A film-integrated camera does not have a back cover, unlike ordinary cameras, so that the patrone having therein an exposed film is taken out from the camera by opening the patrone-letting-out cover that is provided in the bottom of the exposed film-rolling room and letting out the patrone along the axial direction. Because of such constitution, if the tongue of the exposed film is not completely cased in the patrone, the patrone cannot be taken out from the camera since the projected tongue will interfere with the taking-out operation. Therefore, the operation of drawing the tongue of the exposed film from the patrone with a tool necessarily precedes the development of the exposed film as cased in the patrone. However, the operation is difficult in using a 36-exposures film in a film-integrated camera. Because of the reasons, the loading of a 36-exposures film in a film-integrated camera has heretofore been not desired in consideration of the development of the exposed film.

On the other hand, if a 24-exposures film is loaded in a camera having a thinned thickness, the diameter of the rolled film to be in the camera must be reduced. If so reduced, however, the film will be strongly curled so that the operation of drawing the tongue of the exposed film from the patrone will also be extremely difficult. In particular, when films are exposed to a high-temperature atmosphere in summer season, they will be much more strongly curled and the operation of drawing the tongue of the exposed film from the patrone will be more difficult. In addition, such strongly curled films will cause fatal troubles, such as uneven development or breakage of the end of the film, in the end-free development in mini-laboratories.

In order to overcome the above-mentioned problems by satisfying the two factors, one being a strong mechanical strength and the other being an attenuated curling property, there are two means. The first means is to modify a cellulose triacetate (TAC) film having restorability of the curling habit so as to improve the mechanical strength of the film. The second means is to improve a polyester support naturally having a high mechanical strength such as, for example, a polyethylene terephthalate (PET) support to thereby reduce the curling habit of the support.

It is presumed extremely difficult to satisfy the two factors by the first means. This is because of the following reasons. The thickness of the TAC support that is generally used in the current color negative photographic films is 122 μm, and if it is reduced to 100 μm, the modulus of bending elasticity of the thinned support will be lowered to 55% of the 122 μm-thick support since the modulus is proportional to the third power of the thickness. Therefore, in the case, it is necessary to produce a support having an about two-time higher modulus of elasticity. On the other hand, if the diameter of the spool is reduced to 10 mm or less, even such a TAC film having restorability of the curling habit cannot sufficiently restore its curling, which resulted from its winding around such a thin spool, during the development to cause the above-mentioned "uneven development" and "breakage of film" and, additionally, the operation of drawing the tongue of the exposed film from the patrone is difficult. Hence, it is considered extremely difficult to satisfy all the three factors of "two-time improvement in the modulus of elasticity", "improvement in the restorability of curling habit" and "improvement in the operation of drawing the tongue of the exposed film from patrone" by the first means.

On the other hand, if the requirements are desired to be attained by the second means, for example, by using a PET film, the thickness of the film may be reduced to 100 μm or even to 90 μm with maintaining the modulus of bending elasticity comparable to that of a 122 μm-thick TAC film, since the PET film naturally has a high modulus of elasticity. Therefore, only the improvement in the curling habit of the PET film will be needed in order to satisfy the requirements. As a result of the inventors' investigations in this regard, it has been decided that the use of a PET film in the present invention is preferred.

In order to attain the above-mentioned objects, it has heretofore been considered that a polyethylene terephthalate film will be substitutable for a TAC film, as the former is inexpensive and has excellent producibility, a high mechanical strength and a high dimension stability. However, since a polyethylene terephthalate film strongly curls and the curl of the film remains much when it is rolled, handling of a developed photographic material having a support of the film is troublesome though the form of a roll film is most popularly used in the field of photography. Therefore, despite of the above-mentioned excellent properties, use of the PET film as a support for photographic films has been limited.

The inventor of the present invention has found that the use of a thinned support of a polyethylene-aromatic dicarboxylate type polyester, after its heat-treatment before coating emulsion layers thereon, is effective in attaining the above-mentioned objects. They have further found that the loading of a photographic film having the support in a film-integrated camera is extremely effective in increasing the number of the exposures of the film and in reducing the thickness of the camera body.

Polyesters which are preferably used in the present invention will be mentioned below.

There are many polyesters usable in the present invention. In view of the high quality with balancing the hardly-curling property, the mechanical strength and the cost with one another, preferred are polyesters comprising, as main components, benzene-dicarboxylic acids and ethylene glycol. Of them, especially preferred are polyethylene terephthalate (PET) type and polyethylene naphthalate type polyesters.

Polyesters for use in the present invention comprise, as essential components, diols and aromatic dicarboxylic acids. As usable dibasic acids, are mentioned terephthalic acid, isophthalic acid, phthalic acid, phthalic anhydride, naphthalene-dicarboxylic acid, succinic acid, glutaric acid, adipic acid, sebacic acid, succinic anhydride, maleic acid, fumaric acid, maleic anhydride, itaconic acid, citraconic anhydride, tetrahydrophthalic anhydride, diphenylene-p,p'-dicarboxylic acid, tetrachlorophthalic anhydride, 3,6-endomethylenetetrahydrophthalic anhydride, 1,4-cyclohexanedicarboxylic acid, and the following dibasic acids:

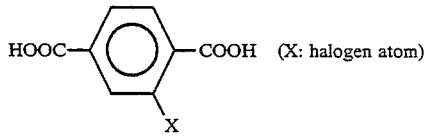

(X: halogen atom)

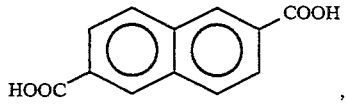

,

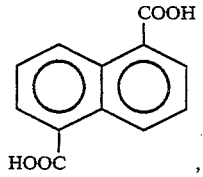

,

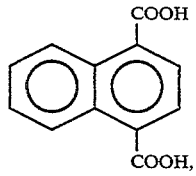

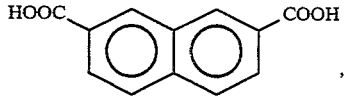

,

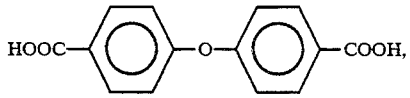

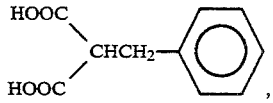

,

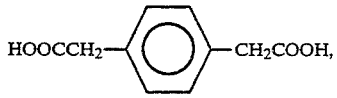

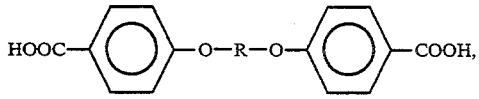

(R: $C_1$–$C_5$ alkylene)

-continued

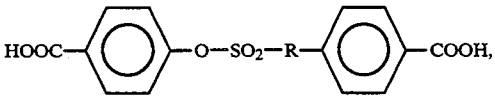

(R: $C_1$-$C_5$ alkylene)

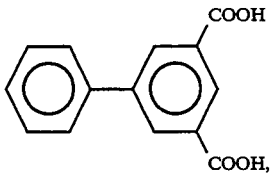

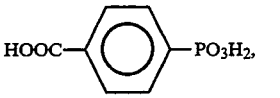

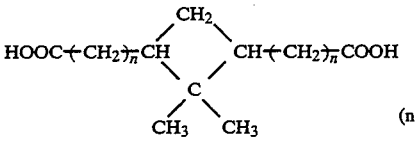

(n = 0,1),

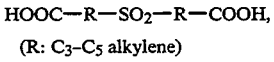

(R: $C_3$-$C_5$ alkylene)

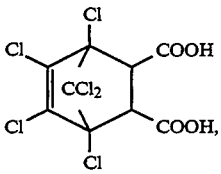

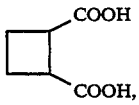

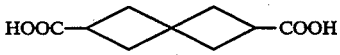

The essential aromatic dicarboxylic acids are those of the above-mentioned dicarboxylic acids, having at least one benzene nucleus therein.

As usable diols, are mentioned ethylene glycol, 1,3-propanediol, 1,2-propanediol, 1,4-butanediol, 1,5-pentanediol, 1,6-hexanediol, 1,7-heptanediol, 1,8-octanediol, 1,10-decanediol, 1,12-dodecanediol, 1,4-cyclohexanediol, 1,4-cyclohexanedimethanol, 1,3-cyclohexanediol, 1,1-cyclohexanedimethanol, catechol, resorcinol, hydroquinone, 1,4-benzenedimethanol and the following diols:

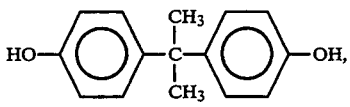

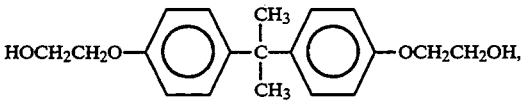

-continued

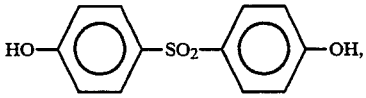

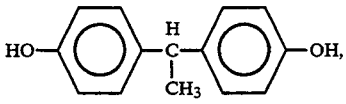

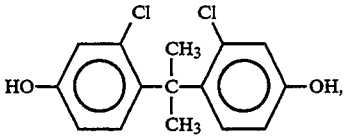

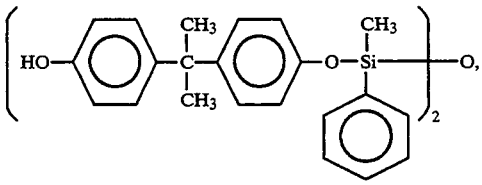

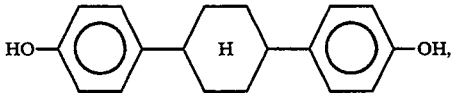

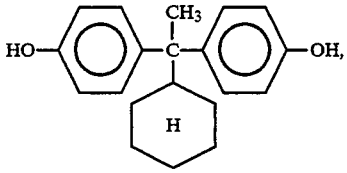

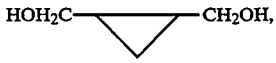

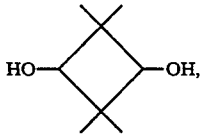

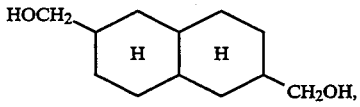

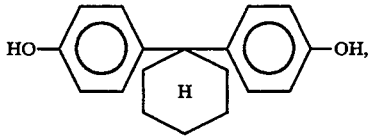

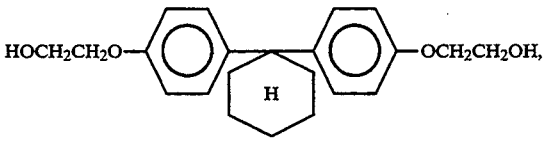

If desired, copolyesters containing additional comonomers of mono-functional or tri- or more polyfunctional hydroxyl group-containing compounds or acid-containing compounds may also be used in the present invention. Again, also usable in the present invention are copolyesters containing additional comonomers of compounds having both hydroxyl group(s) and carboxyl (or its ester) group(s) in the molecule. As examples of such comonomers, the following compounds are mentioned.

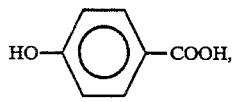

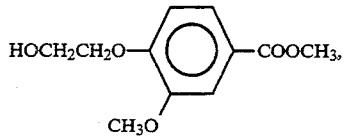

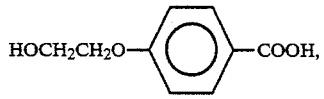

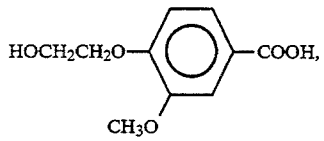

Of the polyesters comprising the above-mentioned diols and dicarboxylic acids, more preferred are homopolymers such as polyethylene terephthalate, polyethylene naphthalate, polycyclohexanedimethanol terephthalate (PCT), etc., and also copolymers to be obtained by copolymerizing one or more essential aromatic dicarboxylic acids, such as 2,6-naphthalenedicarboxylic acid (NDCA), terephthalic acid (TPA), isophthalic acid (IPA), ortho-phthalic acid (OPA) and paraphenylenedicarboxylic acid (PPDC), and one or more diols, such as ethylene glycol (EG), cyclohexanedimethanol (CHDM), neopentyl glycol (NPG), bisphenol A (BPA) and biphenol (BP), along with one or more comonomers hydroxycarboxylic acids, such as parahydroxybenzoic acid (PHBA) and 6-hydroxy-2-naphthalenecarboxylic acid (HNCA).

Of them, further preferred are copolymers of terephthalic acid, naphthalenedicarboxylic acid and ethylene glycol (in which the molar ratio of terephthalic acid to naphthalenedicarboxylic acid is preferably from 0.9/0.1 to 0.1/0.9, more preferably from 0.8/0.2 to 0.2/0.8); copolymers of terephthalic acid, ethylene glycol and bisphenol A (in which the molar ratio of ethylene glycol to bisphenol A is preferably from 0.6/0.4 to 0/1.0, more preferably 0.5/0.5 to 0.1/0.9); copolymers of isophthalic acid, paraphenylenedicarboxylic acid, terephthalic acid and ethylene glycol (in which the molar ratio of isophthalic acid to terephthalic acid and that of paraphenylenedicarboxylic acid to the same are preferably from 0.1/1 to 0.5/1 and from 0.1/1 to 0.5/1, respectively, more preferably from 0.2/1 to 0.3/1 and from 0.2/1 to 0.3/1, respectively); copolymers of terephthalic acid, neopentyl glycol and ethylene glycol (in which the molar ratio of neopentyl glycol to ethylene glycol is preferably from 1/0 to 0.7/0.3, more preferably from 0.9/0.1 to 0.6/0.4), copolymers of terephthalic acid, ethylene glycol and biphenol (in which the molar ratio of ethylene glycol to biphenol is from 0/1.0 to 0.8/0.2, more preferably from 0.1/0.9 to 0.7/0.3), and copolymers of parahydroxybenzoic acid, ethylene glycol and terephthalic acid (in which the molar ratio of parahydroxybenzoic acid to ethylene glycol is preferably from 0.1/0 to 0.1/0.9, more preferably from 0.9/0.1 to 0.2/0.8).

These homopolymers and copolymers may be synthesized by conventional known methods of producing ordinary polyesters. For instance, an acid component and a glycol component are directly esterified; or if a dialkyl ester is used as an acid component, it is first interesterified with a glycol component and the resulting product is then heated under reduced pressure to remove the excess glycol component. Alternatively, an acid halide is used as an acid component and this may be reacted with a glycol component. In the case, interesterification, addition of a catalyst or polymerization catalyst or addition of a heat-resistant stabilizer may be employed, if desired. Regarding the polyester synthesizing methods, for example, the descriptions of Studies of Polymer Experiments, Vol. 5 "Polycondensation and Addition Polymerization" (published by Kyoritsu Publishing Co., (1980)), pp. 103–136; and Synthetic Polymers V (published by Asakura Shoten KK, (1971)), pp. 187–286 may be referred to.

The polyesters preferably have a mean molecular weight of approximately from 10,000 to 500,000.

The polyesters may be blended with a part of other polyesters or may be copolymerized with comonomers of constituting other polyesters or may be copolymerized with unsaturated bond-having monomers for their radical crosslinking, in order to improve their adhesiveness to other polyesters.

Such polymer blends obtained by blending two or more polymers may easily be formed in accordance with the methods described in JP-A-49-5482, JP-A-64-4325, JP-A-3-192718, and Research Disclosure Nos. 283739-41, 284779-82 and 294807-14.

The polyesters for use in the present invention have a Tg of 50° C. or higher. However, since any special care is not generally taken in using the photographic article of the present invention and the article is often exposed to high temperatures of up to 40° C. especially in the outdoors in high summer, the polyesters are desired to have a Tg of 55° C. or higher, more preferably 60° C. or higher, especially preferably 70° C. or higher, from the safety viewpoint. This is because the improvement in the curling habit of the polyester support to be attained by the heat treatment thereof will be lost, if the support is exposed to higher temperatures than its glass transition point. Hence, the polyesters for use in the present invention are desired to have a glass transition point higher than 40° C. in view of the severe conditions under which the article is handled by general users or, for example, in view of the atmospheric temperature (40° C. or higher) in summer season.

Popular polyester films which are transparent and have a Tg of higher than 200° C. are unknown up to the present. Therefore, it is necessary that the polyesters for use in the present invention have a Tg of from 50° C. to 200° C.

Specific examples of polyester compounds which are preferably used in the present invention are mentioned below, but these are not limitative.

| Examples of Polyester Compounds: | | |
|---|---|---|
| P-0: | [terephthalic acid (TPA)/ethylene glycol (EG) (100/100)] (PET) | Tg = 80° C. |
| P-1: | [2,6-naphthalenedicarboxylic acid (NDCA)/ethylene glycol (EG) (100/100)] (PEN) | Tg = 119° C. |
| P-2: | [terephthalic acid (TPA)/cyclohexane-dimethanol (CHDM) (100/100)] | Tg = 93° C. |
| P-3: | [TPA/bisphenol A (BPA) (100/100)] | Tg = 192° C. |
| P-4: | 2,6-NDCA/TPA/EG (50/50/100) | Tg = 92° C. |
| P-5: | 2,6-NDCA/TPA/EG (75/25/100) | Tg = 102° C. |
| P-6: | 2,6-NDCA/TPA/EG/BPA (50/50/75/25) | Tg = 112° C. |
| P-7: | TPA/EG/BPA (100/50/50) | Tg = 105° C. |
| P-8: | TPA/EG/BPA (100/25/75) | Tg = 135° C. |
| P-9: | TPA/EG/CHDM/BPA (100/25/25/50) | Tg = 115° C. |
| P-10: | IPA/PPDC/TPA/EG (20/50/30/100) | Tg = 95° C. |
| P-11: | NDCA/NPG/EG (100/70/30) | Tg = 105° C. |
| P-12: | TPA/EG/BP (100/20/80) | Tg = 115° C. |
| P-13: | PHBA/EG/TPA (200/100/100) | Tg = 125° C. |
| P-14: | PEN/PET (60/40) | Tg = 95° C. |
| P-15: | PEN/PET (80/20) | Tg = 104° C. |
| P-16: | PAr/PEN (50/50) | Tg = 142° C. |
| P-17: | PAr/PCT (50/50) | Tg = 118° C. |
| P-18: | PAr/PET (60/40) | Tg = 101° C. |
| P-19: | PEN/PET/PAr (50/25/25) | Tg = 108° C. |
| P-20: | TPA/5-sulfoisophthalic acid (SIP)/EG (95/5/100) | Tg = 65° C. |

The thickness of the support of the present invention is from 50 μm to 100 μm. If it is less than 50 μm, the support cannot resist the contraction stress of the light-sensitive layers to be yielded when the photographic material is dried. However, if it is more than 100 μm, it will be contradictory to the object for reducing the thickness of the photographic material so as to make the photographic article of the present invention compact.

All the above-mentioned polyesters for use in the present invention have a higher modulus of bending elasticity than that of TAC. Using them, therefore, the realization of the initial object of the present invention, which is to reduce the thickness of the photographic film in a film-integrated camera, is possible. Of the above-mentioned polyesters, PET and PEN have a particularly high modulus of elasticity. Using the two, therefore, it is possible to reduce the thickness of the film to 100 μm or less, while the thickness is needed to be 122 μm when TAC is used as the support.

The polyester support of the present invention is characterized in that it is heat-treated at a temperature falling within the range of 40° C. and its glass transition point for a period of from 0.1 to 1500 hours. The effect resulting from the heat treatment is higher, when the heat-treating temperature is higher. However, if the heat-treating temperature exceeds the glass transition point of the support film, the molecules in the film will rather be moved at random to reversely increase the free volume of them, whereby the molecules will become more fluid or, that is, the film will become more easily curled. Therefore, the heat-treatment need to be conducted at a temperature not higher than the glass transition point of the support film.

Because of the reasons, it is desired that the heat-treatment is conducted at a temperature a little lower than the glass transition point of the support film for the purpose of reducing the treating time. Specifically, the heat-treating temperature is to fall between 40° C. and the glass transition point of the film support to be heat-treated, preferably between a temperature lower than the glass transition point by 30° C. and the glass transition point.

When the support film is heat-treated under the above-mentioned temperature condition for a period of 0.1 hour or more, the film may exhibit the effect resulting from the treatment. However, even though the treating time is longer than 1500 hours under the same condition, the effect will almost be saturated. Therefore, it is desired that the heat-treatment is conducted within a period of from 0.1 hour to 1500 hours.

In the heat-treatment of the polyesters of the present invention, it is also preferred to pre-heat them for a short period of time, preferably for 5 minutes to 3 hours at a temperature higher than their Tg by from 20° C. to 100° C., so as to reduce the heat-treating time. Regarding the heat-treating method, the polyester film rolls may be kept in a heating storehouse as they are for attaining the intended heat-treatment of them therein, or alternatively, they may be conveyed in a heating zone. In view of the aptness for suitably producing the support films, the latter is preferred.

The core roll to be used for heat-treating the polyester film rolls is desirably a hollow roll in order that the thermal transfer may be effected efficiently throughout the film roll rolled over the hollow core roll, or it may have therein a built-in electric heater or have such a structure that a high-temperature fluid may flow through the hollow of the core roll in order that the core roll may be heated by the electric heater or the high-temperature fluid. The material of the core roll is not specifically defined but is preferably such that its strength is not reduced or it is not deformed when heated. For instance, usable are stainless steels and glass fiber-reinforced resins.

The polyesters for use in the present invention preferably contain various additives in order to further elevate their functions as photographic supports.

For instance, the polyester films for use in the present invention may contain an ultraviolet absorbent for the purpose of anti-fluorescence and of stabilization in storage, by kneading the absorbent into the film. As the ultraviolet absorbent, preferred are those not absorbing visible rays. The amount of the absorbent to be in the polyester film is generally approximately from 0.01% by weight to 20% by weight, preferably approximately from 0.05% by weight to 10% by weight based on the weight of the polyester film. If it is less than 0.01% by weight, its anti-UV effect cannot be attained. As preferred examples of the ultraviolet absorbent, mentioned are benzophenone compounds such as 2,4-dihydroxybenzophenone, 2-hydroxy-4-methoxybenzophenone, 2-hydroxy-4-n-octoxybenzophenone, 4-dodecyloxy-2-hydroxybenzophenone, 2,2',4,4'-tetrahydroxybenzophenone, and 2,2'-dihydroxy-4,4'-dimethoxybenzophenones; benzotriazole compounds such as 2-(2'-hydroxy-5-methylphenyl)benzotriazole, 2-(2'-hydroxy-3',5'-di-t-butylphenyl)benzotriazole, and 2-(2'-hydroxy-3'-di-t-butyl-5'-methylphenyl)benzotriazole; and salicylic acid compounds such as phenyl salicylate and methyl salicylate.

Use of the polyester film as the support of the photographic material of the present invention involves one problem about its properties, which is that the support causes light-piping due to its high refractive index.

The polyesters, especially aromatic polyesters, for use in the present invention have a high refractive index of from 1.6 to 1.7; while gelatin, which is the essential component of the light-sensitive layers to be coated over the polyester film, has a smaller refractive index of from 1.50 to 1.55 than the former. Therefore, when light is introduced into the film from its edge, it easily reflects on the interface between the base support and the emulsion layer. Because of the reasons, the polyester film causes a so-called light-piping phenomenon.

For evading such a light-piping phenomenon, there are known a method of adding inert inorganic grains or the like to the base film and a method of adding dyes thereto.

In the present invention, the addition of dyes which do not greatly increase the film haze is preferred for evading the light-piping phenomenon.

The dyes to be used for coloring the film for the purpose are not specifically defined. Preferred are gray coloring dyes in view of the general properties of photographic materials. Further preferred are dyes having high heat resistance in the temperature range for filming the polyester films and having excellent compatibility with the polyesters.

In view of the above-mentioned points, specifically mentioned are commercial dyes of Mitsubishi Kasei's Diaresin or Nippon Chemical's Kayaset, which are sold in the market as dyes for coloring polyesters. By adding these dyes, the intended object may be attained.

The coloring density due to addition of such dyes is needed to be at least 0.01 or more, more preferably 0.03 or more, as a visible color density measured with a Mackbeth's color densitometer.

The polyester films for use in the present invention may be treated to be lubricative, in accordance with their use. The means for making the films lubricative is not specifically defined. For instance, generally employable is a method of kneading an inactive inorganic compound into the film or a method of coating a surfactant over the film.

As the inactive inorganic grains usable for the purpose, mentioned are, for example, grains of $SiO_2$, $TiO_2$, $BaSO_4$, $CaCO_3$, talc, kaolin and the like. Apart from the addition of such inert grains to the polyester films during the step of producing them for the purpose of making the films lubricative, further employable is a method of precipitating internal grains in the polyester films where grains of catalysts or the like as added during polymerization of polyesters are precipitated out.

The means for making the polyester films lubricative are not specifically limited. However, since the supports of photographic materials must be transparent as their important factor, the grains to be added to the polyesters by the former method are desired to be selectively $SiO_2$ grains which have a refractive index relatively near to that of polyester films, and the internal grains to be precipitated in the polyester film by the latter method are desired to be selectively those having a relatively small grain size.

Where the polyester films are made lubricative by the grains-kneading means, a method of laminating a functional layer over the film is also preferably employable so as to much elevate the transparency of the film. As examples of the method, mentioned are co-extrusion with plural extruders and feed blocks and also co-extrusion with multi-manifold dies.

Where the polymer films mentioned above are used as the support in the present invention, it is extremely difficult to firmly fix photographic layers (such as light-sensitive silver halide emulsion layer, interlayer, filter layer, etc.) containing a protective colloid mainly containing gelatin, on the support, since the films have hydrophobic surfaces. The following two conventional methods (1) and (2) have heretofore been tried so as to overcome the difficulty.

(1) The first is a method of activating the surface of the support to be coated with photographic emulsion, by chemical treatment, mechanical treatment, corona-discharging treatment, flame treatment, ultraviolet treatment, high frequency treatment, glow-discharging treatment, activated plasma treatment, laser treatment, mixed acid treatment, ozone-oxidation treatment or the like, followed by direct coating of photographic emulsion over the activated surface, whereby the adhesion between the support and the coated layers is ensured.

(2) The second is a method of forming a subbing layer on the surface of the support, after the above-mentioned surface treatment of the support or without it, and thereafter coating photographic emulsion layers over the subbing layer. (Regarding the second method, for example, U.S. Pat. Nos. 2,698,241, 2,764,520, 2,864,755, 3,462,335, 3,475,193, 3,143,421, 3,501,301, 3,460,944, 3,674,531, British Patent 788,365, 804,005, 891,469, JP-B-48-43122, and JP-B-51-446 are referred to.)

All the above-mentioned surface treatments are considered to form polar groups in some degree on the surface of the support, which is naturally hydrophobic, and to increase the density of cross-linking on the surface thereof. As a result of any of the surface treatments, it is considered that the affinity of the thus-treated surface for the polar groups to be in the components contained in the liquid for the subbing layer is elevated and that the fastness of the surface of the support coated by photographic layers is elevated.

Various constitutions for the subbing layers are known. For instance, there are known a so-called multi-layer method where a first layer which well adheres to the support (hereinafter referred to as a first subbing layer) is coated on the support and then a hydrophilic resin layer which well adheres to photographic layers (hereinafter referred to as a second subbing layer) is coated over the first layer; and a single-layer method where only one resin layer having both hydrophobic groups and hydrophilic groups is coated on the support.

Of the surface treatments (1), corona-discharging treatment is the most popular method. This may be conducted by any known techniques, such as those described in JP-B-48-5043, JP-B-47-51905, JP-A-47-28067, JP-A-49-83767, JP-A-51-41770, and JP-A-51-131576. The number of frequency for the discharging method is suitably from 50 Hz to 5000 KHz, preferably from 5 KHz to several hundreds KHz. If the number of frequency for discharging is too small, stable discharging cannot be effected so that the treated surface will have unfavorably many pin holes. If the number of frequency for the same is too large, however, a special device will be needed for impedance matching. Such a special device is costly and unfavorable. The strength for the discharging treatment is suitably from 0.001 $KV.A.min/m^2$ to 5 $KV.A.min/m^2$, preferably from 0.01 $KV.A.min/m^2$ to 1 $KV.A.min/m^2$, to improve the wettability of ordinary polyester, polyolefin and other plastic films. The gap clearance between the electrode and the dielectric roll may be from 0.5 to 2.5 mm, preferably from 1.0 to 2.0 mm.

Of the surface treatments (1), glow-discharging treatment is the most effective in many cases, and it may be conducted by any known techniques such as those described in JP-B-35-7578, JP-B-36-10336, JP-B-45-22004, JP-B-45-22005, JP-B-45-24040, JP-B-46-43480, U.S. Pat. Nos. 3,057,792, 3,057,795, 3,179,482, 3,288,683, 3,309,299, 3,424,735, 3,462,335, 3,475,307 and 3,761,299, British Patent 997,093, and JP-A-53-129262.

Regarding the conditions for glow-discharging of the polymer supports for use in the present invention, in general, the pressure is suitably from 0.005 to 20 Torr, preferably from 0.02 to 2 Tort. If the pressure is too low, the surface-treating effect will be insufficient, but if it is too high, excessive current will flow through the support being treated to often generate sparks so that the operation is dangerous and additionally the support being treated will be destroyed. The discharging is conducted by applying high voltage to a pair or pairs of spaced metal plates or metal bars in a vacuum tank. The voltage may be varied, depending upon the composition of the ambient vapor and the pressure of the same. Generally, however, it is suitably from 500 to 5000 V within the above-mentioned pressure range so as to attain stable constant glow-discharging. The suitable range of the voltage for improving the adhesiveness of the treated support is between 2000 V and 4000 V.

The discharging frequency is suitably from a direct current to several thousands MHz, preferably from 50 Hz to 20 MHz, as will be derived from the related known techniques. The strength for the discharging treatment is suitably from 0.01 KV.A.min/$m^2$ to 5 KV.A.min/$m^2$, preferably from 0.15 KV.A.min/$m^2$ to 1 KV.A.min/$m^2$, so as to attain the intended adhering performance of the treated support.

The second method (2) for forming subbing layer(s) on the surface of the support for use in the present invention will be mentioned below. This includes, as mentioned above, a multi-layer method and a single-layer method, both of which have been studied well in this technical field. Regarding the first subbing layer in the former multi-layer method, for example, copolymers comprising monomers chosen from among vinyl chloride, vinylidene chloride, butadiene, methacrylic acid, acrylic acid, iraconic acid and maleic anhydride, as well as other various polymers such as polyethylenimine, epoxy resins, grafted gelatins and nitro cellulose have been investigated with respect to their characteristics; and regarding the second subbing layer in the same, gelatin has been essentially investigated.

In the latter single-layer method, it is frequently carried out to swell supports so as to attain good adhesion between the support and a hydrophilic subbing polymer by interfacial admixture between the two.

As hydrophilic subbing polymers usable in the present invention, mentioned are water-soluble polymers, cellulose esters, latex polymers and water-soluble polyesters. As water-soluble polymers, mentioned are gelatin, gelatin derivatives, casein, agar, sodium alginate, starch, polyvinyl alcohol, polyacrylic acid copolymers and maleic anhydride copolymers; and as cellulose esters, mentioned are carboxymethyl cellulose and hydroxyethyl cellulose. As latex polymers, mentioned are vinyl chloride-containing copolymers, vinylidene chloride-containing copolymers, acrylate-containing copolymers, vinyl acetate-containing copolymers and butadiene-containing copolymers. Of them, most preferred is gelatin.

As compounds of swelling the support for use in the present invention, mentioned are resorcinol, chlororesorcinol, methylresorcinol, o-cresol, m-cresol, p-cresol, phenol, o-chlorophenol, p-chlorophenol, dichlorophenol, trichlorophenol, monochloroacetic acid, dichloroacetic acid, trifluoroacetic acid and chloral hydrate. Of them, preferred are resorcinol and p-chlorophenol.

The subbing layer for use in the present invention may contain various gelatin-hardening agents. As usable gelatin hardening agents, mentioned are, for example, chromium salts (chromium alum, etc.), aldehydes (formaldehyde, glutaraldehyde, etc.), isocyanates, active halogen compounds (2,4-dichloro-6-hydroxy-s-triazine, etc.), epichlorohydrin resins and others.

The subbing layer for use in the present invention may contain fine inorganic grains such as $SiO_2$, $TiO_2$ or mat agent or fine grains (having a grain size of from 1 to 10 μm) of polymethyl methacrylate copolymers.

in addition to the above-mentioned components, the subbing layer for use in the present invention may further contain other various additives. For instance, it may contain a surfactant, an antistatic agent, an anti-halation agent, coloring dyes and pigments, a coating aid, an antifoggant, etc. Where the support for use in the present invention is coated by plural subbing layers, it is quite unnecessary to incorporate an etchant such as resorcinol, chloral hydrate or chlorophenol into the coating liquid for the first subbing layer. If desired, however, such an etchant may be added to the coating liquid for the first subbing layer.

The subbing layer may be coated on the support by any well-known method, for example, by a dip-coating, air knife-coating, curtain-coating, roller coating, wire bar-coating or gravure-coating method or may also by an extrusion coating method using a hopper, such as that described in U.S. Pat. No. 2,681,294. If desired, two or more subbing layers may be coated at the same time, for example, by the methods described in U.S. Pat. Nos. 2,761,791, 3,508,947, 2,941,898 and 3,526,528 and in Yuji Harazaki, *Coating Engineering, page* 253 (published by Asakura Shoten KK, (1973)).

The photographic material for use in the present invention may have various light-insensitive layers such as anti-halation layer, interlayer, backing layer and surface protective layer, in addition to light-sensitive layers.

The binder of the backing layer of the photographic material for use in the present invention may be made of a hydrophobic polymer or may also be made of a hydrophilic polymer such as that to be in the subbing layer.

The backing layer may contain an antistatic agent, a lubricant, a matting agent, a surfactant, a dye and other additives. The antistatic agent to be in the backing layer is not specifically defined. For instance, it includes anionic polyelectrolytes of polymers containing carboxylic acids, carboxylic acid salts or sulfonic acid salts, such as those described in JP-A-48-22017, JP-B-46-24159, JP-A-51-30725, JP-A-51-129216 and JP-A-55-95942; and cationic polymers such as those described in JP-A-49-121523, JP-A-48-91165 and JP-B-49-24582. The ionic surfactant to be in the layer may be either anionic one or cationic one. For instance, usable are compounds as described in JP-A-49-85826, JP-A-49-33630, U.S. Pat. Nos. 2,992,108 and 3,206,312, JP-A-48-87826, JP-B-49-11567, JP-B-49-11568 and JP-A-55-70837.

The most preferred antistatic agent to be in the backing layer comprises fine grains of at least one crystalline metal oxide selected from ZnO, $TiO_2$, $SnO_2$, $Al_2O_3$, $In_2O_3$, $SiO_2$, MgO, BaO, $MoO_3$ and $V_2O_5$ and composite oxides of them.

The fine grains of the conductive crystalline oxides or composite oxides to be usable in the present invention have a volume resistivity of $10^7$ Ωcm or less, more preferably $10^5$ Ωcm or less. The grain size of them is desirably from 0.002 to 0.7 μm, especially preferably from 0.005 to 0.3 μm.

The diameter of the hollow or spool to be in the center of the roll photographic material that is used in the film-integrated camera of the present invention is desired to be smaller. However, if it is less than 3 mm, the photographic properties of the photographic material will be deteriorated too much because of the pressure to be imparted to the photographic material so that the photographic material rolled around such a thin hollow or spool will be of no practical use. Therefore, the diameter of the hollow or spool to be in the center of the roll photographic material for use in the present invention is desirably not less than 3 mm. Its uppermost limit is desirably 12 mm. Preferably, the diameter is from 3 mm to 11 mm, more preferably from 3 mm to 10 mm, especially preferably from 4 mm to 9 mm.

The diameter of the roll photographic material as rolled around a spool is also desired to be smaller. However, if it is less than 5 mm, the photographic properties of the photographic material will be deteriorated too much because of the pressure to be imparted to the photographic material so that the photographic material rolled around such a thin hollow or spool will be of no practical use. Additionally, a long photographic material for many exposures cannot be loaded in the camera. Therefore, the diameter of the roll photographic material as rolled around the spool to be loaded in the camera of the present invention is desirably not less than 5 mm, and its uppermost limit is desirably 15 mm. More preferably, it is from 6 mm to 13.5 mm, further more preferably from 7 mm to 13.5 mm, especially preferably from 7 mm to 13 mm.

The photographic material for use in the present invention is not specifically defined, provided that it has at least one blue-sensitive silver halide emulsion layer, at least one green-sensitive silver halide emulsion layer and at least one red-sensitive silver halide emulsion layer on a support. In the photographic material, the number of the silver halide emulsion layers and light-insensitive layers as well as the order of the layers on the support is not specifically defined. As one typical example, mentioned is a silver halide photographic material having, on the support, at least one light-sensitive layer comprising plural silver halide emulsion layers all having a substantially same color-sensitivity but having different sensitivities, in which the light-sensitive layer is a unit light-sensitive layer that is sensitive to any one of blue light, green light and red light. In a multi-layer silver halide color photographic material, in general, the order of the unit light-sensitive layers to be on the support comprises a red-sensitive layer, a green-sensitive layer and a blue-sensitive layer as formed on the support in this order. As the case may be, however, the order may be opposite to the above-mentioned one, in accordance with the object of the photographic material. As still another embodiment, a light-sensitive layer having different color-sensitivity may be sandwiched between other two light-sensitive layers both having the same color-sensitivity.

Various light-insensitive layers such as interlayer may be provided between the above-mentioned silver halide light-sensitive layers, or as the uppermost layer or lowermost layer.

Such an interlayer may contain various couplers and DIR compounds described in JP-A-61-43748, JP-A-59-113438, JP-A-59-113440, JP-A-61-20037 and JP-A-61-20038, and it may also contain conventional color stain preventing agents.

As the constitution of the plural silver halide emulsion layers of constituting the respective unit light-sensitive layers, preferred is a two-layered constitution composed of a high-sensitivity emulsion layer and a low-sensitivity emulsion layer as described in German Patent 1,121,470 and British Patent 923,045. In general, it is preferred that the plural light-sensitive layers are arranged on the support in such a way that the sensitivity degree of the layer is to gradually decrease in the direction to the support. In the embodiment, a light-insensitive layer may be provided between the plural silver halide emulsion layers. As another embodiment, a low-sensitivity emulsion layer is formed remote from the support and a high-sensitivity emulsion layer is formed near to the support, as so described in JP-A-57-112751, JP-A-62-200350, JP-A-62-206541, and JP-A-62-206543.

As specific examples of the layer constitution on the support, there are mentioned an order of low-sensitivity blue-sensitive layer (BL)/high-sensitivity blue-sensitive layer (BH)/high-sensitivity green-sensitive layer (GH)/low-sensitivity green-sensitive layer (GL)/high-sensitivity red-sensitive layer (RH)/low-sensitivity red-sensitive layer (RL) from the remotest side from the support; and an order of BH/BL/GL/GH/RH/RL; and an order of BH/BL/GH/GL/RL/RH.

As other examples, there are mentioned an order of blue-sensitive layer/GH/RH/GL/RL from the remotest side from the support, as described in JP-B-55-34932; and an order of blue-sensitive layer/GL/RL/GH/RH from the remotest side from the support, as described in JP-A-56-25738 and JP-A-62-63936.

As further example, there is mentioned a three-layer constitution as described in JP-B-49-15495, where the uppermost layer is a highest-sensitivity silver halide emulsion layer, the intermediate layer is a silver halide emulsion layer having a lower sensitivity than the uppermost layer, and the lowermost layer is a silver halide emulsion layer having a further lower sensitivity than the intermediate layer. That is, in the layer constitution of the type, the sensitivity degree of each emulsion layer is gradually lowered to the direction of the support. Even in the three-layer constitution of the type, each of the same color-sensitivity layers may be composed of three layers of middle-sensitivity emulsion layer/high-sensitivity emulsion layer/low-sensitivity emulsion layer as formed in this order from the remotest side from the support, as so described in JP-A-59-202464.

As still other examples of the layer constitution of the photographic material for use in the present invention, there are mentioned an order of high-sensitivity emulsion layer/low-sensitivity emulsion layer/middle-sensitivity emulsion layer, and an order of low-sensitivity emulsion layer/middle-sensitivity emulsion layer/high-sensitivity emulsion layer. Where the photographic material of the invention has four or more layers, the layer constitution thereof may be varied in accordance with the manner mentioned above.

As mentioned above, various layer constitutions and arrangements may be selected in accordance with the object of the photographic material for use in the present invention.

The silver halide grains to be in the photographic emulsion of constituting the photographic material for use in the present invention may be regular crystalline ones such as cubic, octahedral or tetradecahedral grains, or irregular crystalline ones such as spherical or tabular grains, or irregular crystalline ones having a crystal defect such as a twin plane, or composite crystalline ones composed of the above-mentioned regular and irregular crystalline forms.

Regarding the grain size of the silver halide grains, the grains may be fine grains having a small grain size of about 0.2 micron or less or may be large ones having a large grain size of up to about 10 microns as the diameter of the projected area. The emulsion of the grains may be either a polydisperse emulsion or a monodisperse emulsion.

The silver halide photographic emulsions to be used in the present invention may be prepared by various methods, for example, those described in Research Disclosure (RD) No. 17643 (December, 1978), pages 22 to 23 (I. Emulsion Preparation and Types); RD No. 18716 (November, 1979), pages 648; RD No. 307105 (November, 1989), pages 863 to 865; P. Glafkides, *Chimie et Physique Photographique* (published by Paul Montel, (1967)); G. F. Duffin, *Photographic Emulsion Chemistry* (published by Focal Press, (1966)); and V. L. Zelikman et al, *Making and Coating Photographic Emulsion* (published by Focal Press, (1964)).

Monodisperse emulsions as described in U.S. Pat. Nos. 3,574,628 and 3,655,394 and British Patent 1,413,748 are also preferably used in the present invention.

Additionally, tabular grains having an aspect ratio of about 3 or more may also be used in the present invention. Such tabular grains may easily be prepared in accordance with various methods, for example, as described in Gutoff, *Photographic Science and Engineering,* Vol. 14, pages 248 to 257 (1970); and U.S. Pat. Nos. 4,434,226, 4,414,310, 4,433,048 and 4,439,520 and British Patent 2,112,157.

Regarding the crystal structure of the silver halide grains of constituting the emulsions for use in the present invention, the grains may have the same halogen composition throughout the whole grain, or they may have different halogen compositions between the inside part and the outside part of one grain, or they may have a layered structure. Further, the grains may have different halogen compositions as conjugated by epitaxial bond, or they may have other components than silver halides, such as silver rhodanide or lead oxide, as conjugated with the silver halide matrix. Additionally, a mixture of various grains of different crystalline forms may be employed in the present invention.

The above-mentioned emulsions for use in the present invention may be either surface latent image type ones of forming latent images essentially on the surfaces of the grains or internal latent image type ones of forming latent images essentially in the insides of them, or may also be surface/inside latent image type ones of forming a latent images both on the surfaces of the grains and in the insides of them. Anyhow, the emulsions are needed to be negative emulsions. As internal latent image type emulsions, they may be internal latent image type core/-shell emulsions as described in JP-A-63-264740. A method of preparing such internal latent image type core/shell emulsions is described in JP-A-59-133542. The thickness of the shell of the emulsion grains of the type varies, depending upon the way of developing them, and is preferably from 3 to 40 nm, especially preferably from 5 to 20 nm.

The emulsions for use in the present invention are generally physically ripened, chemically ripened and/or color-sensitized. Additives to be used in such a ripening or sensitizing step are described in RD Nos. 17643, 18716 and 307105, and the related descriptions in these references are shown in the table mentioned below.

In the photographic material for use in the present invention, two or more emulsions which are different from one another in at least one characteristic of light-sensitive silver halide grains of constituting them, which is selected from the grain size, the grain size distribution, the halogen composition, the shape and the sensitivity of the grains, can be incorporated into one and the same layer.

Surface-fogged silver halide grains as described in U.S. Pat. No. 4,082,553; inside-fogged silver halide grains as described in U.S. Pat. No. 4,626,498 and JP-A-59-214852; as well as colloidal silver may preferably be used into light-sensitive silver halide emulsion layers and/or substantially light-insensitive hydrophilic colloid layers of constituting the photographic material for use in the present invention. Inside-fogged or surface-fogged silver halide grains are such grains that can be non-imagewise uniformly developed irrespective of the non-exposed area and the exposed area of the photographic material. A method of preparing such inside-fogged or surface-fogged silver halide grains is described in U.S. Pat. No. 4,626,498 and JP-A-59-214852.

The silver halide of forming the inside nucleus of an inside-fogged core/shell type silver halide grain may be either one having the same halogen composition or one having a different halogen composition. The inside-fogged or surface-fogged silver halide may be any of silver chloride, silver chlorobromide, silver iodobromide or silver chloroiodobromide. The grain size of such a fogged silver halide grain is not specifically defined, and it is preferably from 0.01 to 0.75 μm, especially preferably from 0.05 to 0.6 μm, as an average grain size. The shape of the grain is not also specifically defined, and it may be either a regular grain or an irregular grain. The emulsion containing such fogged grains may be either a monodisperse one or a polydisperse one. Preferred is a monodisperse one, in which at least 95% by weight or by number of all the silver halide grains therein have a grain size to fall within the range of the average grain size ±40%.

The photographic material for use in the present invention preferably contain light-insensitive fine silver halide grains. Light-insensitive fine silver halide grains are meant to be fine silver halide grains which are not sensitive to the light as imparted to the photographic material for imagewise exposure thereof for the purpose of obtaining a dye image and are substantially not developed in the step of development of the exposed material. These fine grains are desired not previously fogged.

The fine silver halide grains have a silver bromide content of from 0 to 100 mol % and, if desired, they may additionally contain silver chloride and/or silver iodide. Preferably,-they contain silver iodide in an amount of from 0.5 to 10 mol %.

The fine silver halide grains are desired to have an average grain size (as an average value of the circle-corresponding diameter of the projected area) of from 0.01 to 0.5 μm, more preferably from 0.02 to 0.2 μm.

The fine silver halide grains may be prepared by the same method as that of preparing ordinary light-sensitive silver halide grains. In the case, the surfaces of the fine silver halide grains to be prepared do not need to be chemically sensitized and color sensitization of the grains is unnecessary. However, prior to addition of the fine grains to the coating composition, it is desired to previously add a known stabilizer, such as triazole compounds, azaindene compounds, benzothiazolium compounds or, mercapto compound or zinc compounds, to the coating composition. The fine silver halide grains-containing layer may preferably contain colloidal silver.

The amount of silver as coated in the photographic material for use in the present invention is preferably 9.0 $g/m^2$ or less, most preferably 8.0 $g/m^2$ or less.

Various known photographic additives which may be used in preparing the photographic materials for use in the present invention are mentioned in the above-mentioned three RD's, and the related descriptions therein are shown in the following table.

| Kinds of Additives | RD 17643 | RD 18716 | RD 307105 |
|---|---|---|---|
| 1 Chemical Sensitizer | page 23 | page 648, right column | page 866 |
| 2 Sensitivity Enhancer | | page 648, right column | |
| 3 Color Sensitizing Agent | pages 23 to 24 | page 648, right column to page 649, right column | pages 866 to 868 |
| Supersensitizing Agent | pages 23 to 24 | page 648, right column to page 649, right column | pages 866 to 868 |
| 4 Brightening Agent | page 24 | page 647, right column | page 868 |
| 5 Anti-foggant | pages 24 to 25 | page 649, right column | pages 868 to 870 |
| Stabilizer | pages 24 to 25 | page 649, right column | pages 868 to 870 |
| 6. Light Absorbent | pages 25 to 26 | page 649, right column to page 650, left column | page 873 |
| Filter Dye | pages 25 to 26 | page 649, right column to page 650, left column | page 873 |
| Ultraviolet Absorbent | pages 25 to 26 | page 649, right column to page 650, left column | page 873 |
| 7 Stain Inhibitor | page 25, right column | page 650, left column to right column | page 872 |
| 8 Dye Image Stabilizer | page 25 | page 650, left column | page 872 |
| 9 Hardening Agent | page 26 | page 651, left column | pages 874 to 875 |
| 10 Binder | page 26 | page 651, left column | pages 873 to 874 |
| 11 Plasticizer | page 27 | page 650, right column | page 876 |
| Lubricant | page 27 | page 650, right column | page 876 |
| 12 Coating Aid | pages 26 to 27 | page 650, right column | pages 875 to 076 |
| Surfactant | pages 26 to 27 | page 650, right column | pages 875 to 876 |
| 13 Antistatic Agent | page 27 | page 650, right column | pages 876 to 877 |
| 14 Matting Agent | | | pages 878 to 879 |

In order to prevent deterioration of the photographic property of the photographic material for use in the present invention by formaldehyde gas as imparted thereto, compounds capable of reacting with formaldehyde so as to fix it, for example, those described in U.S. Pat. Nos. 4,411,987 and 4,435,503, are preferably incorporated into the photographic material.

It is preferred to incorporate mercapto compounds described in U.S. Pat. Nos. 4,740,454 and 4,788,132 and JP-A-62-18539 and JP-A-1-283551 into the photographic materials for use in the present invention.

It is also preferred to incorporate, into the photographic materials for use in the present invention, compounds capable of releasing a foggant, a development accelerator, a silver halide solvent or a precursor thereof, irrespective of the amount of the developed silver as formed by development, which are described in JP-A-1-106052.

It is also preferred to incorporate, into the photographic materials for use in the present invention, dyes as dispersed by the method described in Published unexamined international application No. WO88/04794 and Published unexamined international application No. 1-502912, or dyes as described in European Patent 317,308A, U.S. Pat. No. 4,420,555 and JP-A-1-259358.

Various color couplers can be incorporated into the photographic material for use in the present invention, and examples of usable color couplers are described in patent publications as referred to in the above-mentioned RD No. 17643, VII-C to G, and RD No. 307105, VII-C to G.

As yellow couplers, for example, those described in U.S. Pat. Nos. 3,933,501, 4,022,620, 4,326,024, 4,401,752 and 4,248,961, JP-B-58-10739, British Patents 1,425,020 and 1,476,760, U.S. Pat. Nos. 3,973,968, 4,314,023 and 4,511,649, and European Patent 249,473A are preferred.

As magenta couplers, 5-pyrazolone compounds and pyrazoloazole compounds are preferred. For instance, those described in U.S. Pat. Nos. 4,310,619 and 4,351,897, European Patent 73,636, U.S. Pat. Nos. 3,061,432 and 3,725,067, RD No. 24220 (June, 1984), JP-A-60-33552, RD No. 24230 (June, 1984), JP-A-60-43659, JP-A-61-72238, JP-A-60-35730, JP-A-55-118034, JP-A-60-185951, U.S. Pat. Nos. 4,500,630, 4,540,654 and 4,556,630, and Published unexamined international application No. W088/04795 are preferably used in the present invention.

As cyan couplers, phenol couplers and naphthol couplers are preferred. For instance, those described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German patent publication (OLS) No. 3,329,729, European Patents 121,365A and 249,453A, U.S. Pat. Nos. 3,446,622, 4,333,999, 4,775,616, 4,451,559, 4,427,767, 4,690,889, 4,254,212 and 4,296,199, and JP-A-61-42658 are preferred. In addition, pyrazoloazole couplers as described in JP-A-64-553, JP-A-64-554, JP-A-64-555 and JP-A-64-556 and imidazole couplers as described in U.S. Pat. No. 4,818,672 are also usable.

Polymerized dye-forming couplers may also be used, and typical examples of such couplers are described in U.S. Pat. Nos. 3,451,820, 4,080,211, 4,367,282, 4,409,320 and 4,576,910, British Patent 2,102,137 and European Patent 341,188A.

Couplers capable of forming a colored dyes having a pertinent diffusibility may also be used, and those described in U.S. Pat. No. 4,366,237, British Patent 2,125,570, European Patent 96,570, and West German patent publication (OLS) No. 3,234,533 are preferred.

Colored couplers of correcting the unnecessary absorption of the colored dyes, such as those described in RD No. 17643, VII-G, RD No. 307105, VII-G, U.S. Pat. No. 4,163,670, JP-B-57-39413, U.S. Pat. Nos. 4,004,929 and 4,138,258, British Patent 1,146,368, are preferably used in the present invention. In particular, yellow-colored cyan couplers of the above-mentioned formulae (CI) to (CIV) are especially preferably used in the present invention. Additionally, couplers of correcting the unnecessary absorption of the colored dyes by the fluorescent dye to be released during coupling, as described in U.S. Pat. No. 4,774,181, as well as couplers having a dye precursor group capable of reacting with a developing agent to form a dye, as a release group, as described in U.S. Pat. No. 4,777,120 are also preferably used.

Couplers capable of releasing a photographically useful residue along with coupling may also be used in the present invention. For instance, as DIR couplers of releasing a development inhibitor, those described in the patent publications as referred to in the above-mentioned RD No. 17643, Item VII-F, RD No. 307105, Item VII-F, as well as those described in JP-A-57-151944, JP-A-57-154234, JP-A-60-184248, JP-A-63-37346 and JP-A-63-37350 and U.S. Pat. Nos. 4,248,962 and 4,782,012 are preferred. In particular, DIR compounds of the above-mentioned formulae (1) and (2) are preferred.

As couplers of imagewise releasing a nucleating agent or development accelerator during development, those described in British Patents 2,097,140 and 2,131,188, and JP-A-59-157638 and JP-A-59-170840 are preferred. In addition, compounds of releasing a foggant, a development accelerator or a silver halide solvent by redox reaction with an oxidation product of a developing agent, as described in JP-A-60-107029, JP-A-60-252340, JP-A-1-44940 and JP-A-1-45687, are also preferably used.

Additionally, as examples of compounds which may be incorporated into the photographic materials for use in the present invention, there are further mentioned competing couplers described in U.S. Pat. No. 4,130,427; poly-valent couplers described in U.S. Pat. Nos. 4,238,472, 4,338,393 and 4,310,618; DIR redox compound-releasing couplers, DIR coupler-releasing couplers, DIR coupler-releasing redox compounds and DIR redox-releasing redox compounds described in JP-A-60-185950 and JP-A-62-24252; couplers of releasing a dye which recolors after released from the coupler, as described in European Patents 173,302A and 313,308A; bleaching accelerator-releasing couplers, as described in RD No. 11449, RD No. 24241 and JP-A-61-201247; ligand-releasing couplers described in U.S. Pat. No. 4,555,477; leuco dye-releasing couplers described in JP-A-63-75747; and couplers of releasing a fluorescent dye as described in U.S. Pat. No. 4,774,181.

The above-mentioned couplers can be incorporated into the photographic materials for use in the present invention by various known dispersion methods.

For instance, an oil-in-water dispersion method may be employed for the purpose. Examples of high boiling point solvents usable in the method are described in U.S. Pat. No. 2,322,027. As examples of high boiling point organic solvents having a boiling point of 175° C. or higher at normal pressure, which are used in an oil-in-water dispersion, there are mentioned phthalates (e.g., dibutyl phthalate, dicyclohexyl phthalate, di-2-ethylhexyl phthalate, decyl phthalate, bis(2,4-di-t-amylphenyl) phthalate, bis(2,4-di-t-amylphenyl) isophthalate, bis(1,1-diethylpropyl) phthalate, phosphates or phosphonates (e.g., triphenyl phosphate, tricresyl phosphate, 2-ethylhexyl diphenylphosphate, tricyclohexyl phosphate, tri-2-ethylhexyl phosphate, tridocyl phosphate, tributoxyethyl phosphate, trichloropropyl phosphate, di-2-ethylhexylphenyl phosphonate), benzoates (e.g., 2-ethylhexyl benzoate, dodecyl benzoate, 2-ethylhexyl p-hydroxybenzoate), amides (e.g., N,N-diethyldodecanamide, N,N-diethyllaurylamide, N-tetradecylpyrrolidone), alcohols or phenols (e.g., isostearyl alcohol, 2,4-di-tert-amylphenol), aliphatic carboxylates (e.g., bis(2-ethylhexyl) sebacate, dioctyl azelate, glycerol tributylate, isostearyl lactate, trioctyl citrate), aniline derivatives (e.g.,- N,N-dibutyl-2-butoxy-5-tert-octylaniline), hydrocarbons (e.g., paraffin, dodecylbenzene, diisopropylnaphthalene). As an auxiliary solvent, organic solvents having a boiling point of approximately 30° C. or higher, preferably from 50° to 160° C. can be used. As examples of such auxiliary organic solvents, there are mentioned ethyl acetate, butyl acetate, ethyl propionate, methyl ethyl ketone, cyclohexanone 2-ethoxyethyl acetate and dimethylformamide.

A latex dispersion method may also be employed for incorporating couplers into the photographic material for use in the present invention. The steps of carrying out the dispersion method, the effect of the method and examples of latexes usable in the method for impregnation are described in U.S. Pat. No. 4,199,363, West German patent publication (OLS) Nos. 2,541,174 and 2,541,230.

The color photographic material for use in the present invention preferably contains an antiseptic or fungicide of various kinds, for example, selected from phenethyl alcohol and those described in JP-A-63-257747, JP-A-62-272248 and JP-A-1-80941, such as 1,2-benzisothiazolin-3-one, n-butyl p-hydroxybenzoate, phenol, 4-chloro-3,5-dimethylphenol, 2-phenoxyethanol or 2-(4-thiazolyl)benzimidazole.

The present invention may apply to various color photographic materials. For instance, there are mentioned, as typical examples, color negative films for general use or for movie use, color reversal films for slide use or for television use, as well as color papers, color positive films and color reversal papers.

Suitable supports which are usable in the present invention are described in, for example, the above-mentioned RD No. 17643, page 28, RD No. 18716, from page 647, right column to page 648, left column, and RD No. 307105, page 879. However, the above-mentioned polyester supports are especially preferably used in the present invention.

It is desired that the total film thickness of all the hydrophilic colloid layers as provided on the surface of the support of having emulsion layers is 28 microns or less, preferably 23 microns or less, more preferably 18 microns or less, especially preferably 16 microns or less, in the photographic material for use in the present invention. It is also desired that the photographic material for use in the invention has a film swelling rate ($T_{\frac{1}{2}}$) of 30 seconds or less, preferably 20 seconds or less. The film thickness as referred to herein is one as measured under the controlled condition of a temperature of 25° C. and a relative humidity of 55% (for 2 days); and the film swelling rate as referred to herein may be measured by any means known in this technical field. For instance, it may be measured by the use of a swellometer of the model as described in A. Green et al., Photographic Science Engineering, Vol. 19, No. 2, pages 124 to 129. The film swelling rate ($T\frac{1}{2}$) is defined as follows: 90% of the maximum swollen thickness of the photographic material as processed in a color developer under the condition of 30° C. and 3 minutes and 15 seconds is called a saturated swollen thickness. The time necessary for attaining a half ($\frac{1}{2}$) of the saturated swollen thickness is defined to be a film swelling rate ($T\frac{1}{2}$).

The film swelling rate ($T\frac{1}{2}$) can be adjusted by adding a hardening agent to gelatin of a binder or by varying the condition of storing the coated photographic material. Additionally, the photographic material for use in the present invention is desired to have a swelling degree of from 150 to 400%. The swelling degree as referred to herein is calculated from the maximum swollen film thickness as obtained under the above-mentioned condition, on the basis of a formula of:

(maximum swollen film thickness—original film thickness)/(original film thickness).

The color photographic material according to the present invention can be subjected to development in accordance with an ordinary-method as described in RD No. 17643, pages 28 to 29, RD No. 18716, page 651, left column to right column and RD No. 307105, pages 880 to 881.

The color developer to be used for development of the photographic material for use in the present invention is preferably an aqueous alkaline solution consisting essentially of an aromatic primary amine color-developing agent. As the color-developing agent, p-phenylenediamine compounds are preferably used, though aminophenol compounds are also useful. Specific examples of p-phenylenediamine compounds usable as the color-developing agent include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-β-methoxyethylaniline, as well as sulfates, hydrochlorides and p-toluenesulfonates of the compounds. Above all, especially preferred is 3-methyl-4-amino-N-ethyl-N-β-hydroxyethylaniline sulfate. These compounds can be used in combination of two or more of them, in accordance with the object.

The color developer generally contains a pH buffer such as alkali metal carbonates, borates or phosphates, and a development inhibitor or anti-foggant such as chlorides, bromides, iodides, benzimidazoles, benzothiazoles or mercapto compounds. If desired, it may also contain various preservatives such as hydroxylamine, diethylhydroxylamine, sulfites, hydrazines such as N,N-biscarboxymethylhydrazine, phenylsemicarbazides, triethanolamine, catechol-sulfonic acids; an organic solvent such as ethylene glycol, and diethylene glycol; a development accelerator such as benzyl alcohol, polyethylene glycol, quaternary ammonium salts, and amines; a dye-forming coupler; a competing coupler; an auxiliary developing agent such as 1-phenyl-3-pyrazolidone; a tackifier; as well as various chelating agents such as aminopolycarboxylic acids, aminopolyphosphonic acids, alkylphosphonic acids, and phosphonocarboxylic acids. As specific examples of chelating agents which may be incorporated into the color developer, there are mentioned ethylenediaminetetraacetic acid, nitrilotriacetic acid, diethylenetriaminepentaacetic acid, cyclohexanediaminetetraacetic acid, hydroxylethyliminodiacetic acid, 1-hydroxyethylidene-1,1-diphosphonic acid, nitrilo-N,N,N-trimethylenephosphonic acid, ethylenediamine-N,N,N,N-tetramethylenephosphonic acid, ethylenediaminedi(o-hydroxyphenylacetic acid) and their salts.

Where the photographic material is processed for reversal finish, in general, it is first subjected to black-and-white development-and then subjected to color development. For the first black-and-white development is used a black-and-white developer, which contains a conventional black-and-white developing agent, for example, dihydroxybenzenes such as hydroquinone, 3-pyraozlidones such as 1-phenyl-3-pyraozlidone, or aminophenols such as N-methyl-p-aminophenol, singly or in combination of them. The color developer and the black-and-white developer generally has a pH value of from 9 to 12. The amount of the replenisher to the developer is, though depending upon the the color photographic material to be processed, generally 3 liters or less per $m^2$ of the material to be processed. It may be reduced to 500 ml or less per $m^2$ of the photographic material to be processed, by lowering the bromide ion concentration in the replenisher. Where the amount of the replenisher is reduced, it is preferred to reduce the contact area of the surface of the processing solution in the processing tank with air so as to prevent vaporization and aerial oxidation of the solution.

The contact surface area of the processing solution with air in the processing tank is represented by the opening ratio which is defined by the following formula:

Opening Ratio = (Contact Surface Area ($cm^2$) of Processing Solution with Air)/(Volume ($cm^3$) of Processing Tank)

The above-mentioned opening ratio is preferably 0.1 or less, more preferably from 0.001 to 0.05. Various means can be employed for the purpose of reducing the opening ratio, which include, for example, provision of a masking substance such as a floating lid on the surface of the processing solution in the processing tank, employment of the mobile lid as described in JP-A-1-82033 and employment of the slit-developing method as described in JP-A-63-216050. Reduction of the opening ratio is preferably applied to not only the both steps of color development and black-and-white development but also all the subsequent steps such as bleaching, bleach-fixation, fixation, washing and stabilization steps. In addition, the amount of the replenisher to be added may also be reduced by means of suppressing accumulation of bromide ions in the developer.

The time for color development is generally within the range of from 2 minutes to 5 minutes, but the processing time may be shortened by elevating the processing temperature, elevating the pH value of the processing solution and elevating the concentration of the color developing agent in the processing solution.

After color developed, the photographic emulsion layer is generally bleached. Bleaching may be effected simultaneously with fixation (bleach-fixation) or separately therefrom. In order to accelerate the processing speed, a system of bleaching followed by bleach-fixation may also be employed. If desired, a system of using a bleach-fixing bath of continuous two tanks, a system of fixation followed by bleach-fixation, or a system of bleach-fixation followed by bleaching may also be employed, in accordance with the object. As the bleaching agent can be used, for example, compounds of polyvalent metals such as iron(III), as well as peracids, quinones and nitro compounds. Specific examples of the bleaching agent usable in the present invention include organic complexes of iron(III), such as complexes thereof with aminopolycarboxylic acids such as ethylenediaminetetraacetic acid, diethylenetriaminepentaacetic acid, cyclohexanediaminetetraacetic acid, methyliminodiacetic acid, 1,3-diaminopropanetetraacetic acid or glycol ether-diaminetetraacetic acid or with organic acids such as citric acid, tartaric acid or malic acid. Among them, aminopolycarboxylato/iron(III) complexes such as ethylenediaminetetraacetato/iron(III) complex and 1,3-diaminopropanetetraacetato/iron(III) complex are preferred in view of the rapid processability thereof and of prevention of environmental pollution. The aminopolycarboxylato/iron(III) complexes are especially useful both in a bleaching solution and in a bleach-fixing solution. The bleaching solution or bleach-fixing solution containing such aminopolycarboxylato/iron(III) complexes generally has a pH value of from 4.0 to 8.0, but the solution may have a lower pH value for rapid processing.

The bleaching solution, the bleach-fixing solution and the previous bath may contain a bleaching accelerator, if desired. Various bleaching accelerators are known, and examples thereof which are advantageously used in the present invention include mercapto group- or disulfide group-containing compounds described in U.S. Pat. No. 3,893,858, West German Patents 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623 and JP-A-53-28426, RD Mo. 17129 (July, 1978); thiazolidine derivatives as described in JP-A-50-140129; thiourea derivatives as described in JP-B-45-8506, JP-A-52-20832 and JP-A-53-32735 and U.S. Pat. No. 3,706,561; iodide salts as described in West German Patent 1,127,715 and JP-A-58-16235; polyoxyethylene compounds as described in West German Patents 966,410 and 2,748,430; polyamine compounds as described in JP-B-45-8836; other compounds as described in JP-A-49-40943, JP-A-49-59644, JP-A-53-94927, JP-A-54-35727, JP-A-55-26506 and JP-A-58-163940; and bromide ions. Above all, mercapto group- or disulfide group-containing compounds, in particular, those as described in U.S. Pat. No. 3,893,858, West German Patent 1,290,812 and JP-A-53-95630 are preferred, as having a large accelerating effect. In addition, compounds described in U.S. Pat. No. 4,552,834 are also preferred. These bleaching accelerators may be incorporated into the photographic material for use in the present invention. Where the photographic material for use in the present invention is a picture-taking color photographic material and it is bleach-fixed, these bleaching accelerators are especially effective.

The bleaching solution and bleach-fixing solution may further contain, in addition to the above-mentioned components, various organic acids for the purpose of preventing bleaching stains. Especially preferred organic acids for the purpose are those having an acid dissociating constant (pKa) of from 2 to 5. For instance, acetic acid, propionic acid and hydroxyacetic acid are preferably used.

As the fixing agent in the fixing solution or bleach-fixing solution to be applied to the photographic material for use in the present invention, usable are thiosulfates, thiocyanates, thioether compounds, thioureas, and a large amount of iodide salts. Use of thiosulfates is general for the purpose. Above all, ammonium thiosulfate is most widely used. Additionally, combination of thiosulfates and thiocyanates, thioether compounds or thioureas is also preferred. As the preservative to be in the fixing solution or bleach-fixing solution, preferred are sulfites, bisulfites and carbonylbisulfite adducts, as well as sulfinic acid compounds as described in European Patent 294769A. Further, the fixing solution or bleach-fixing solution may preferably contain various aminopolycarboxylic acids or organic phosphonic acids for the purpose of stabilizing the solution.

It is preferred that the fixing solution or bleach-fixing solution to be used for processing the photographic material for use in the present invention contains compounds having a pKa value of from 6.0 to 9.0, for the purpose of adjusting the pH value of the solution. As such compounds, preferably added are imidazoles such as imidazole, 1-methylimidazole, 1-ethylimidaozle or 2-methylimidazole, in an amount of from 0.1 to 10 mol/liter.

The total time for the desilvering process is preferably shorter within the range of not causing desilvering insufficiency. For instance, the time is preferably from 1 minute to 3 minutes, more preferably from 1 minute to 2 minutes. The processing temperature may be from 25° C. to 50° C., preferably from 35° C. to 45° C. In such a preferred temperature range, the desilvering speed is accelerated and generation of stains in the processed material may effectively be prevented.

In the desilvering process, it is desired that stirring of the processing solution during the process is promoted as much as possible. As examples of reinforced stirring means for forcedly stirring the photographic material during the desilvering step, there are mentioned a method of running a jet stream of the processing solution to the emulsion-coated surface of the photographic material, as described in JP-A-62-183460; a method of promoting the stirring effect by the use of a rotating means, as described in JP-A-62-183461; a method of moving the photographic material being processed in the processing bath while the emulsion-coated surface of the photographic material is brought into contact with a wiper blade as provided in the processing bath, whereby the processing solution as applied to the emulsion-coated surface of the photographic material is made turbulent and the stirring effect is promoted; and a method of increasing the total circulating amount of the processing solution. Such reinforced stirring means are effective to any of the bleaching solution, bleach-fixing solution and fixing solution. It is considered that reinforcement of stirring of the processing solution would promote penetration of the bleaching agent and fixing agent into the emulsion layer of the photographic material being processed and, as a result, the desilvering rate in processing the photographic material would be elevated. The above-mentioned reinforced stirring means is more effective, when a bleaching accelerator is incorporated into the processing solution. Because of the means, therefore, the bleaching accelerating effect could remarkably be augmented, and the fixation preventing effect by the bleaching accelerator could be evaded.

The photographic material for use in the present invention can be processed with an automatic developing machine. It is desired that the automatic developing machine to be used for processing the photographic material for use in the present invention is equipped with a photographic material-conveying means as described in JP-A-60-191257, JP-A-60-191258 and JP-A-60-191259. As is noted from the related disclosure of JP-A-60-191257, the conveying means may noticeably reduce the carry-over amount from the previous bath to the subsequent bath and therefore it is extremely effective for preventing deterioration of the processing solution being used. Because of the reasons, the conveying means is especially effective for shortening the processing time in each processing step and for reducing the amount of the replenisher to each processing bath.

The silver halide color photographic material for use in the present invention is generally washed in water and/or stabilized, after being desilvered. The amount of the water to be used in the washing step can be set in a broad range, in accordance with the characteristic of the photographic material being processed (for example, depending upon the raw material components, such as the coupler and so on) or the use of the photographic material, as well as the temperature of the washing water, the number of the washing tanks (the number of the washing stages), the replenishment system of concurrent or countercurrent and other various kinds of conditions. Among these conditions, the relation between the number of the washing tanks and the amount of the washing water in a multi-stage countercurrent washing system can be obtained by the method described in *Journal of the Society of Motion Picture and Television Engineers,* Vol. 64, pages 248 to 253 (May, 1955).

According to the multi-stage countercurrent system described in the above-mentioned reference, the amount of the washing water to be used can be reduced noticeably, but because of the prolongation of the residence time of the water in the washing tank, bacteria would propagate in the tank so that the floating substances generated by the propagation of bacteria would adhere to the surface of the photographic material as it was processed. Accordingly, the above system would often have a problem. In the practice of processing the photographic material for use in the present invention, the method of reducing calcium and magnesium ions, which is described in JP-A-62-288838, can extremely effectively be used for overcoming this problem. In addition, isothiazolone compounds and thiabendazoles described in JP-A-57-8542; chlorine-containing bactericides such as chlorinated sodium isocyanurates; and benzotriazoles and other bactericides described in H. Horiguchi, *Chemistry of Bactericidal and Fungicidal Agents,* (1986), by Sankyo Publishing Co., Japan, *Bactericidal and Fungicidal Techniques to Microorganisms,* edited by Association of Sanitary Technique, Japan, (1982), by Kogyo Gijutsu-kai, Japan, and *Encyclopeadia of Bactericidal and Fungicidal Agents,* edited by Nippon Bactericide and Fungicide Association, Japan, (1986), can also be used.

The pH value of the washing water to be used for processing the photographic material for use in the present invention is from 4 to 9, preferably from 5 to 8. The temperature of the washing water and the washing time can also be set variously in accordance with the characteristics of the photographic material being processed as well as the use thereof, and in general, the temperature is from 15° to 45° C. and the time is from 20 seconds to 10 minutes, and preferably the temperature is from 25° to 40° C. and the time is from 30 seconds to 5 minutes. Alternatively, the photographic material for use in the present invention may also be processed directly with a stabilizing solution in place of being washed with water. For the stabilization, any known methods, for example, as described in JP-A-57-8543, JP-A-58-14834 and JP-A-60-220345, can be employed.

In addition, the photographic material can also be stabilized, following the washing step. As one example of the case, there may be mentioned a stabilizing bath containing a dye stabilizer and a surfactant, which is used as a final bath for picture-taking color photographic materials. As examples of dye stabilizers usable for the purpose, there are mentioned aldehydes such as formalin and glutaraldehyde, N-methylol compounds, hexamethylenetetramine and aldehyde-sulfite adducts. The stabilizing bath may also contain various chelating agents and fungicides.

The overflow from the washing and/or stabilizing solutions because of addition of replenishers thereto may be re-used in the other steps such as the previous desilvering step.

Where the photographic material for use in the present invention is processed with an automatic developing machine system and the processing solutions as being used in the step are evaporated and thickened, it is desired to add water to the solutions so as to correct the concentration of the solutions.

The silver halide color photographic material for use in the present invention can contain a color developing agent for the purpose of simplifying and accelerating the processing of the photographic material. For incorporation of a color developing agent into the photographic material, various precursors of the agent are preferably used. For example, there are mentioned indoaniline compounds as described in U.S. Pat. No. 3,342,597, Schiff base compounds as described in U.S. Pat. No. 3,342,599 and RD Nos. 14850 and 15159, aldole compounds as described in RD No. 13924, metal complexes as described in U.S. Pat. No. 3,719,492 and urethane compounds as described in JP-A-53-135628, as the precursors.

The silver halide color photographic material for use in the present invention can contain various kinds of 1-phenyl-3-pyrazolidones, if desired, for the purpose of accelerating the color developability thereof. Specific examples of these compounds are described in JP-A-56-64339, JP-A-57-144547 and JP-A-58-115438.

The processing solutions for the photographic material for use in the present invention are used at 10° C. to 50° C. In general, a processing temperature of from 33° C. to 38° C. is standard, but the temperature may be made higher so as to accelerate the processing or to shorten the processing time, or on the contrary, the temperature may be made lower so as to improve the quality of images formed and to improve the stability of the processing solutions used.

Next, the present invention will be explained in more detail by means of the following examples, which, however, are not intended to restrict the scope of the present invention.

EXAMPLE 1

Plural layers each having the composition mentioned below were coated on a subbing layer-coated cellulose triacetate film support, to prepare a multilayer color photographic material (Sample 101).

Compositions of Light-sensitive Layers:

Essential components of constituting the light-sensitive layers are grouped as follows:

ExC: Cyan Coupler
ExM: Magenta Coupler
ExY Yellow Coupler
ExS: Sensitizing Dye

UV: Ultraviolet Absorbent

HBS: High Boiling Point Organic Solvent

H: Gelatin Hardening Agent

The number for each component indicates the amount coated by way of a unit of g/m$^2$. The amount of silver halide coated is represented as the amount of silver therein coated. The amount of sensitizing dye coated is represented by way of a molar unit to mol of silver halide in the same layer.

Formation of Sample 101:

| | |
|---|---|
| First Layer: Anti-halation Layer | |
| Black Colloidal Silver | 0.18 as Ag |
| Gelatin | 1.60 |
| ExM-1 | 0.11 |
| ExF-1 | $3.4 \times 10^{-3}$ |
| HBS-1 | 0.16 |
| Second Layer: Interlayer | |
| ExC-2 | 0.055 |
| UV-1 | 0.011 |
| UV-2 | 0.030 |
| UV-3 | 0.053 |
| HBS-1 | 0.05 |
| HBS-2 | 0.020 |
| Polyethylene Acrylate Latex | $8.1 \times 10^{-2}$ |
| Gelatin | 0.75 |
| Third Layer: | |
| Low-sensitivity Red-sensitive Emulsion Layer | |
| Emulsion A | 0.46 as Ag |
| ExS-1 | $5.0 \times 10^{-4}$ |
| ExS-2 | $1.8 \times 10^{-5}$ |
| ExS-3 | $5.0 \times 10^{-4}$ |
| ExC-1 | 0.11 |
| ExC-3 | 0.045 |
| ExC-4 | 0.07 |
| ExC-5 | 0.0050 |
| ExC-7 | 0.001 |
| ExC-8 | 0.010 |
| Cpd-2 | 0.005 |
| HBS-1 | 0.090 |
| Gelatin | 0.87 |
| Fourth Layer: | |
| Middle-sensitivity Red-sensitive Emulsion Layer | |
| Emulsion D | 0.70 as Ag |
| ExS-1 | $3.0 \times 10^{-4}$ |
| EXS-2 | $1.2 \times 10^{-5}$ |
| ExS-3 | $4.0 \times 10^{-4}$ |
| ExC-1 | 0.13 |
| ExC-2 | 0.055 |
| ExC-4 | 0.085 |
| ExC-5 | 0.007 |
| ExC-8 | 0.009 |
| Cpd-2 | 0.036 |
| HBS-1 | 0.11 |
| Gelatin | 0.70 |
| Fifth Layer: | |
| High-sensitivity Red-sensitive Emulsion Layer | |
| Emulsion E | 1.62 as Ag |
| ExS-1 | $2.0 \times 10^{-4}$ |
| ExS-2 | $1.0 \times 10^{-5}$ |
| ExS-3 | $3.0 \times 10^{-4}$ |
| ExC-1 | 0.125 |
| ExC-3 | 0.040 |
| ExC-6 | 0.010 |
| ExC-8 | 0.014 |
| Cpd-2 | 0.050 |
| HBS-1 | 0.22 |
| HBS-2 | 0.10 |
| Gelatin | 1.60 |
| Sixth Layer: Interlayer | |
| Cpd-1 | 0.07 |
| HBS-1 | 0.04 |
| Polyethylene Acrylate Latex | 0.19 |
| Gelatin | 1.30 |
| Seventh Layer: | |
| Low-sensitivity Green-sensitive Emulsion Layer | |
| Emulsion A | 0.24 as Ag |
| Emulsion B | 0.10 as Ag |

-continued

| | |
|---|---|
| Emulsion C | 0.14 as Ag |
| ExS-4 | $4.0 \times 10^{-5}$ |
| ExS-5 | $1.8 \times 10^{-4}$ |
| ExC-6 | $6.5 \times 10^{-4}$ |
| ExM-1 | 0.005 |
| ExM-2 | 0.30 |
| ExM-3 | 0.09 |
| ExY-1 | 0.015 |
| HBS-1 | 0.26 |
| HBS-3 | 0.006 |
| Gelatin | 0.80 |
| Eighth Layer: | |
| Middle-sensitivity Green-sensitive Emulsion Layer | |
| Emulsion D | 0.94 as Ag |
| ExS-4 | $2.0 \times 10^{-5}$ |
| ExS-5 | $1.4 \times 10^{-4}$ |
| ExS-6 | $5.4 \times 10^{-4}$ |
| ExM-2 | 0.16 |
| ExM-3 | 0.045 |
| ExY-1 | 0.008 |
| ExY-5 | 0.030 |
| HBS-1 | 0.14 |
| HBS-3 | $8.0 \times 10^{-3}$ |
| Gelatin | 0.90 |
| Ninth Layer: | |
| High-sensitivity Green-sensitive Emulsion Layer | |
| Emulsion E | 1.29 as Ag |
| ExS-4 | $3.7 \times 10^{-5}$ |
| ExS-5 | $8.1 \times 10^{-5}$ |
| ExS-6 | $3.2 \times 10^{-4}$ |
| ExC-1 | 0.011 |
| ExM-1 | 0.016 |
| ExM-4 | 0.046 |
| ExM-5 | 0.023 |
| Cpd-3 | 0.050 |
| HBS-1 | 0.20 |
| HBS-2 | 0.08 |
| Polyethyl Acrylate Latex | 0.26 |
| Gelatin | 1.57 |
| Tenth Layer: Yellow Filter-Layer | |
| Yellow Colloidal Silver | 0.010 as Ag |
| Cpd-1 | 0.10 |
| HBS-1 | 0.055 |
| Gelatin | 0.70 |
| Eleventh Layer: | |
| Low-sensitivity Blue-sensitive Emulsion Layer | |
| Emulsion A | 0.25 as Ag |
| Emulsion C | 0.25 as Ag |
| Emulsion D | 0.10 as Ag |
| ExS-7 | $8.0 \times 10^{-4}$ |
| ExY-1 | 0.010 |
| ExY-2 | 0.70 |
| ExY-3 | 0.055 |
| ExY-4 | 0.006 |
| ExY-6 | 0.075 |
| ExC-7 | 0.040 |
| HBS-1 | 0.25 |
| Gelatin | 1.60 |
| Twelfth Layer: | |
| High-sensitivity Blue-sensitive Emulsion Layer | |
| Emulsion F | 1.30 as Ag |
| ExS-7 | $3.0 \times 10^{-4}$ |
| ExY-2 | 0.15 |
| ExY-3 | 0.06 |
| HBS-1 | 0.070 |
| Gelatin | 1.13 |
| Thirteenth Layer: First Protective Layer | |
| UV-2 | 0.08 |
| UV-3 | 0.11 |
| UV-4 | 0.26 |
| HBS-1 | 0.09 |
| Gelatin | 2.40 |
| Fourteenth Layer: Second Protective Layer | |
| Emulsion G | 0.10 as Ag |
| H-1 | 0.37 |
| B-1 (diameter 1.7 μm) | $5.0 \times 10^{-2}$ |
| B-2 (diameter 1.7 μm) | 0.10 |
| B-3 | 0.10 |
| S-1 | 0.20 |

-continued

| | |
|---|---|
| Gelatin | 0.75 |

In addition, the respective layers contained any of W-1 through W-3, B-4 through B-6, F-1 through F-17, and iron salt, lead salt, gold salt, platinum salt, iridium salt, palladium salt and rhodium salt, so as to have improved storability, processability, pressure resistance, fungicidal and bactericidal property, antistatic property and coatability.

Structural formulae of the compounds used as well as the the emulsions used are shown below.

TABLE A

| | Average AgI Content (%) | Average Grain Size (μm) | Fluctuation Coefficient to Grain Size (%) | Ratio of Diameter/-Thickness | Ratio of Silver Contents [core/interlayer/shell] (as AgI content %) | Structure and Shape of Grains |
|---|---|---|---|---|---|---|
| Emulsion A | 2.0 | 0.55 | 25 | 7 | — | uniform structural tabular grains |
| Emulsion B | 9.0 | 0.63 | 25 | 6 | [12/59/29] (0/11/8) | three-layer structural tabular grains |
| Emulsion C | 3.0 | 0.60 | 25 | 7 | [10/60/30] (0/1/8) | three-layer structural tabular grains |
| Emulsion D | 4.1 | 0.80 | 18 | 6 | [14/56/30] (0.2/3.3/7.5) | three-layer structural tabular grains |
| Emulsion E | 3.4 | 1.10 | 16 | 6 | [6/64/30] (0.2/2.7/5.5) | three-layer structural tabular grains |
| Emulsion F | 13.6 | 1.75 | 26 | 3 | [1/2] (41/0) | two-layer structural tabular grains |
| Emulsion G | 1.0 | 0.07 | 15 | 1 | — | uniform structural fine grains |
| Emulsion H | 13.6 | 1.45 | 27 | 3 | [1/2] (41/0) | two-layer structural tabular grains |

In Table A above;

(1) Emulsions A to F had been subjected to reduction sensitization with thiourea dioxide and thiophosphonic acid during formation of the grains, in accordance with the example of JP-A-2-191938 (corresponding to U.S. Pat. No. 5,061,614);

(2) Emulsions A to F has been subjected to gold sensitization, sulfur sensitization and selenium sensitization in the presence of the color sensitizing dyes to be in the respective light-sensitive layers and sodium thiocyanate, in accordance with the example of JP-A-3-237450 (corresponding to EP-A-443453);

(3) for preparation of tabular grains, a low molecular weight gelatin was used in accordance with the example of JP-A-1-158426; and (4) tabular grains were observed to have dislocation lines as described in JP-A-3-237450 (corresponding to EP-A-443453), with a high-pressure electronic microscope.

Chemical formulae of the compounds used above are mentioned below.

ExC-1

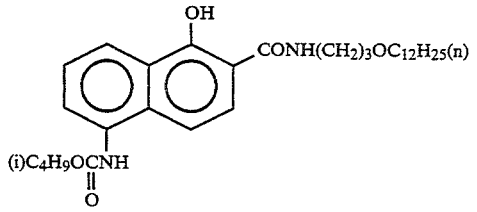

ExC-2

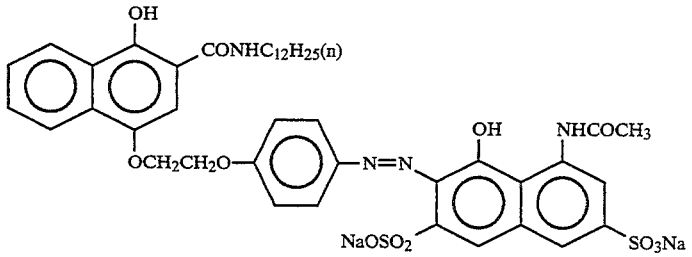

ExC-3

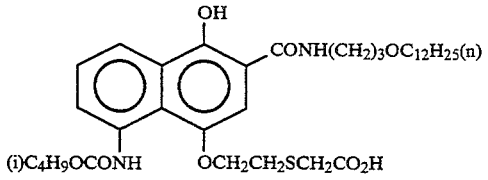

-continued
ExC-4
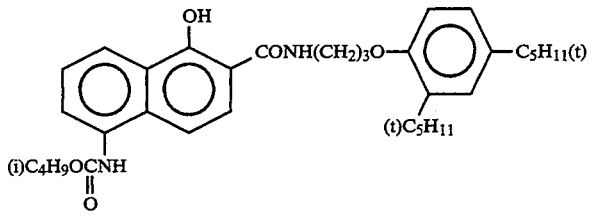
ExC-5
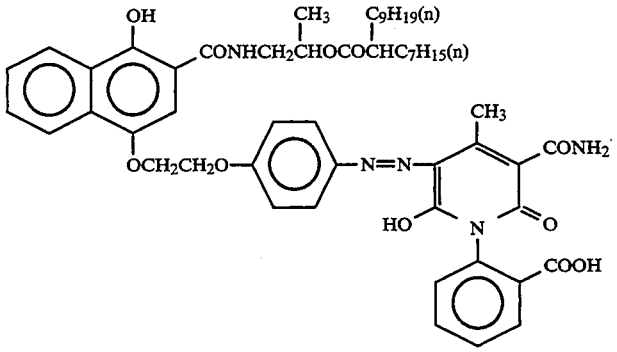
ExC-6
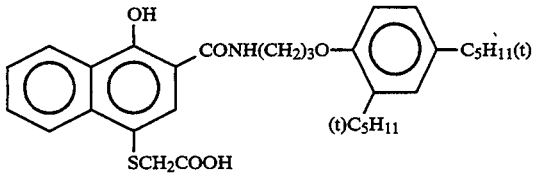
ExC-7
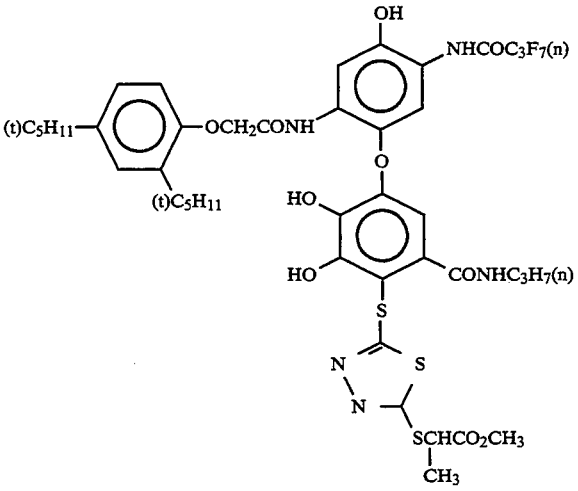
ExC-8
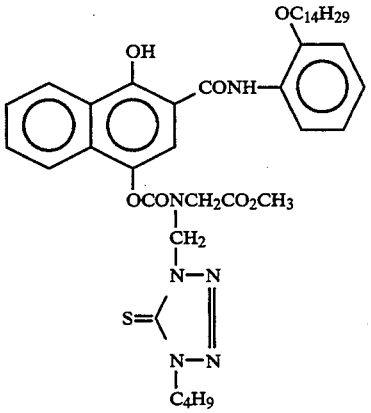

-continued
ExM-1
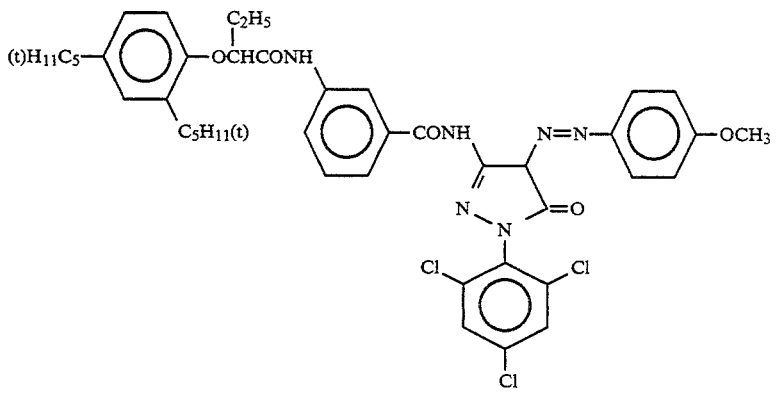
ExM-2
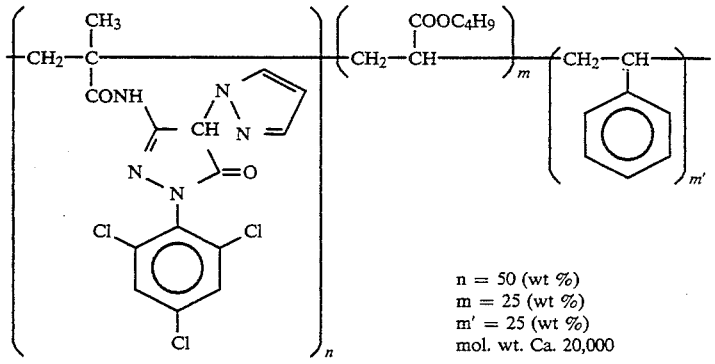
ExM-3
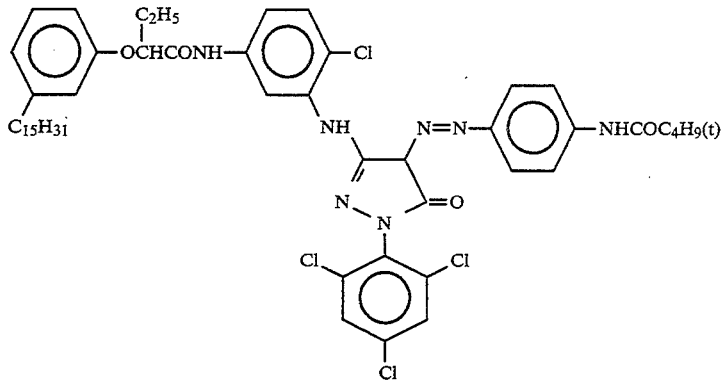
ExM-4
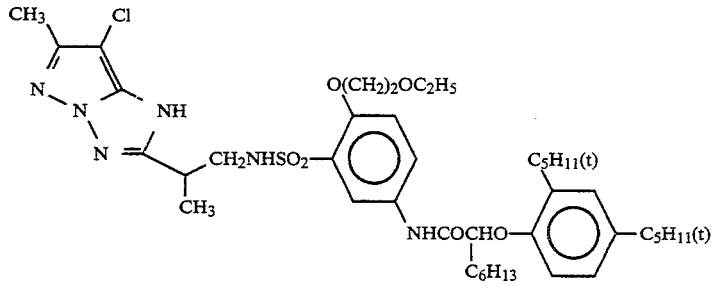

-continued
ExM-5
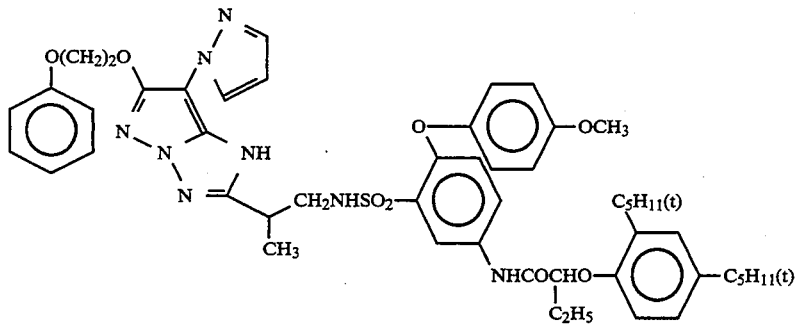
ExY-1
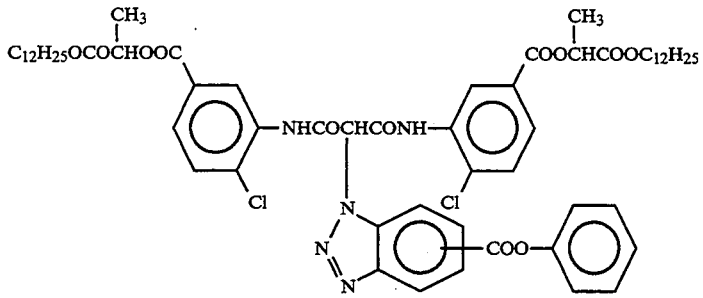
ExY-2
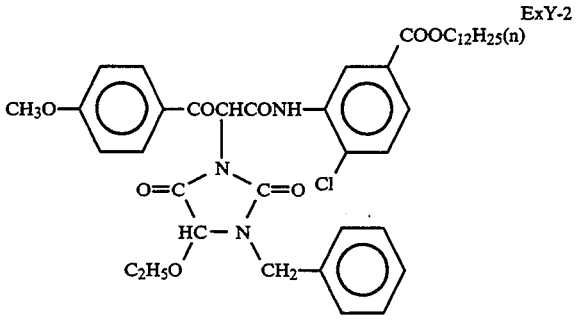
ExY-3
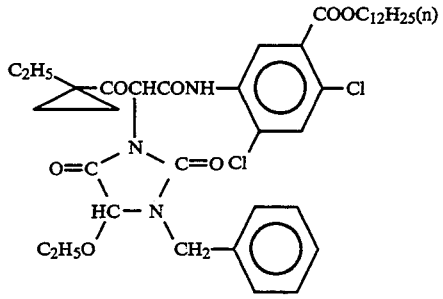
ExY-4
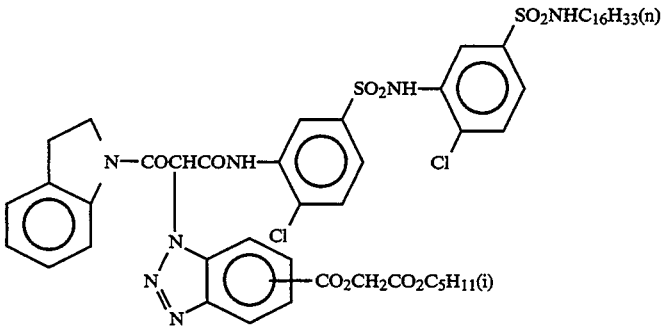
ExY-5
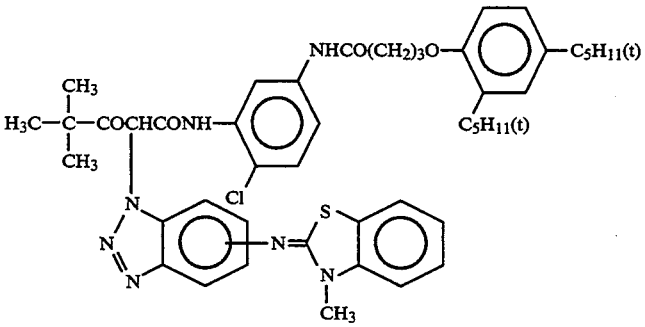

-continued
ExY-6
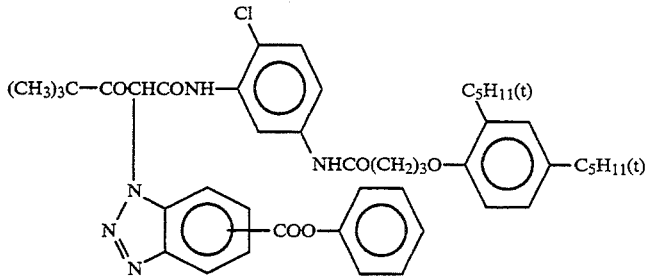
ExF-1
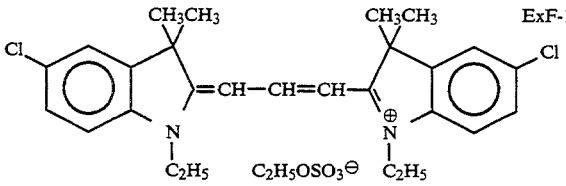
Cpd-1
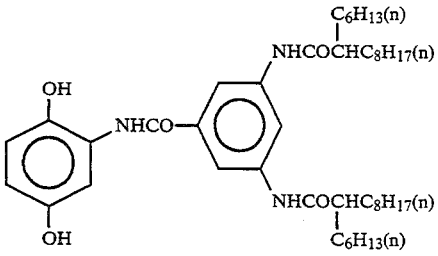
Cpd-2
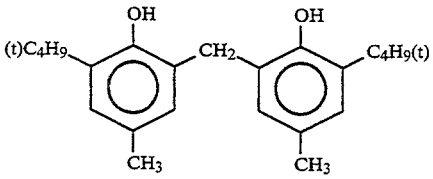
Cpd-3
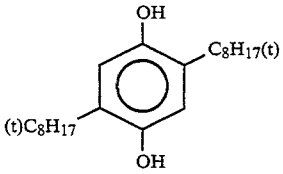
UV-1
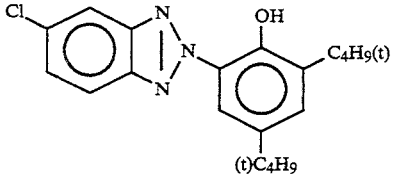
UV-2
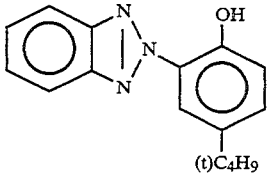
UV-3
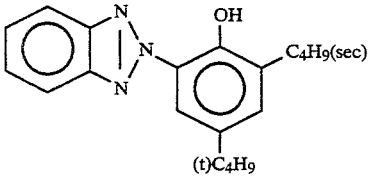
UV-4
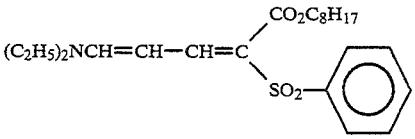
Tricresyl Phosphate HBS-1
Di-n-butyl Phthalate HBS-2
HBS-3
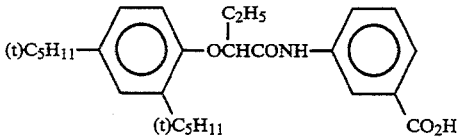
ExS-1
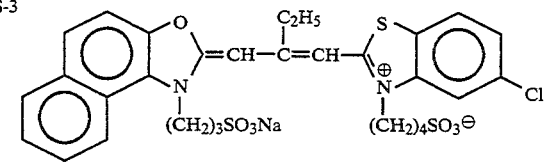
ExS-2
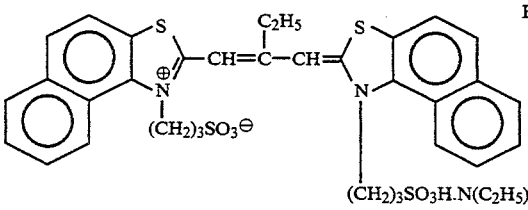
ExS-3
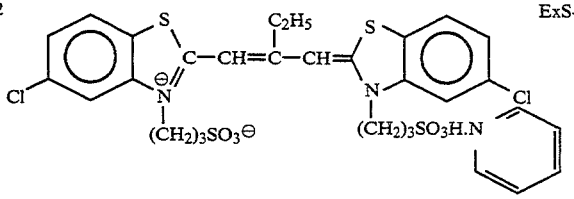

-continued
ExS-4
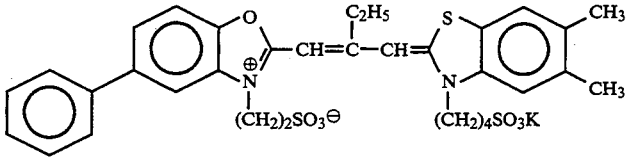
ExS-5
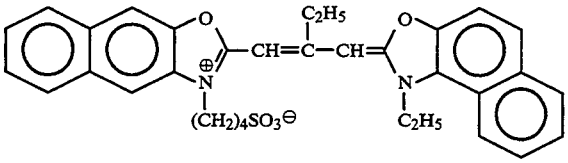
ExS-6
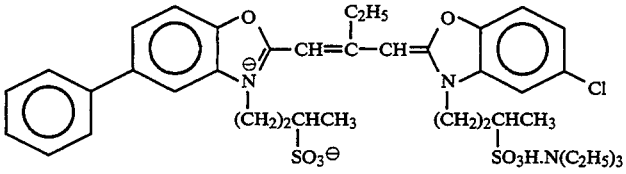
ExS-7
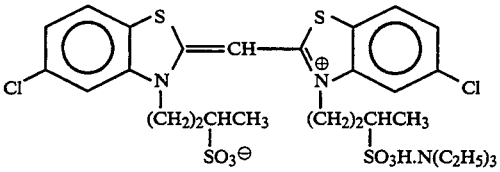
S-1
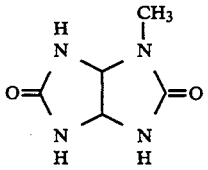
H-1
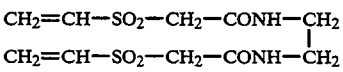
B-1
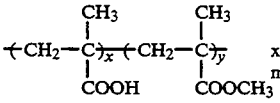
x/y = 10/90 (wt %)
mol. wt.: approx. 100,000
B-2
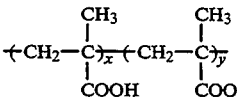
x/y = 40/60 (wt %)
mol. wt.: approx. 100,000
B-3
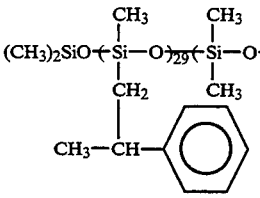
(29/46 wt %)
mol. wt.: approx. 100,000
B-4
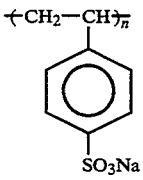
mol. wt.: approx. 1,000,000
B-5
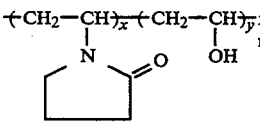
x/y = 70/30 (wt %)
mol. wt.: approx. 100,000
B-6
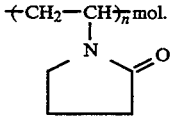
mol. wt.: approx. 10,000
W-1
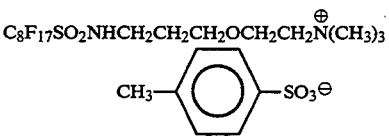

-continued
W-2
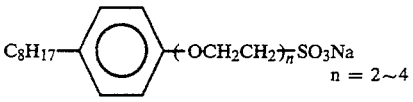
W-3
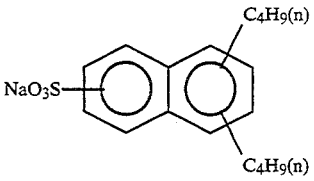
F-1
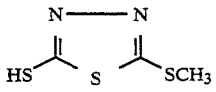
F-2
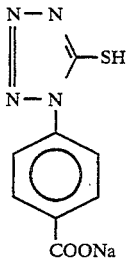
F-3
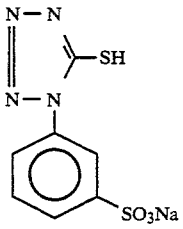
F-4
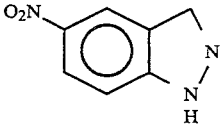
F-5
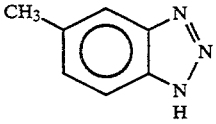
F-6
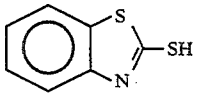
F-7
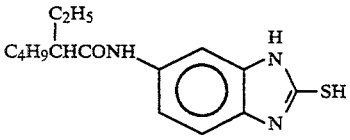
F-8
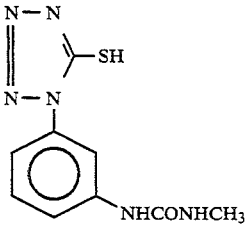
F-9
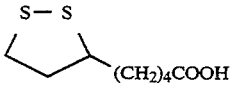
F-10
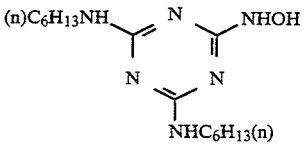
F-11
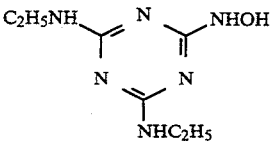
F-12
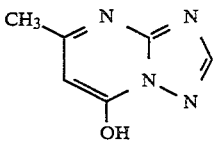
F-13
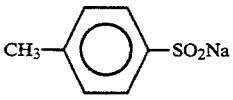
F-14
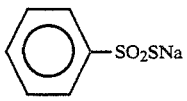
F-15
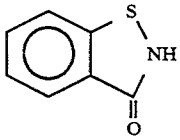
F-16
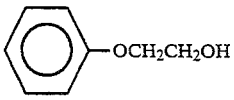

-continued

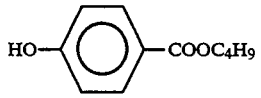

F-17

Samples 102 to 105 were prepared in the same manner as above, except that the emulsions and their amounts were changed to those as indicated in Table B below.

TABLE B

| Sample | 101 | 102 | 103 | 104 | 105 |
|---|---|---|---|---|---|
| 3rd layer (low-sensitivity red-sensitive emulsion layer) | A: 0.46 | A: 0.30 | A: 0.37 | A: 0.30 | A: 0.60 |
| 4th layer (middle-sensitivity red-sensitive emulsion layer) | D: 0.70 | B: 0.40<br>C: 0.30 | B: 0.30<br>C: 0.10<br>D: 0.30 | D: 0.60 | D: 0.80 |
| 5th layer (high-sensitivity red-sensitive emulsion layer) | E: 1.62 | D: 1.21 | D: 0.55<br>E: 0.85 | E: 1.62 | E: 1.62 |
| 7th layer (low-sensitivity green-sensitive emulsion layer) | A: 0.24<br>B: 0.10<br>C: 0.14 | A: 0.20<br>B: 0.10<br>C: 0.07 | A: 0.20<br>B: 0.10<br>C: 0.10 | A: 0.16<br>B: 0.10·<br>C: 0.07 | A: 0.28<br>B: 0.10<br>C: 0.20 |
| 8th layer (middle-sensitivity green-sensitive emulsion layer) | D: 0.94 | B: 0.53<br>C: 0.41 | B: 0.31<br>C: 0.15<br>D: 0.40 | D: 0.82 | D: 1.06 |
| 9th layer (high-sensitivity green-sensitive emulsion layer) | E: 1.29 | D: 1.04 | D: 0.50<br>E: 0.65 | E: 1.29 | E: 1.29 |
| 11th layer (low-sensitivity blue-sensitive emulsion layer) | A: 0.25<br>C: 0.25<br>D: 0.10 | A: 0.18<br>C: 0.15 | A: 0.20<br>C: 0.24 | A: 0.20<br>C: 0.20<br>D: 0.10 | A: 0.31<br>C: 0.30<br>D: 0.05 |
| 12th layer (high-sensitivity blue-sensitive emulsion layer) | F: 1.30 | H: 0.95 | F: 0.70<br>H: 0.45 | F: 1.30 | F: 1.30 |

The specific photographic sensitivity and the point gamma <γ> of each sample were obtained by the methods described hereinabove and are shown in Table C below.

Each sample was cut to a predetermined size and processed, and was cased in an ordinary metal patrone as a roll photographic material, which was loaded in the roll film room of a photographic material package unit with an exposure function. Thus, a photographic material-loaded photographic article with an exposure function was obtained. The focal length of the lens used in the article was 32 mm, and the F value thereof was 10.5. The shutter speed was fixed to be 1/100 second. The article was fitted with an electronic flash having a guide number of 9.5 for a photographic material with an ISO sensitivity of 100.

The thus-prepared photographic articles were imagewise exposed under anyone of the following conditions, and the exposed photographic materials were developed under the same condition as that employed for obtaining the specific photographic sensitivity. The developed photographic materials were printed onto Fuji Color SUPER FAV by an ordinary method.

Condition 1: The photographic article was imagewise exposed in the night with a distance of 3 meter from the object, using the electronic flash.

Condition 2: The photographic article was imagewise exposed in the night with a distance of 5 meter from the object, using the electronic flash. Condition 3: The photographic article was imagewise exposed in the night with a distance of 7 meter from the object, using the electronic flash.

Condition 4: The photographic article was imagewise exposed to the right light on a sunny day with a distance of 5 meter from the object, not using the electronic flash. (The illuminance of the object was about 30000 lux, having a so-called LV value (i.e., light value) of 13.)

Condition 5: The photographic article was imagewise exposed to the right light on a cloudy day with a distance of 5 meter from the object, not using the electronic flash. (The illuminance of the object was about 5000 lux, having a so-called LV value of 11 or less.)

Condition 6: The photographic article was imagewise exposed to the right light on a fine day at a skiing ground having a land height of 1,500 meters, with a distance of 5 meter from the object, not using the electronic flash. (The illuminance of the object was about 200000 lux, having a so-called LV value of 16.)

The results of the sensual evaluation of the color prints thus obtained are shown in Table C below. The sensual evaluation was conducted on the basis of the following criteria.

◎: Excellent.
○: Good.
Δ: Not good.
x: Bad.

TABLE C

| Sample | 101 sample of the invention | 102 comparative sample | 103 sample of the invention | 104 comparative sample | 105 sample of the invention |
|---|---|---|---|---|---|
| Specific Photographic Sensitivity Region with <γ> of 0.4 or more (as logE) | 840 | 430 | 650 | 830 | 850 |
| blue | 2.95 | 2.85 | 2.90 | 2.65 | 3.10 |
| green | 3.20 | 3.0 | 3.10 | 2.75 | 3.30 |
| red | 3.10 | 2.95 | 3.05 | 2.70 | 3.25 |
| Condition 1 | ◎ | ◎○ | ◎ | ◎ | ◎ |
| Condition 2 | ◎○ | Δ (flat with low saturation, due to a little under-exposure) | ○ | ◎○ | ◎○ |
| Condition 3 | ○ or Δ (a little flat due to a little under- | X (no visible picture formed, due to | Δ (flat due to a little under-exposure) | ○ or Δ (a little flat due to a little under- | ○ or Δ (a little flat due to a little under- |

TABLE C-continued

| Sample | 101 sample of the invention | 102 comparative sample | 103 sample of the invention | 104 comparative sample | 105 sample of the invention |
|---|---|---|---|---|---|
| | exposure) | extreme under-exposure) | | exposure) | exposure) |
| Condition 4 | ◎ | ◎ | ◎ | ○ | ◎ |
| Condition 5 | ◎ | Δ (flat with low saturation, due to a little under-exposure) | ○ | ◎ | ◎ |
| Condition 6 | ○ | ○ | ○ | Δ or X (flat and not sharp, with yellowed background) | ◎ |

As is noted from Table C above, Sample 102 having a film with a specific photographic sensitivity of less than 640 could not give satisfactory pictures when exposed under the cloudy condition 5. When several persons were desired to be photographed in one frame of the photographic material in Sample 102, using the built-in electronic flash under the condition 2, the power of the electronic flash was insufficient so that the system sensitivity of the photographic article was insufficient. As opposed to this, it is noted that the samples of the present invention having a photographic material with a specific photographic sensitivity of not less than 640 all gave satisfactory pictures even when exposed under the cloudy condition and that they also gave almost satisfactory pictures even when exposed under the condition 2 or the condition 3 using the built-in electronic flash.

Regarding Sample 104 having a film, of which the region of the point gamma ($<\gamma>=dD/dlogE$) of being not less than 0.4 is in the range of not more than 2.8 as logE, could not give a satisfactory picture under the glaring condition 6. From the results, the effectiveness of the present invention is obvious.

EXAMPLE 2

This example demonstrates more clearly the effect of the present invention, which is augmented by enlarging the interlayer effect IE (X/Y) of the photographic materials in the photographic articles of the present invention.

Samples 206 to 208 were prepared in the same manner as in Example 1 preparing Sample 101, except that the AgI contents in the emulsions of the red-sensitive layers and the green-sensitive layers were varied to those indicated in Table D below and that the amounts of the emulsions in the red-sensitive layers and the green-sensitive layers were varied to 1.2 times (in Sample 206), 1.35 times (in Sample 207) and 0.85 times (in sample 208) those in Sample 101.

TABLE D

| Sample | 101 | 206 | 207 | 208 |
|---|---|---|---|---|
| 3rd layer low-sensitivity red-sensitive emulsion layer) | A: 2.0% | A': 3.5% | A'': 4.7% | A''': 0.87% |
| 4th layer (middle-sensitivity red-sensitive emulsion layer) | D: 4.1% | D': 7.15% | D'': 9.6% | D''': 1.79% |
| 5th layer (high-sensitivity red-sensitive emulsion layer) | E: 3.4% | E': 5.93% | E'': 8.01% | E''': 1.49% |
| 7th layer (low-sensitivity green-sensitive emulsion layer) | A: 2.0%<br>B: 9.0%<br>C: 3.0% | A': 3.5%<br>B: 9.0%<br>C': 5.3% | A'': 4.7%<br>B: 9.0%<br>C'': 7.06% | A''': 0.87%<br>B': 4.5%<br>C''': 1.31% |
| 8th layer (middle-sensitivity green-sensitive emulsion layer) | D: 4.1% | D': 7.15% | D'': 9.6% | D''': 1.79% |
| 9th layer (high-sensitivity green-sensitive emulsion layer) | E: 3.4% | E': 5.93% | E'': 8.01% | E''': 1.49% |
| Average AgI content in all red-sensitive layers | 3.34% | 5.84% | 7.86% | 1.46% |
| Average AgI content in all green-sensitive layers | 3.70% | 6.22% | 8.26% | 1.64% |

Using these photographic material samples, photographic material-loaded photographic articles were formed in the same manner as in Example 1 and were exposed under anyone of the conditions 2, 4 and 5 of Example 1. The developed photographic materials were printed onto color papers also in the same manner as in Example 1 and the thus-obtained pictures were evaluated by the same sensual evaluation as that in Example 1. The interlayer effects of these samples were measured by the method mentioned hereinabove.

The results obtained are shown in Table E below.

TABLE E

| Sample | 101 sample of the invention | 102 comparative sample | 206 sample of the invention | 207 sample of the invention | 208 sample of the invention |
|---|---|---|---|---|---|
| Specific Photographic Sensitivity Region with <γ> of 0.4 or more (as logE) | 840 | 430 | 820 | 790 | 850 |
| blue | 2.95 | 2.85 | 2.96 | 2.95 | 2.96 |
| green | 3.20 | 3.0 | 3.23 | 3.29 | 3.15 |
| red | 3.10 | 2.95 | 3.14 | 3.18 | 3.07 |
| Interlayer Effect | good | good | a little insufficient | insufficient | a little insufficient |
| IE (R/G) | 0.26 | 0.27 | 0.10 | 0.08 | 0.12 |
| IE (R/B) | 0.08 | 0.09 | 0.06 | 0.06 | 0.02 |
| IE (G/R) | 0.22 | 0.23 | 0.07 | 0.05 | 0.09 |
| IE (G/B) | 0.24 | 0.25 | 0.23 | 0.25 | 0.17 |
| IE (B/G) | 0.09 | 0.10 | 0.01 | 0 | 0 |
| IE (B/R) | 0.15 | 0.26 | 0.01 | 0 | 0.02 |
| Condition 2 | ◎ ○ | Δ (flat with low saturation, due to a little under-exposure) | ○ (sharp, but a little low saturation) | ○ (sharp, but low saturation) | ○ (sharp, but a little low saturation) |
| Condition 4 | ◎ | ◎ | ◎ or ○ | ○ (a little low saturation) | ◎ or ○ |
| Condition 5 | ◎ | Δ (flat with low saturation, due to a little under-exposure) | ◎ or ○ | ○ (sharp, but low saturation) | ◎ or ○ |

From Table E above, it is noted that the photographic materials having the interlayer effects falling within the preferred ranges mentioned hereinabove gave good pictures with high saturation, when exposed under the conditions 2 and 5.

As has been explained in detail hereinabove, the present invention provides a photographic material-loaded photographic article with an exposure function, in which the loaded photographic material has a specific photographic sensitivity of 640 or more and is characterized in that the region of the point gamma of being 0.4 or more is in the range of 2.8 or more as logE. The photographic article of the present invention gives satisfactory photographs under various light conditions, for example, for popular indoor photographing and also for cloudy or fine, daytime outdoor photographing. More favorably, the interlayer effects of the photographic material to be in the article are defined to fall within particular ranges, whereby photographs having a higher saturation are given by the article.

While the invention has been described in detail and with reference to specific embodiments thereof, it will be apparent to one skilled in the art that various changes and modifications can be made therein without departing from the spirit and scope thereof.

What is claimed is:

1. A photographic product having an exposure function, which has therein a built-in color photographic material comprising a support having provided thereon at least one red-sensitive silver halide emulsion layer, at least one green-sensitive silver halide emulsion layer and at least one blue-sensitive silver halide emulsion layer and having a specific photographic sensitivity of 640 or more, wherein the built-in color photographic material is characterized by blue, green and red density function curves D (logE) in which in each curve a region defined by a gamma (<γ>=dD/dlogE) of 0.4 or more has a logE of 2.8 or more, wherein interlayer effects are present in the built-in color photographic material in the following magnitude IE (X/Y):

$0.15 < IE\ (R/G)$, $-0.05 < IE\ (R/B)$, $0.10 < IE\ (G/R)$, $0.15 < IE\ (G/B)$, $0.03 < IE\ (B/G)$, and $0.15 < IE\ (B/R)$, wherein IE (X/Y) indicates the magnitude of the interlayer effect from a color-sensitive layer x to a color-sensitive layer Y, and G, B and R indicate a green-sensitive layer, a blue-sensitive layer and a red-sensitive layer, respectively, wherein all the at least one red-sensitive layer and all the at least one green-sensitive layer have silver halide emulsions having a mean AgI content of from 2 to 5 mol %.

2. The photographic product as claimed in claim 1, which has a built-in electronic flash, a built-in lens with a fixed aperture and a built-in shutter with a fixed shutter speed.

3. The photographic product as claimed in claim 2, wherein the fixed aperture of the lens is from 8 to 16, the fixed shutter speed of the shutter is from 1/50 to 1/200 second and the guide number of the electronic flash is from 7.5 to 15 for a photographic material having an ISO sensitivity of 100.

4. The photographic product as claimed in claim 1, wherein the support of the photographic material is a polyethylene-aromatic dicarboxylate polyester support, having a glass transition point of from 50° C. to 200° C., and the support has been heat-treated at a temperature of from 40° C. to its glass transition point, before or after having been coated with one or more subbing layers but before being coated with any emulsion layer.

* * * * *